US011485547B2

(12) United States Patent
Gaskey et al.

(10) Patent No.: US 11,485,547 B2
(45) Date of Patent: Nov. 1, 2022

(54) HIGH-INTEGRITY OPAQUE-INSET PANEL ENVELOPE, AND METHOD FOR MANUFACTURING THE SAME

(71) Applicant: FISERV, INC., Brookfield, WI (US)

(72) Inventors: Jason Corbitt Gaskey, Sugar Land, TX (US); Hrishikesh Shashikant Karekar, Sugar Land, TX (US); Santosh Kumar, Stafford, TX (US); Stephen Orlando Bozzone, Danville, IN (US)

(73) Assignee: FISERV, INC., Brookfield, WI (US)

( * ) Notice: Subject to any disclaimer, the term of this patent is extended or adjusted under 35 U.S.C. 154(b) by 180 days.

(21) Appl. No.: 16/811,277

(22) Filed: Mar. 6, 2020

(65) Prior Publication Data

US 2020/0299032 A1 Sep. 24, 2020

Related U.S. Application Data

(60) Provisional application No. 62/822,104, filed on Mar. 22, 2019.

(51) Int. Cl.

| | |
|---|---|
| ***B65D 27/16*** | (2006.01) |
| ***B65D 27/00*** | (2006.01) |
| ***B65D 27/04*** | (2006.01) |

(52) U.S. Cl.

CPC ..... *B65D 27/16* (2013.01); *B65D 27/005* (2013.01); *B65D 27/04* (2013.01)

(58) Field of Classification Search

CPC ..... B65D 27/04; B65D 27/16; B65D 27/005
USPC ..... 229/68.1
See application file for complete search history.

(56) References Cited

U.S. PATENT DOCUMENTS

| | | | | |
|---|---|---|---|---|
| 3,869,964 | A | 3/1975 | Kranz | |
| 3,897,720 | A | 8/1975 | Hiersteiner | |
| 4,072,264 | A | 2/1978 | Kranz | |
| 4,640,030 | A | 2/1987 | Wood et al. | |
| 5,648,143 | A * | 7/1997 | Mehta | C09J 123/08 229/80 |
| 5,894,986 | A * | 4/1999 | Lederman | B65D 27/04 283/56 |
| 5,927,592 | A * | 7/1999 | Kranz | B65D 27/04 229/71 |

(Continued)

OTHER PUBLICATIONS

Notice of Allowance and Fee(s) Due for U.S. Appl. No. 29/780,135, dated Sep. 7, 2022, (15 pages), United States Patent and Trademark Office, US.

*Primary Examiner* — Peter N Helvey
(74) *Attorney, Agent, or Firm* — Alston & Bird LLP

(57) ABSTRACT

A high-integrity opaque-inset panel envelope includes a front panel formed from a printable material, one or more apertures being defined therethrough, one or more flaps extending from the edges of the front panel, and one or more opaque inset panels/labels disposed on an inner surface of the front panel to cover the one or more apertures. Opaque inset panels can have an optical brightness about 1-6% greater than the optical brightness of the printable material. The envelope can be formed by removing portions of a printable material to form one or more flaps about a front panel and one or more apertures through the front panel and disposing one or more opaque inset panels to an inner surface of the front panel, such that the one or more opaque inset panels covers the one or more apertures.

21 Claims, 29 Drawing Sheets

(56) References Cited

U.S. PATENT DOCUMENTS

| | | | | |
|---|---|---|---|---|
| 5,967,403 | A | 10/1999 | Kranz | |
| D434,438 | S | 11/2000 | Kara | |
| D512,094 | S | 11/2005 | Mandeel | |
| D516,123 | S | 2/2006 | Vanderpool | |
| D517,661 | S | 3/2006 | Wolf | |
| 9,751,112 | B1 * | 9/2017 | Delfer | B42D 15/0053 |
| D858,632 | S | 9/2019 | Penn | |
| 2014/0183251 | A1 * | 7/2014 | Miller | B31B 70/26 493/227 |
| 2018/0162597 | A1 * | 6/2018 | Jobe | B65D 65/40 |

* cited by examiner

HIGH-INTEGRITY OPAQUE-INSET PANEL ENVELOPE, AND METHOD FOR MANUFACTURING THE SAME

CROSS-REFERENCE TO RELATED APPLICATIONS

This application claims priority to and the benefit of U.S. Provisional Patent Application No. 62/822,104, filed Mar. 22, 2019, entitled "High-Integrity Opaque-Inset Panel Envelope," the entire disclosure of which is hereby incorporated herein by reference for all purposes.

BACKGROUND

Envelopes are used to enclose and retain mail transmitted between a sender and a receiver. Envelopes are used because they carry sender and/or receiver information, carry postage or postage payment information, carry routing information, and provide some protection for the enclosed mail.

BRIEF SUMMARY

A high-integrity opaque-inset panel envelope includes a front panel formed from a printable material, one or more apertures being defined therethrough, one or more flaps extending from the edges of the front panel, and one or more opaque inset panels disposed on an inner surface of the front panel to cover the one or more apertures. Opaque labeling panels and/or opaque inset panels can have an optical brightness about 1-6% greater than the optical brightness of the printable material. The envelope can be formed by removing portions of a printable material to form one or more flaps about a front panel and one or more apertures through the front panel and disposing one or more opaque inset panels to an inner surface of the front panel such that the one or more opaque inset panels covers the one or more apertures.

According to a first embodiment, an envelope construction is provided that comprises: a front panel formed from a printable material, the front panel comprising an inside surface and one or more apertures through the front panel, the one or more apertures defining one or more windows having a plurality of window edges; and one or more opaque inset panels coupled to the inside surface of the front panel, the one or more opaque inset panels being positioned on the inside surface of the front panel such that an opaque inset panel of the one or more opaque inset panels covers each of the one or more apertures such that the one or more apertures through the front panel are substantially sealed. In some embodiments, the one or more opaque inset panels are coupled to the inside surface of the front panel using an adhesive. In some embodiments, the adhesive comprises one of a back gum, a seam gum, a glue, an epoxy, a fugitive glue, a resin, a dextrin-containing adhesive, a fastening agent, a sealing agent, a water-soluble adhesive, a polymer, a cross-linking agent, an ethylene vinyl acetate copolymer, a polyvinyl alcohol, starches, animal glues, and mixtures thereof. In some embodiments, the printable material and the one or more opaque inset panels are coated with and/or comprise one or more hydrophobic materials. In some embodiments, a flux of moisture and dust from an outside surface of the front panel to the inside surface of the front panel is less than a flux threshold. In some embodiments, the one or more opaque inset panels overlap one or more inside edges of the one or more apertures defined through the front panel by between about 1 mm and about 1 inch. In some embodiments, the front panel further comprises an outside surface, and wherein the one or more opaque inset panels comprise a front surface and a back surface, the one or more opaque inset panels coupled to the inside surface of the front panel such that a portion of the front surface of each of the one or more opaque panels is viewable through a respective aperture of the one or more apertures through the front panel of the envelope construction. In some embodiments, the inside surface of the front panel has a first optical brightness and the front surface of each of the one or more opaque inset panels has a second optical brightness that is between about 1% and about 10% greater than the first optical brightness. In some embodiments, the inside surface of the front panel has an optical brightness that is 95 or less and the front surface of each of the one or more opaque inset panels has an optical brightness that is greater than 95. In some embodiments, the one or more apertures comprise a quantity of apertures between two and about ten, wherein the one or more opaque inset panels comprise a quantity of opaque inset panels between two and about ten, and wherein the quantity of apertures and the quantity of opaque inset panels is the same.

According to a second embodiment, a method for forming an envelope can be provided. In some embodiments, the method can comprise: providing an envelope blank comprising a front panel formed from a printable material, the front panel comprising an inside surface and one or more apertures through the front panel, the one or more apertures defining one or more windows having a plurality of window edges; and coupling one or more opaque inset panels to the inside surface of the front panel, the one or more opaque inset panels being positioned on the inside surface of the front panel such that an opaque inset panel of the one or more opaque inset panels covers each of the one or more apertures such that the one or more apertures through the front panel are substantially sealed. In some embodiments, the method can further comprise: disposing an adhesive to one or more of the inside surface of the front panel at one or more locations adjacent to the plurality of window edges of each of the one or more apertures or a front surface of each of the one or more opaque inset panels at one or more locations adjacent to a plurality of edges of each of the one or more opaque inset panels. In some embodiments, the adhesive comprises one of a back gum, a seam gum, a glue, an epoxy, a fugitive glue, a resin, a dextrin-containing adhesive, a fastening agent, a sealing agent, a water-soluble adhesive, a polymer, a cross-linking agent, an ethylene vinyl acetate copolymer, a polyvinyl alcohol, starches, animal glues, and mixtures thereof. In some embodiments, the printable material and the one or more opaque inset panels are coated with and/or comprise one or more hydrophobic materials. In some embodiments, a flux of moisture and dust from an outside surface of the front panel to the inside surface of the front panel is less than a flux threshold. In some embodiments, the one or more opaque inset panels overlap one or more inside edges of the one or more apertures defined through the front panel by between about 1 mm and about 1 inch. In some embodiments, the front panel further comprises an outside surface, and wherein the one or more opaque inset panels comprise a front surface and a back surface, the one or more opaque inset panels coupled to the inside surface of the front panel such that a portion of the front surface of each of the one or more opaque panels is viewable through a respective aperture of the one or more apertures through the front panel of the envelope construction. In some embodiments, the inside surface of the front panel has a first optical brightness and the front surface of each of the one or more opaque inset panels has a second optical brightness that is between about 1% and about 10% greater than the first optical brightness. In some embodiments, the inside surface of the front panel has an optical brightness that is 95 or less and the front surface of each of the one or more opaque inset panels has an optical brightness that is greater than 95. In some embodiments, the method can further comprise: printing one or more of a mailing address, a return address, a unique identifier, a logo, an advertisement, a background, a picture, or a symbol onto the front side of each of the one of the one or more opaque inset panels. In some embodiments, the one or more apertures comprise a quantity of apertures between two and about ten, wherein the one or more opaque inset panels comprise a quantity of opaque inset panels between two and about ten, and wherein the quantity of apertures and the quantity of opaque inset panels is the same.

According to a third embodiment, an envelope construction can be provided that comprises: an envelope blank formed from a continuous sheet of a printable material, the envelope blank comprising a front panel having an inside surface and an outside surface, one or more apertures being defined through the front panel; and one or more opaque inset panels having a front surface and a back surface, the one or more opaque inset panels being coupled to the inside surface of the front panel, the one or more opaque inset panels being positioned on the inside surface of the front panel such that a portion of the front surface of each of the one or more opaque panels is viewable through a respective aperture of the one or more apertures when viewing the outside surface of the front panel and such that the one or more opaque inset panels cover said one or more apertures, thereby sealing the front panel, wherein the inside surface of the front panel has a first optical brightness and the front surface of each of the one or more opaque inset panels has a second optical brightness that is between about 1% and about 10% greater than the first optical brightness.

According to a fourth embodiment, an envelope construction (also referred to herein as "an envelope") can comprise: a front panel formed from a printable material, one or more apertures being defined therethrough; one or more flaps formed integrally from the printable material and extending from one or more edges of the front panel, the one or more flaps being configured to form a back panel of the envelope construction when suitably folded about the one or more edges of the front panel and coupled to the front panel; and one or more opaque inset panels disposed on an inner surface of the front panel and covering the one or more apertures. In some embodiments, the one or more opaque inset panels are adhesively coupled to the inner surface of the front panel. In some embodiments, once the one or more flaps are folded about the one or more edges of the front panel and coupled to the front panel, an assembled envelope is formed. In some embodiments, the printable material comprises or is coated with a hydrophobic material. In some embodiments, the one or more flaps are coupled to the front panel by an adhesive material disposed therebetween. In some embodiments, once the assembled envelope is formed, a flux of moisture and dust from outside the assembled envelope into an inner volume of the assembled envelope is less than a flux threshold. In some embodiments, the printable material has a first optical brightness and the one or more opaque inset panels have a second optical brightness greater than the first optical brightness. In some embodiments, a difference between the second optical brightness and the first optical brightness is greater than about 1% of the first optical brightness. In some embodiments, a difference between the second optical brightness and the first optical brightness is greater than about 5% of the first optical brightness.

According to a fifth embodiment, a method for forming an envelope can comprise: providing a printable material; removing one or more portions of the printable material to form one or more external edges of one or more flaps; defining a folding edge in the printable material at an inside edge of each of the one or more flaps to define a front panel of the envelope and one or more flaps; removing one or more other portions of the printable material to define one or more apertures through the front panel; and disposing one or more opaque inset panels to an inner surface of the front panel, such that the one or more opaque inset panels covers the one or more apertures. In some embodiments, the one or more flaps are configured to form a back panel of the envelope when each of the one or more flaps are suitably folded respectively about the folding edge and coupled to the front panel or another of the one or more flaps. In some embodiments, disposing the one or more opaque inset panels to the inner surface of the front panel comprises adhesively coupling the one or more opaque inset panels to the inner surface of the front panel. In some embodiments, the printable material comprises or is coated with a hydrophobic material. In some embodiments, the method can further comprise: adhesively coupling a portion of the one or more flaps to the inside surface of the front panel to form the back panel of the envelope and an inner volume of the envelope; disposing at least one piece of mail into the inner volume of the envelope; and adhesively coupling a remaining portion of the one or more flaps to the inside surface of the front panel to seal the envelope against flux of moisture and contaminants into the inner volume of the envelope.

According to a sixth embodiment, an apparatus is provided that comprises at least one processor and at least one memory storing instructions, the at least one memory storing instructions, with the at least one processor, configured to cause the apparatus to at least: cause the formation and assembly of an envelope. In some embodiments, the at least one memory storing instructions, with the at least one processor, can cause the apparatus to at least: provide a printable material; remove one or more portions of the printable material to form one or more external edges of one or more flaps; define a folding edge in the printable material at an inside edge of each of the one or more flaps to define a front panel of the envelope and one or more flaps; remove one or more other portions of the printable material to define one or more apertures through the front panel; and disposing one or more opaque inset panels to an inner surface of the front panel, such that the one or more opaque inset panels covers the one or more apertures. In some embodiments, the one or more flaps are configured to form a back panel of the envelope when each of the one or more flaps are suitably folded respectively about the folding edge and coupled to the front panel or another of the one or more flaps. In some embodiments, disposing the one or more opaque inset panels to the inner surface of the front panel comprises adhesively coupling the one or more opaque inset panels to the inner surface of the front panel. In some embodiments, the printable material comprises or is coated with a hydrophobic material. In some embodiments, the at least one memory storing instructions, with the at least one processor, can cause the apparatus to at least: adhesively couple a portion of the one or more flaps to the inside surface of the front panel to form the back panel of the envelope and an inner volume of the envelope; dispose at least one piece of mail into the inner volume of the envelope; and adhesively couple a remaining portion of the one or more flaps to the inside surface of the front panel to seal the envelope against flux of moisture and contaminants into the inner volume of the envelope.

According to a seventh embodiment, a computer program product is provided that comprises a non-transitory computer-readable medium storing computer code, the computer code operable to cause an apparatus to at least: cause the formation and assembly of an envelope. In some embodiments, the computer code can be operable to cause the apparatus to at least: provide a printable material; remove one or more portions of the printable material to form one or more external edges of one or more flaps; define a folding edge in the printable material at an inside edge of each of the one or more flaps to define a front panel of the envelope and one or more flaps; remove one or more other portions of the printable material to define one or more apertures through the front panel; and dispose one or more opaque inset panels to an inner surface of the front panel such that the one or more opaque inset panels covers the one or more apertures. In some embodiments, the one or more flaps are configured to form a back panel of the envelope when each of the one or more flaps are suitably folded respectively about the folding edge and coupled to the front panel or another of the one or more flaps. In some embodiments, disposing the one or more opaque inset panels to the inner surface of the front panel comprises adhesively coupling the one or more opaque inset panels to the inner surface of the front panel. In some embodiments, the printable material comprises or is coated with a hydrophobic material. In some embodiments, the computer code can be operable to cause the apparatus to at least: adhesively couple a portion of the one or more flaps to the inside surface of the front panel to form the back panel of the envelope and an inner volume of the envelope; dispose at least one pieces of mail into the inner volume of the envelope; and adhesively couple a remaining portion of the one or more flaps to the inside surface of the front panel to seal the envelope against flux of moisture and contaminants into the inner volume of the envelope.

According to an eighth embodiment, an envelope construction is provided that comprises: an envelope shell formed from a continuous sheet of a printable material, the envelope shell having a front panel and defining an inner volume configured to receive one or more pieces of mail, one or more apertures being defined through the front panel; and one or more opaque inset panels disposed on an inner surface of the front panel and covering the one or more apertures. In some embodiments, the one or more opaque inset panels are coupled to the inner surface of the front panel. In some embodiments, the envelope shell further comprises: one or more flaps integrally formed from the continuous sheet of printable material and foldable about one or more edges of the front panel to form a back panel of the envelope construction when coupled to the front panel. In some embodiments, the printable material comprises or is coated with a hydrophobic material. In some embodiments, the one or more flaps, when folded about the one or more edges of the front panel, are coupled to the front panel by an adhesive material disposed therebetween. In some embodiments, the printable material has a first optical brightness and the one or more opaque inset panels have a second optical brightness that is between about 1% and about 6% greater than the first optical brightness.

According to a ninth embodiment, a method is provided for sorting, selecting, and addressing envelopes, the method comprising: disposing ink, according to a predetermined pattern indicative of desired printed content, onto an opaque inset panel, the desired printed content comprising one or more of text, numbers, a bar code, a QR code, a symbol, a mark, an illustration, an image, or the like. The method can further comprise disposing the opaque inset panel onto an inside surface of an unassembled envelope. In some embodiments, the opaque inset panel can be disposed on to the inside surface of an unassembled envelope in order to cover or partially cover an aperture or opening defined through the front of the envelope. In some embodiments, one or more of the printed content on the opaque inset panel can be used to identify a type, a size, a configuration, a client name, a client identifier, a mailing type, an envelope code, or the like. In some embodiments, the method can further comprise providing one or more items of mail; and selecting, based at least in part upon, one or more of a size, shape, mass, thickness, volume, or other characteristic(s) of the one or more items of mail, a particular envelope and one or more particular opaque inset panels to which desired printed content is to be printed. In some embodiments, the method can further comprise: once the desired printed content is printed on the one or more opaque inset panels, the one or more opaque inset panels being disposed onto an inside of the front of the envelope, and a respective piece of mail is disposed within an inner volume of the envelope, sealing the envelope to enclose the piece of mail within the envelope. In some embodiments, the method can further comprise: sorting a plurality of sealed envelopes enclosing a respective piece of mail based at least upon one or more of the printed content on a front side of each respective opaque inset panel. In some embodiments, a common identifier can be printed onto a portion of each envelope shell and a portion of each opaque inset panel such that, once the correct envelope shell is selected for the respective piece of mail to be mailed, an opaque inset panel can be selected, based at least upon the common identifier, that has a correct size, a correct shape, and/or a correct other characteristic for the associated envelope shell, the associated piece of mail, the particular application, and/or other requirements.

According to a tenth embodiment, an apparatus is provided that comprises at least one processor and at least one memory storing instructions, the at least one memory storing instructions, with the at least one processor, configured to cause the apparatus to at least: sort, select, and/or address envelopes. In some embodiments, the at least one memory storing instructions, with the at least one processor, can cause the apparatus to at least: dispose ink, according to a predetermined pattern indicative of desired printed content, onto an opaque inset panel, the desired printed content comprising one or more of text, numbers, a bar code, a QR code, a symbol, a mark, an illustration, an image, or the like. In some embodiments, the at least one memory storing instructions, with the at least one processor, can cause the apparatus to at least: dispose the opaque inset panel onto an inside surface of an unassembled envelope. In some embodiments, the opaque inset panel can be disposed on to the inside surface of an unassembled envelope in order to cover or partially cover an aperture or opening defined through the front of the envelope. In some embodiments, one or more of the printed content on the opaque inset panel can be used to identify a type, a size, a configuration, a client name, a client identifier, a mailing type, an envelope code, or the like. In some embodiments, the at least one memory storing instructions, with the at least one processor, can cause the apparatus to at least: provide one or more items of mail; and select based at least in part upon one or more of a size, shape, mass, thickness, volume, or other characteristic(s) of the one or more items of mail, a particular envelope and one or more particular opaque inset panels to which desired printed content is to be printed. In some embodiments, the at least one memory storing instructions, with the at least one processor, can cause the apparatus to at least: once the desired printed content is printed on the one or more opaque inset panels, the one or more opaque inset panels being disposed onto an inside of the front of the envelope, and a respective piece of mail is disposed within an inner volume of the envelope, seal the envelope to enclose the piece of mail within the envelope. In some embodiments, the at least one memory storing instructions, with the at least one processor, can cause the apparatus to at least: sort a plurality of sealed envelopes enclosing a respective piece of mail based at least upon one or more of the printed content on a front side of each respective opaque inset panel. In some embodiments, a common identifier can be printed onto a portion of each envelope shell and a portion of each opaque inset panel such that, once the correct envelope shell is selected for the respective piece of mail to be mailed, an opaque inset panel can be selected, based at least upon the common identifier, that has a correct size, a correct shape, and/or a correct other characteristic for the associated envelope shell, the associated piece of mail, the particular application, and/or other requirements.

According to an eleventh embodiment, a computer program product is provided that comprises a non-transitory computer-readable medium storing computer code, the computer code operable to cause an apparatus to at least: sort, select, and/or address envelopes. In some embodiments, the computer code can be operable to cause the apparatus to at least: dispose ink, according to a predetermined pattern indicative of desired printed content, onto an opaque inset panel, the desired printed content comprising one or more of text, numbers, a bar code, a QR code, a symbol, a mark, an illustration, an image, or the like. In some embodiments, the computer code can be operable to cause the apparatus to at least: dispose the opaque inset panel onto an inside surface of an unassembled envelope. In some embodiments, the opaque inset panel can be disposed on to the inside surface of an unassembled envelope in order to cover or partially cover an aperture or opening defined through the front of the envelope. In some embodiments, one or more of the printed content on the opaque inset panel can be used to identify a type, a size, a configuration, a client name, a client identifier, a mailing type, an envelope code, or the like. In some embodiments, the computer code can be operable to cause the apparatus to at least: provide one or more items of mail; and select based at least in part upon one or more of a size, shape, mass, thickness, volume, or other characteristic(s) of the one or more items of mail, a particular envelope and one or more particular opaque inset panels to which desired printed content is to be printed. In some embodiments, the computer code can be operable to cause the apparatus to at least: once the desired printed content is printed on the one or more opaque inset panels, the one or more opaque inset panels being disposed onto an inside of the front of the envelope, and a respective piece of mail is disposed within an inner volume of the envelope, sealing the envelope to enclose the piece of mail within the envelope. In some embodiments, the computer code can be operable to cause the apparatus to at least: sorting a plurality of sealed envelopes enclosing a respective piece of mail based at least upon one or more of the printed content on a front side of each respective opaque inset panel. In some embodiments, a common identifier can be printed onto a portion of each envelope shell and a portion of each opaque inset panel such that once the correct envelope shell is selected for the respective piece of mail to be mailed, an opaque inset panel can be selected, based at least upon the common identifier, that has a correct size, a correct shape, and/or a correct other characteristic for the associated envelope shell, the associated piece of mail, the particular application, and/or other requirements.

BRIEF DESCRIPTION OF THE DRAWINGS

Figure 1:
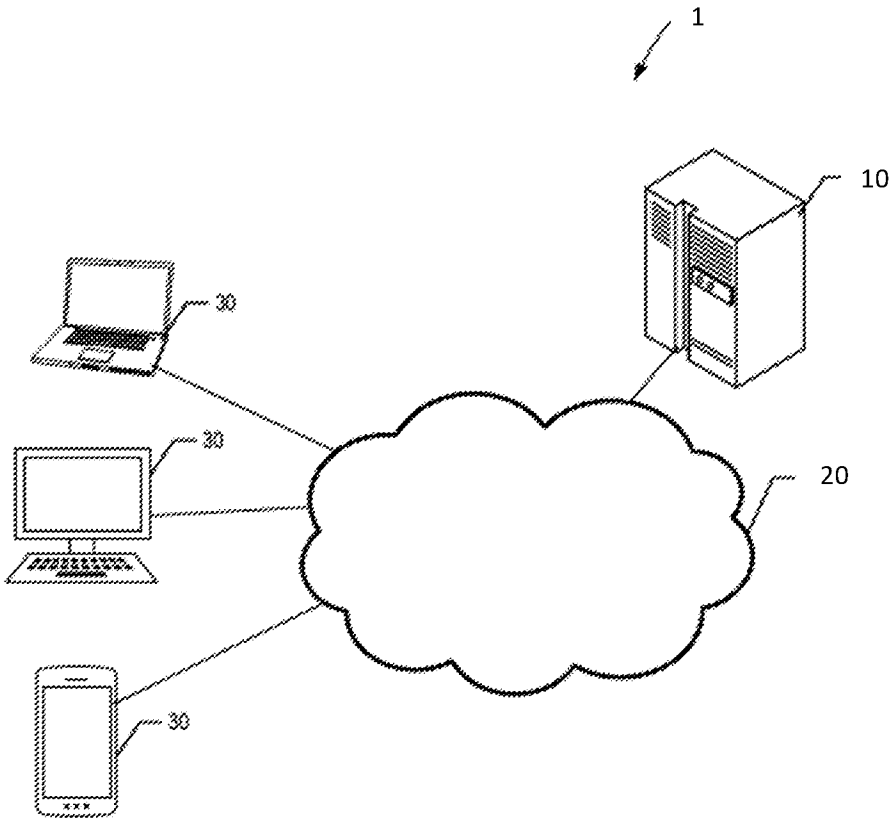
Figure 2A:
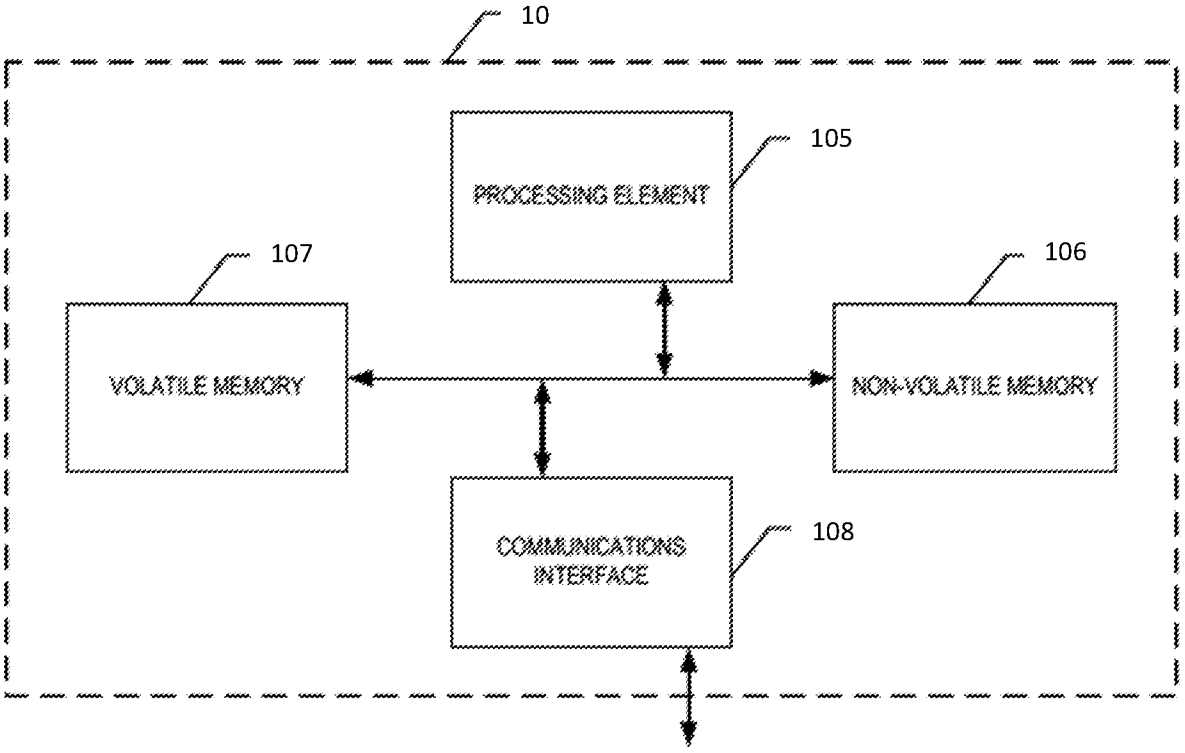
Figure 2B:
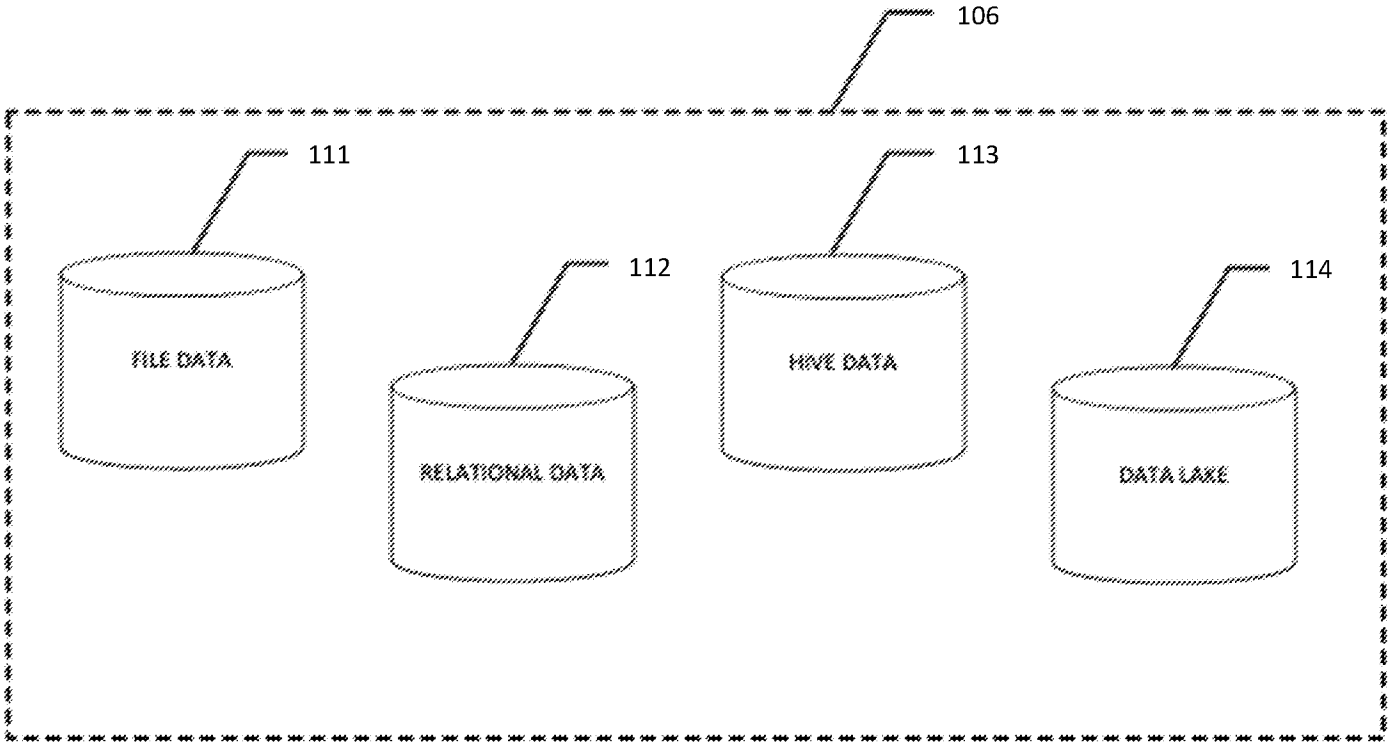
Figure 3:
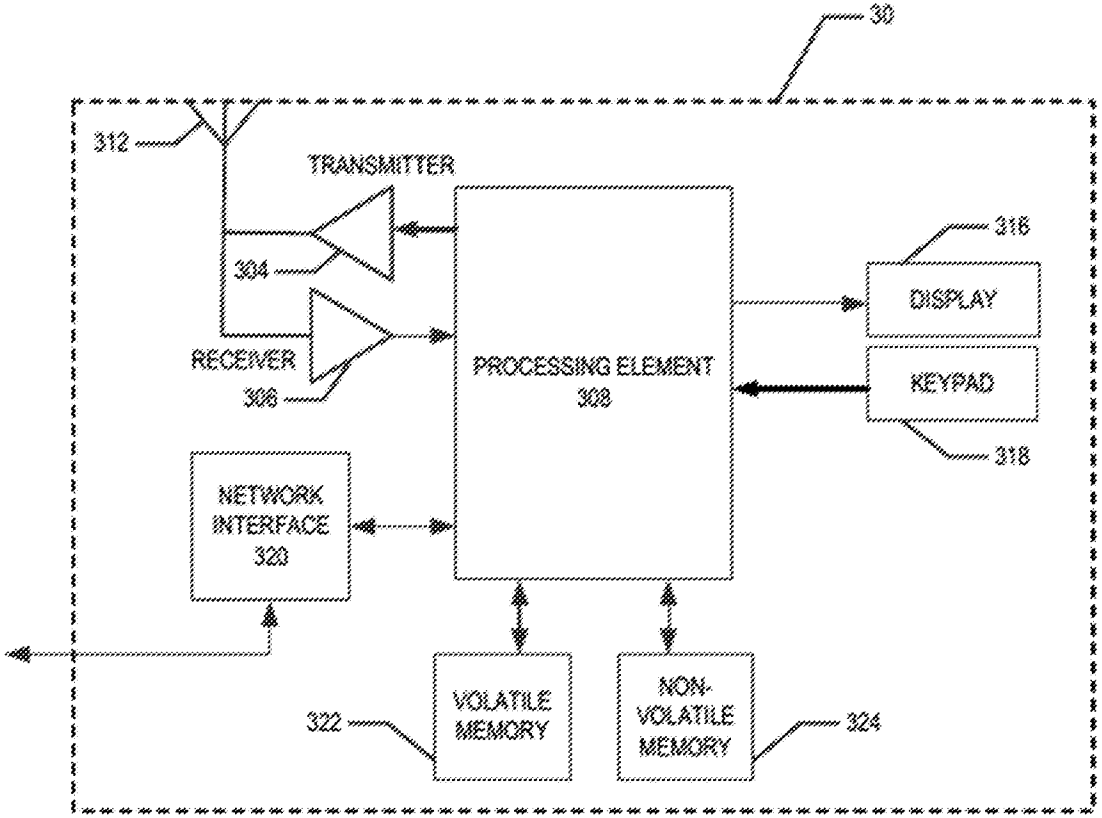
Figure 4A:
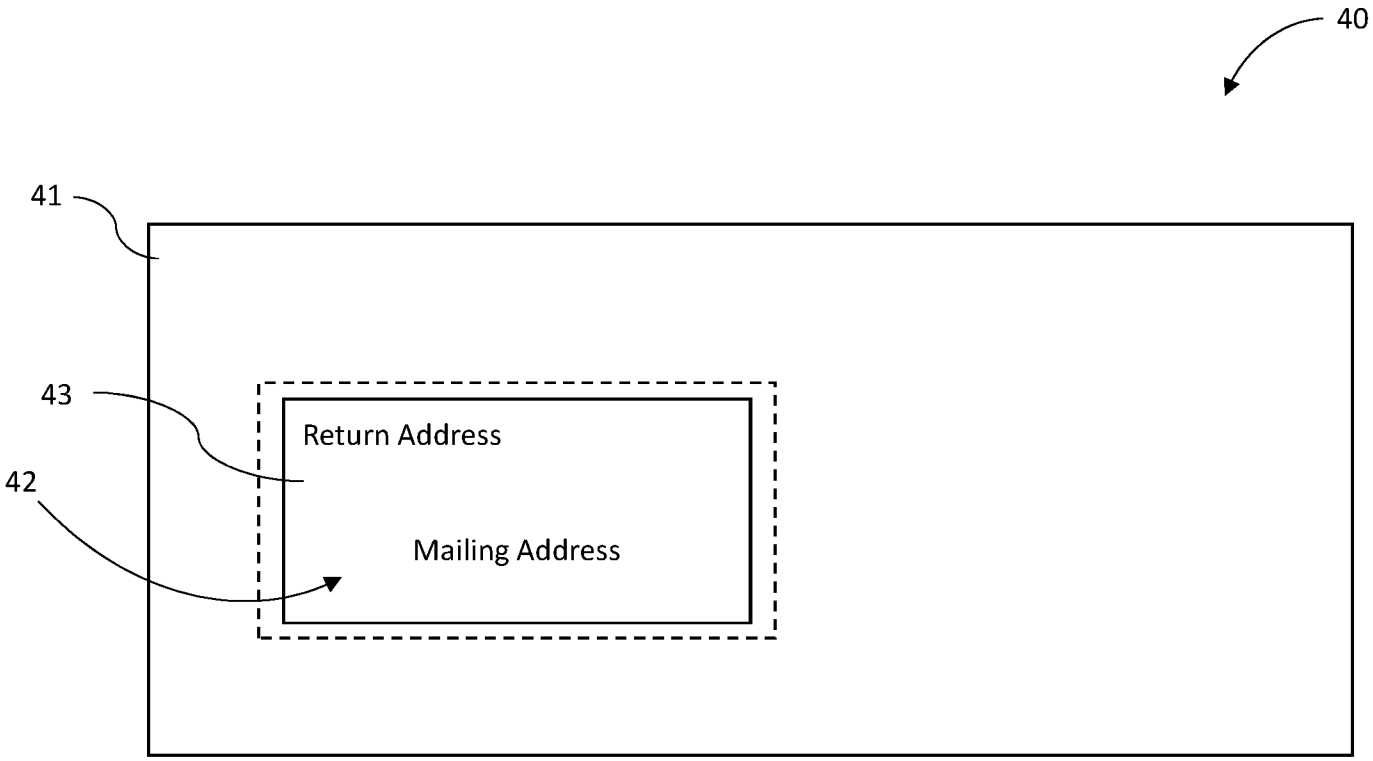
Figure 4B:
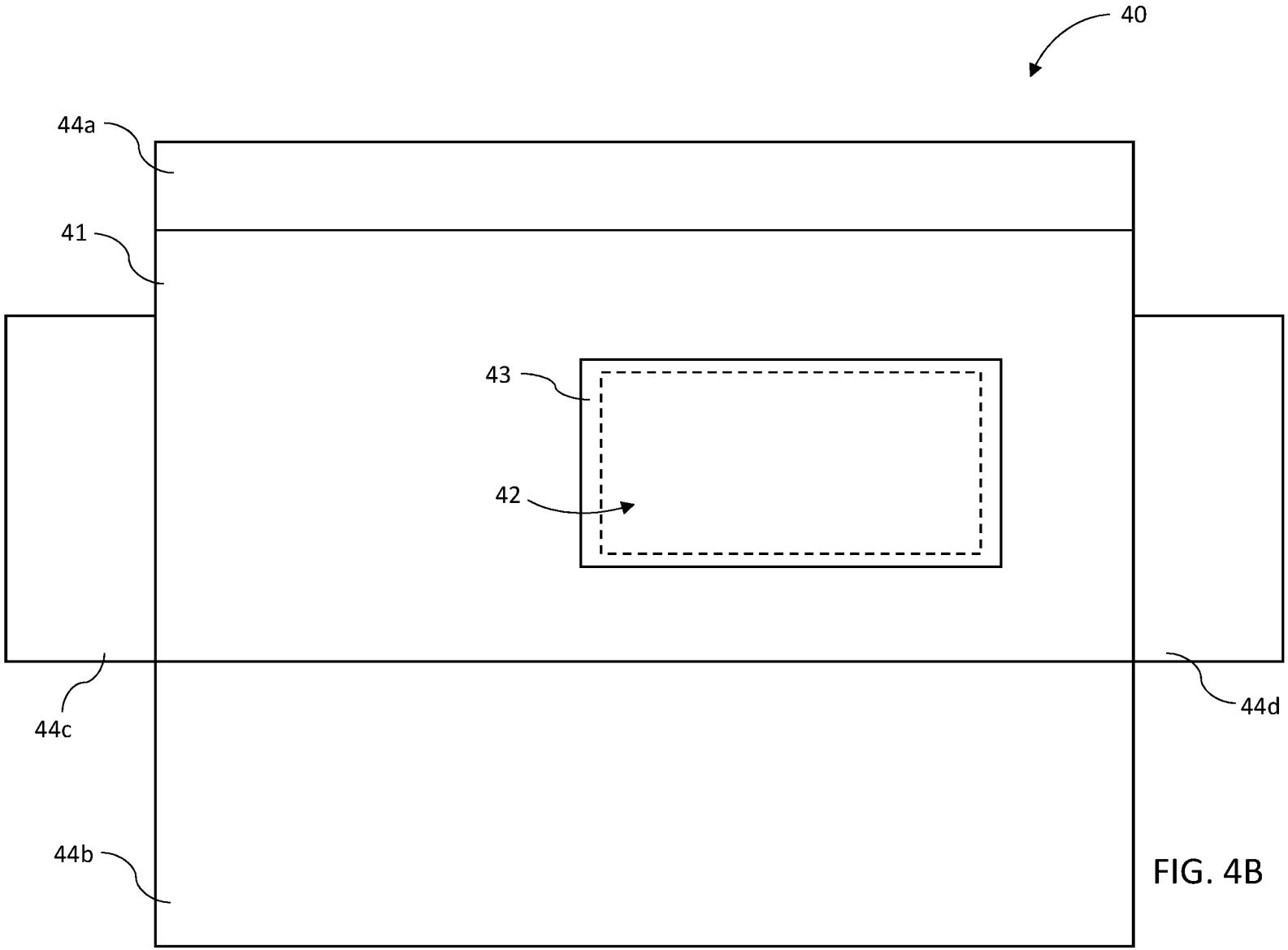
Figure 5:
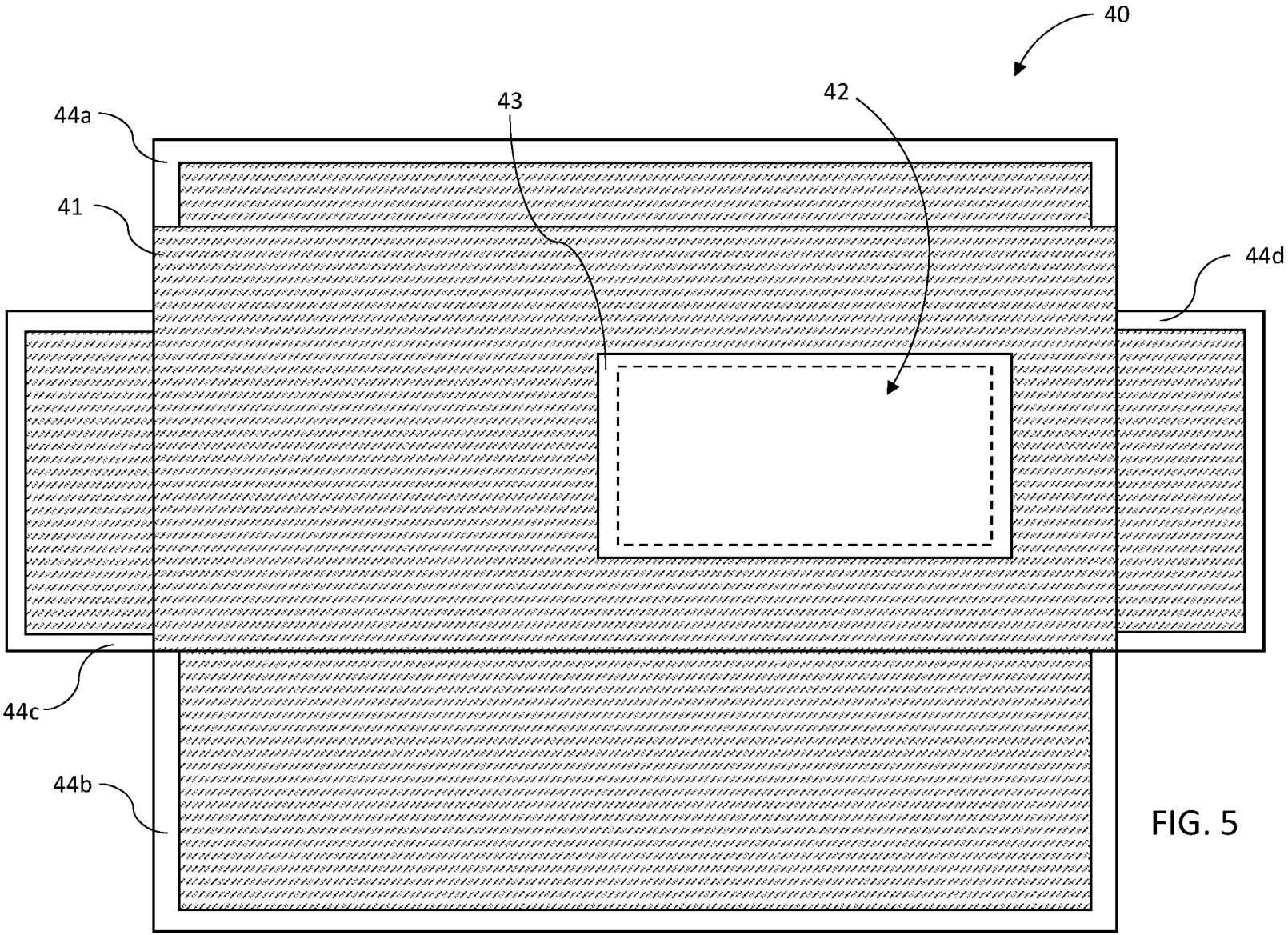
Figure 6A:
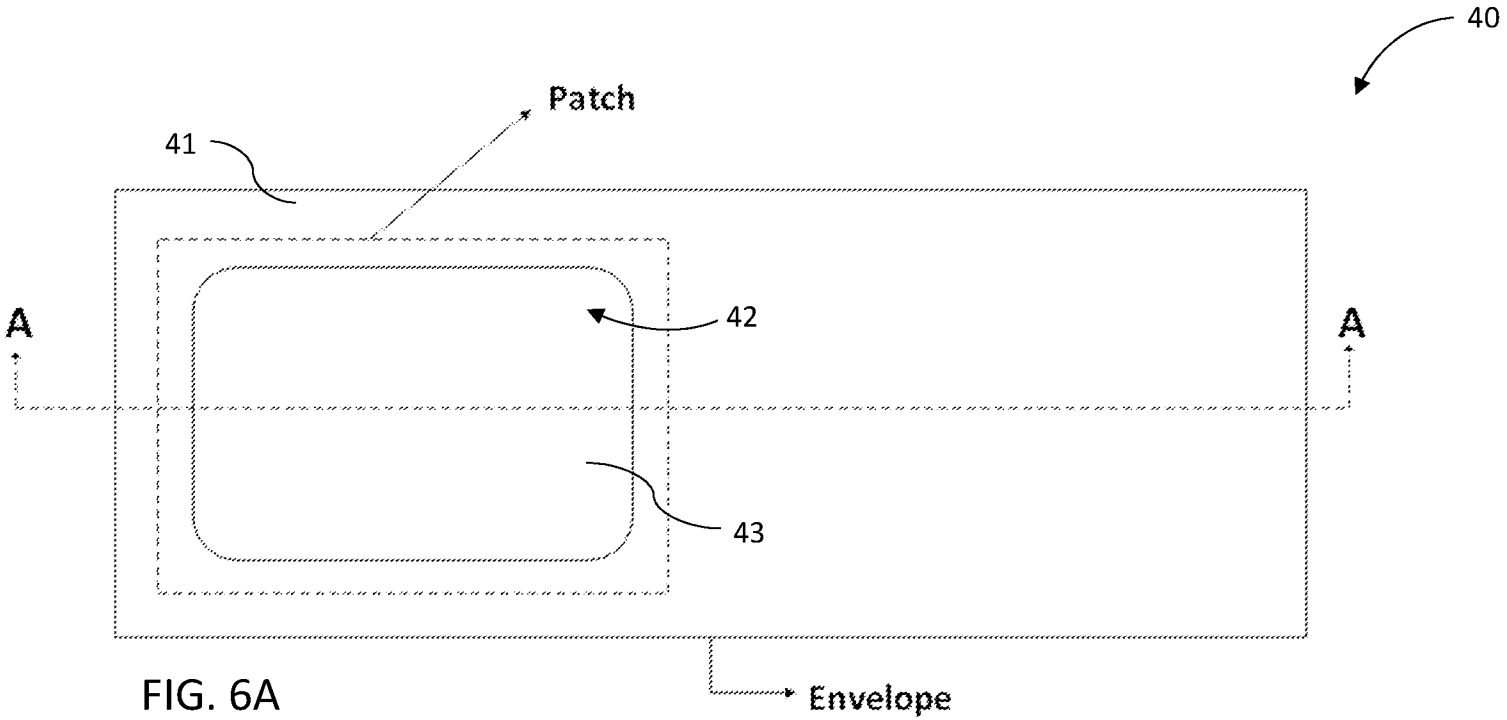
Figure 6B:
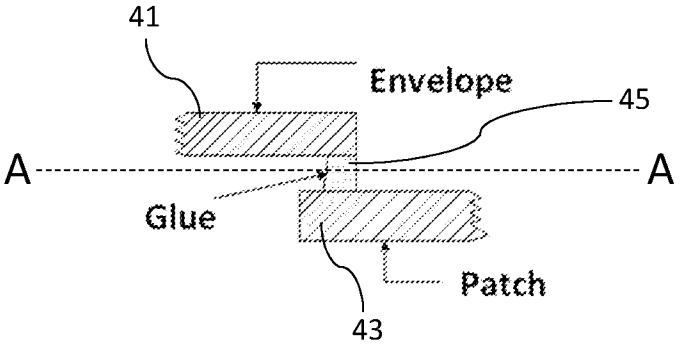
Figure 6C:
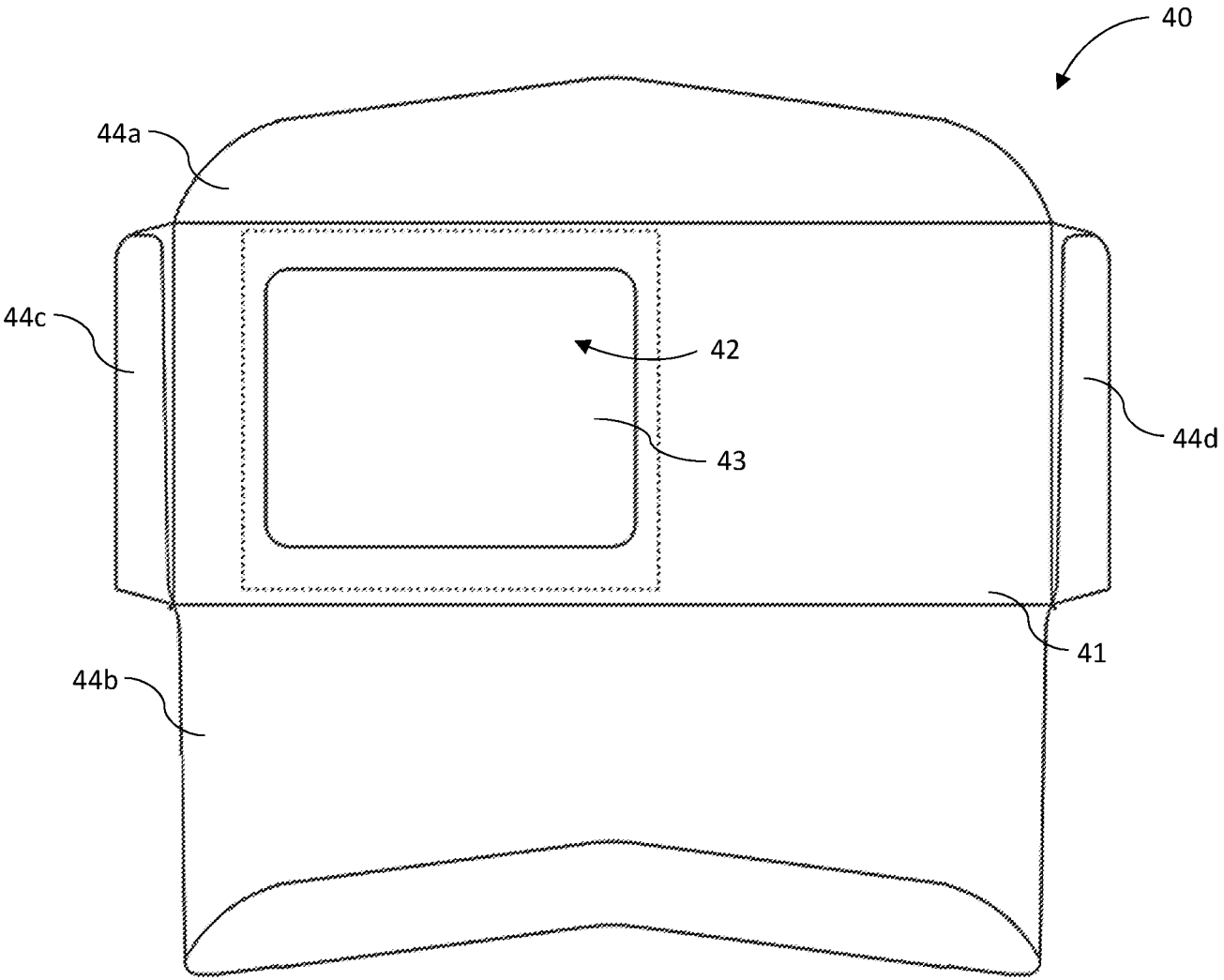
Figure 7:
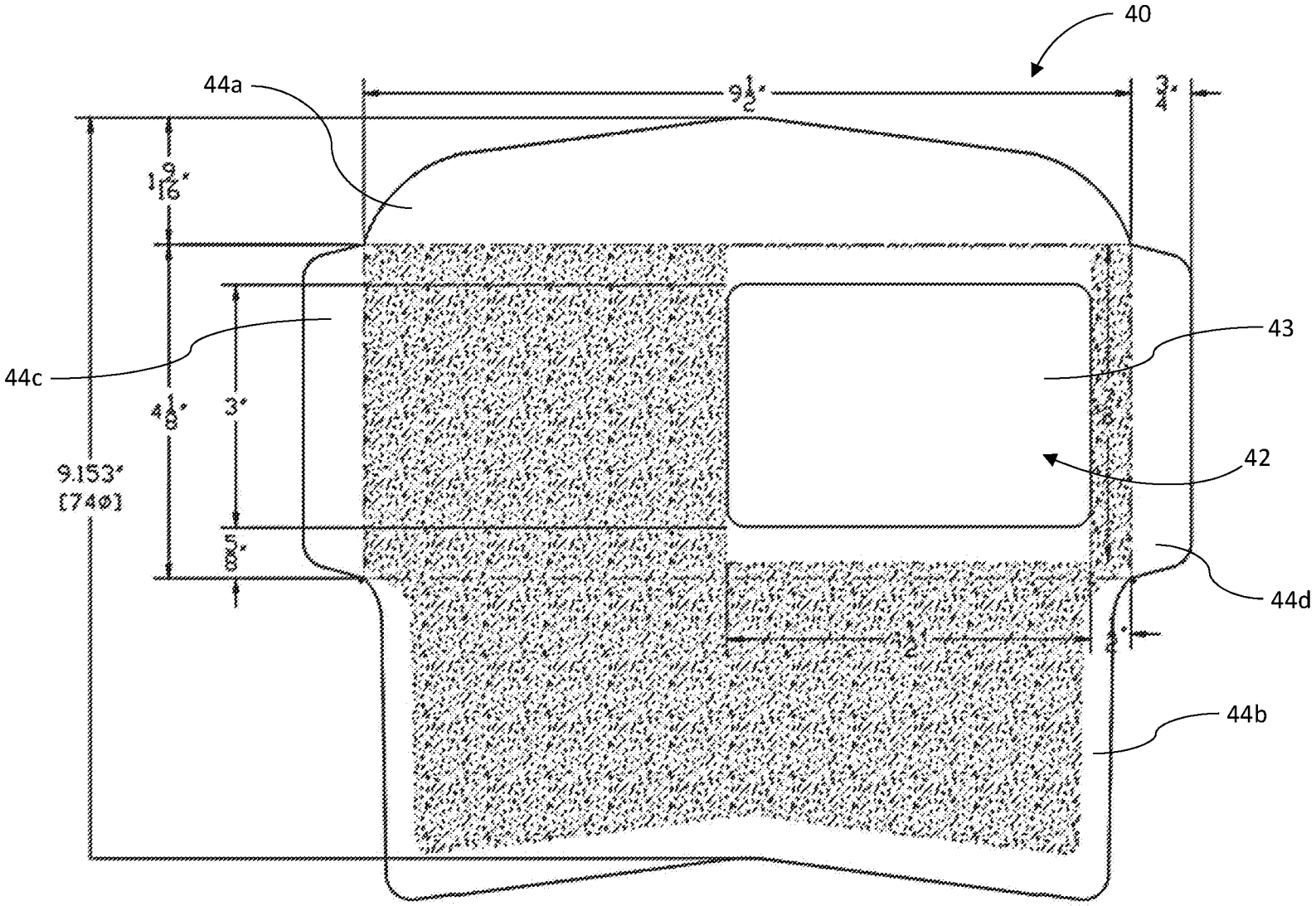
Figure 8:
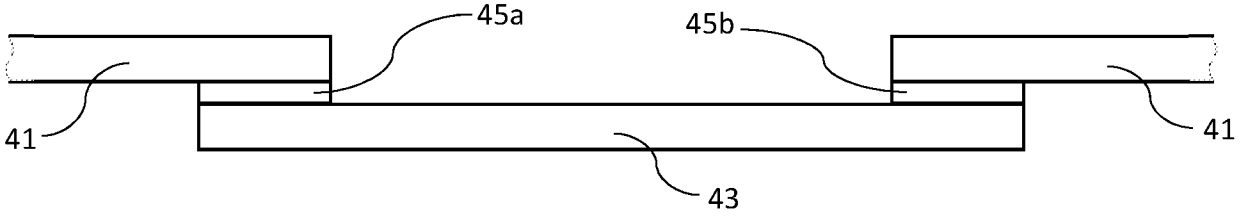
Figure 9A:
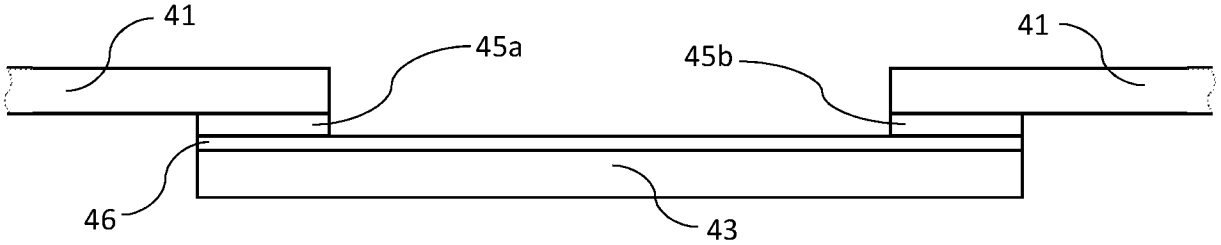
Figure 9B:
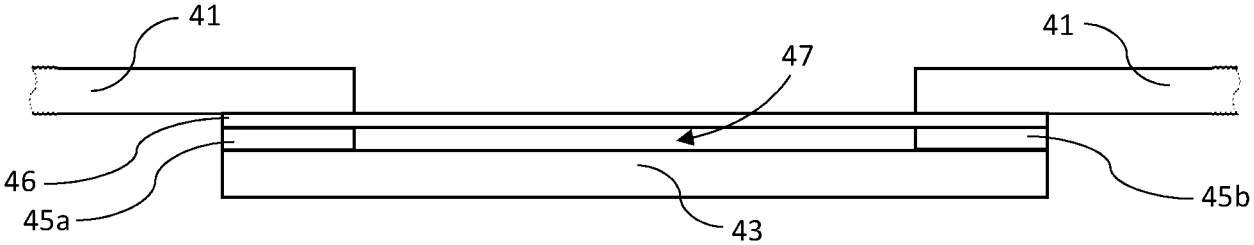
Figure 10A:
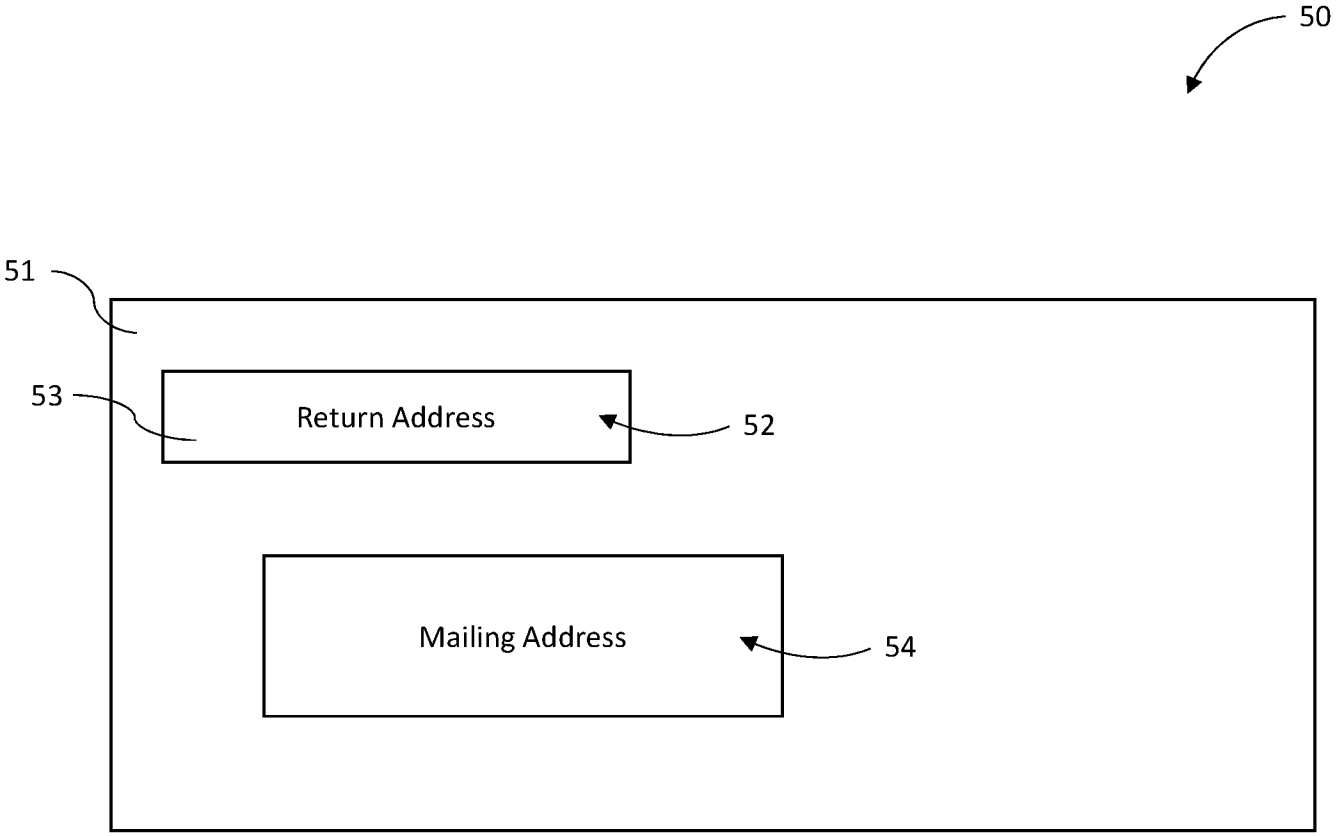
Figure 10B:
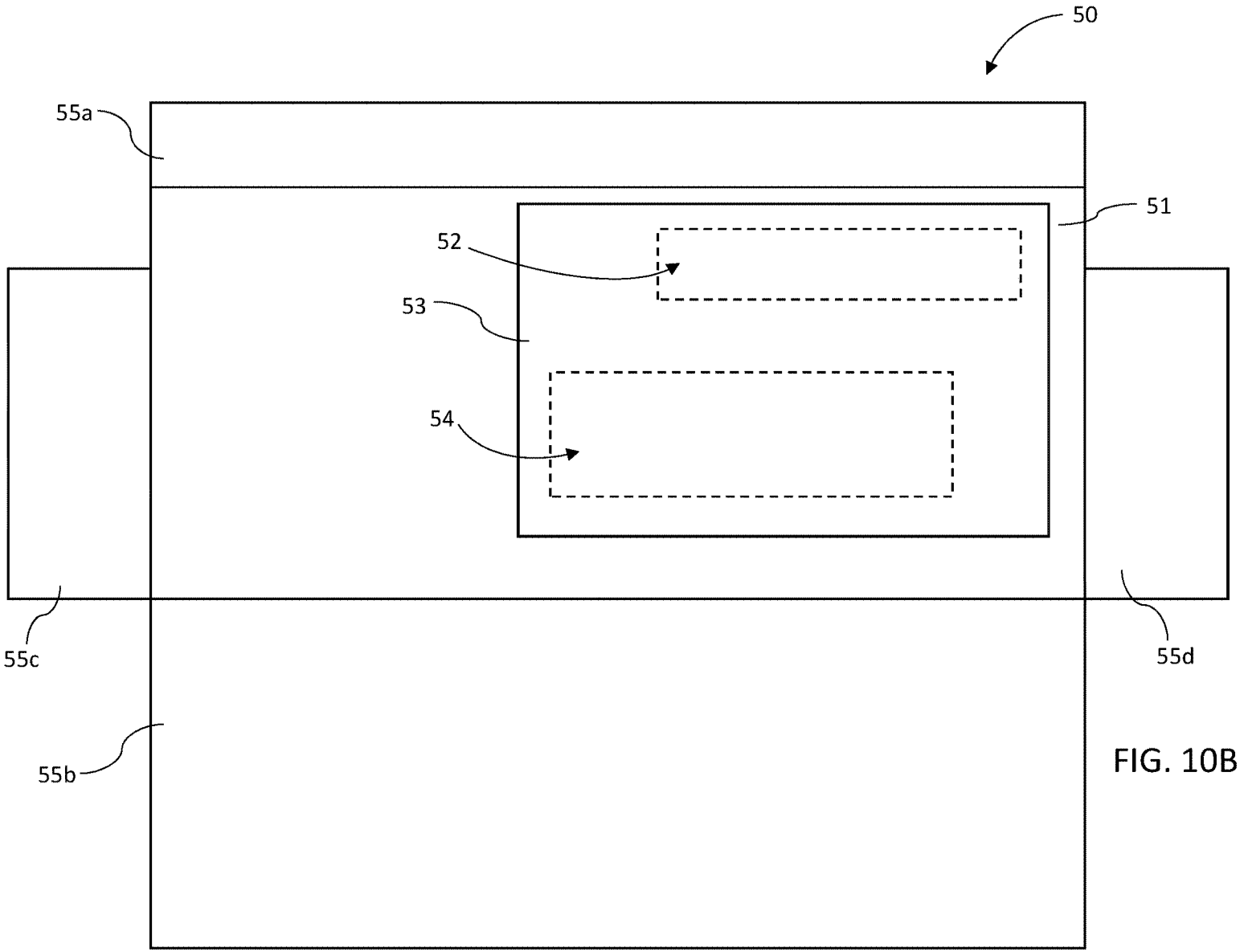
Figure 11A:
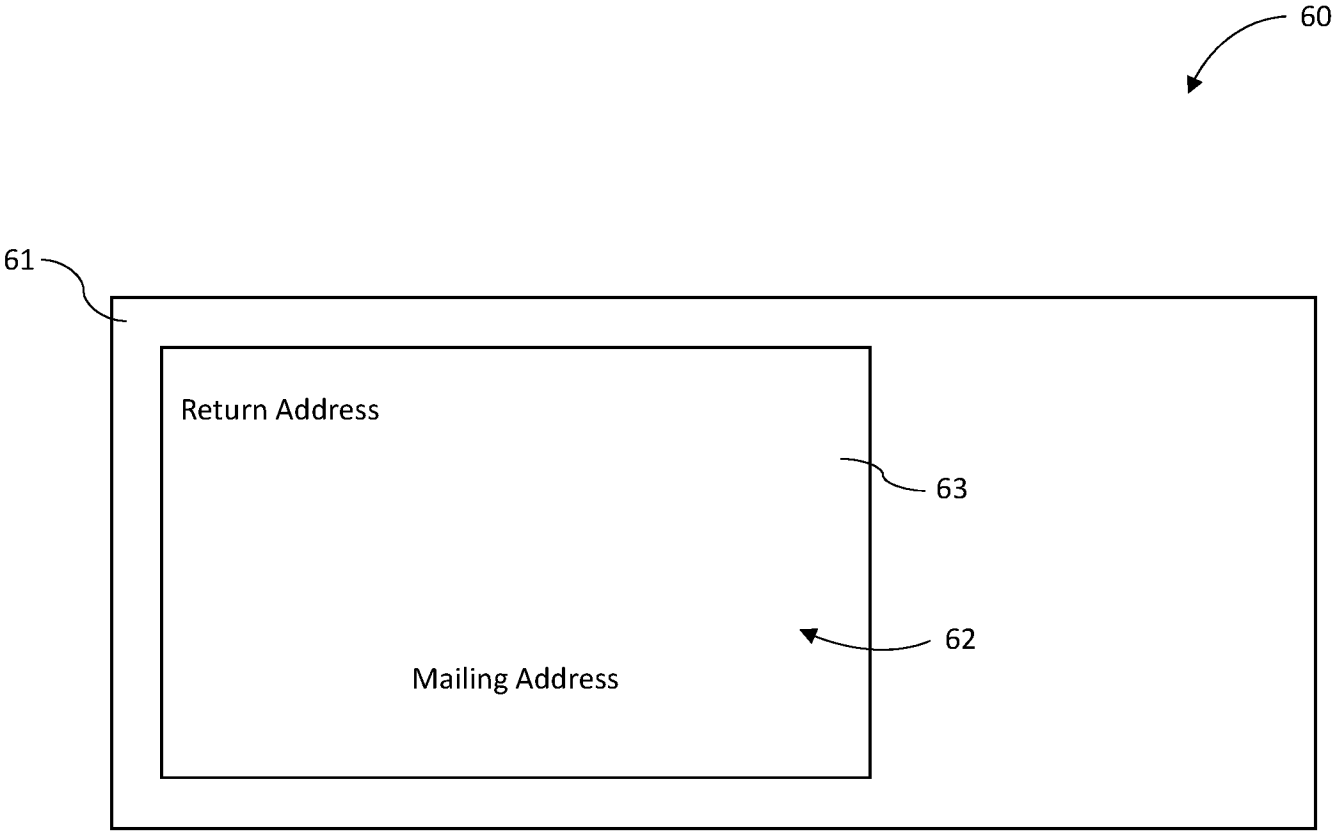
Figure 11B:
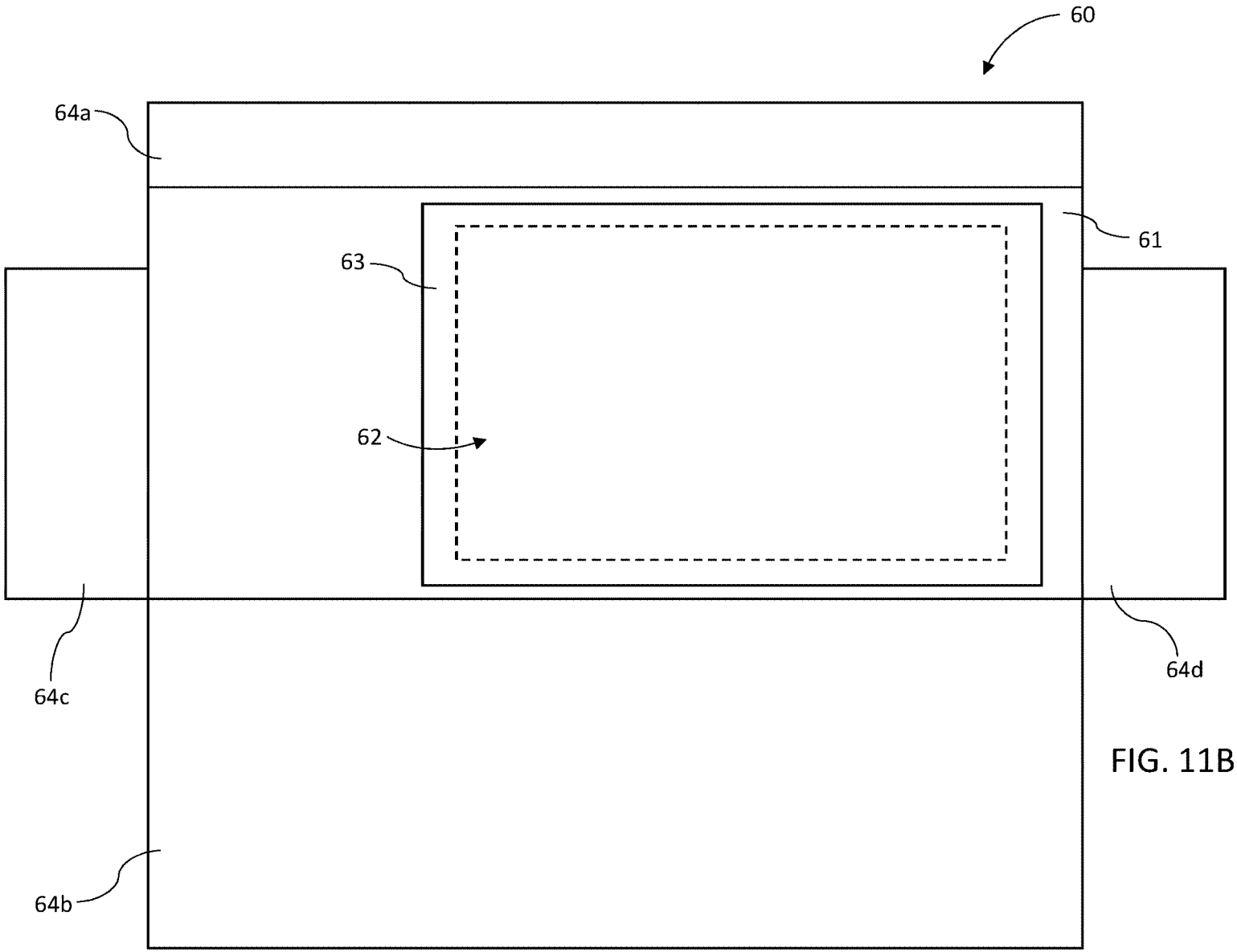
Figure 12A:
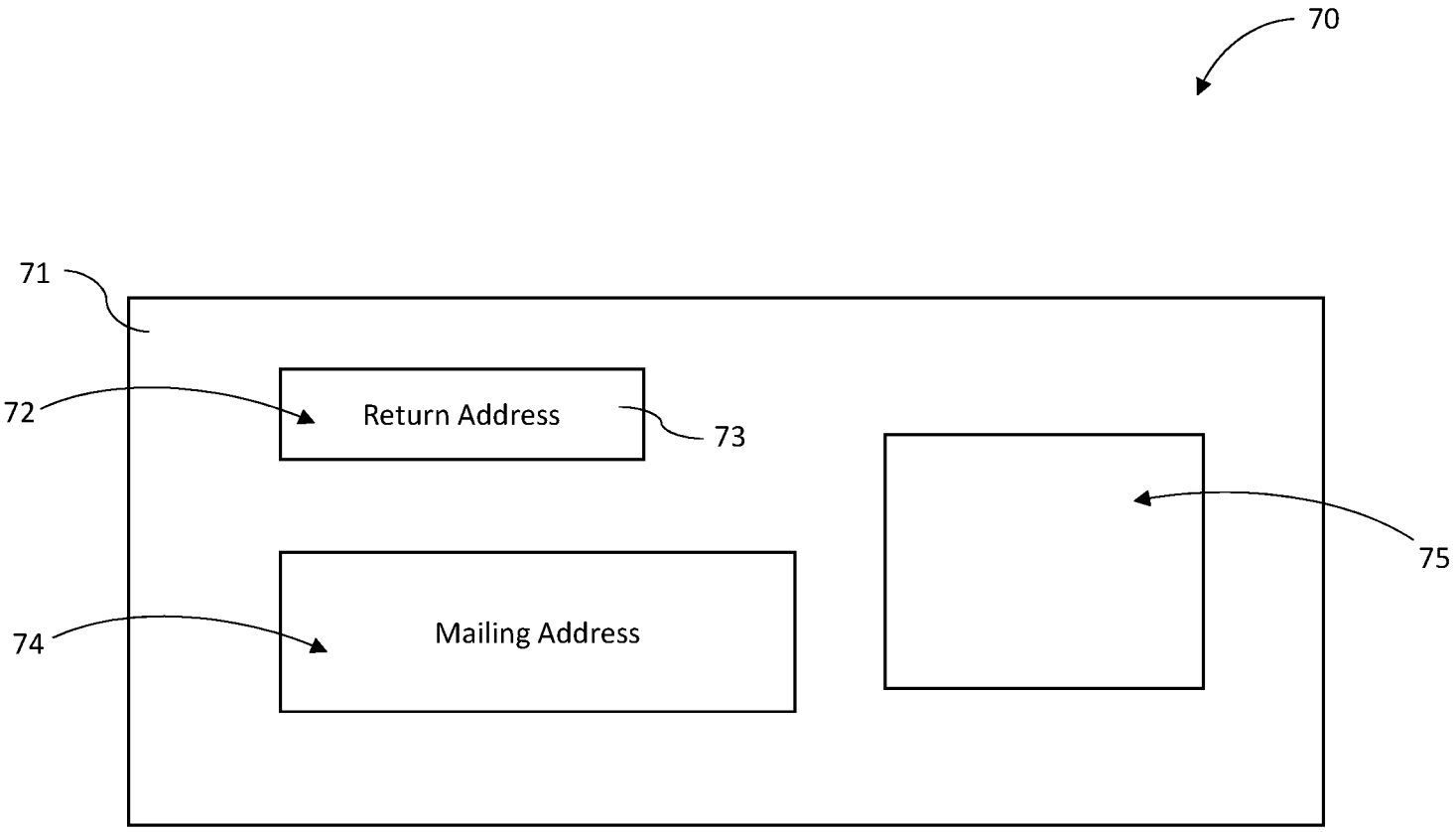
Figure 12B:
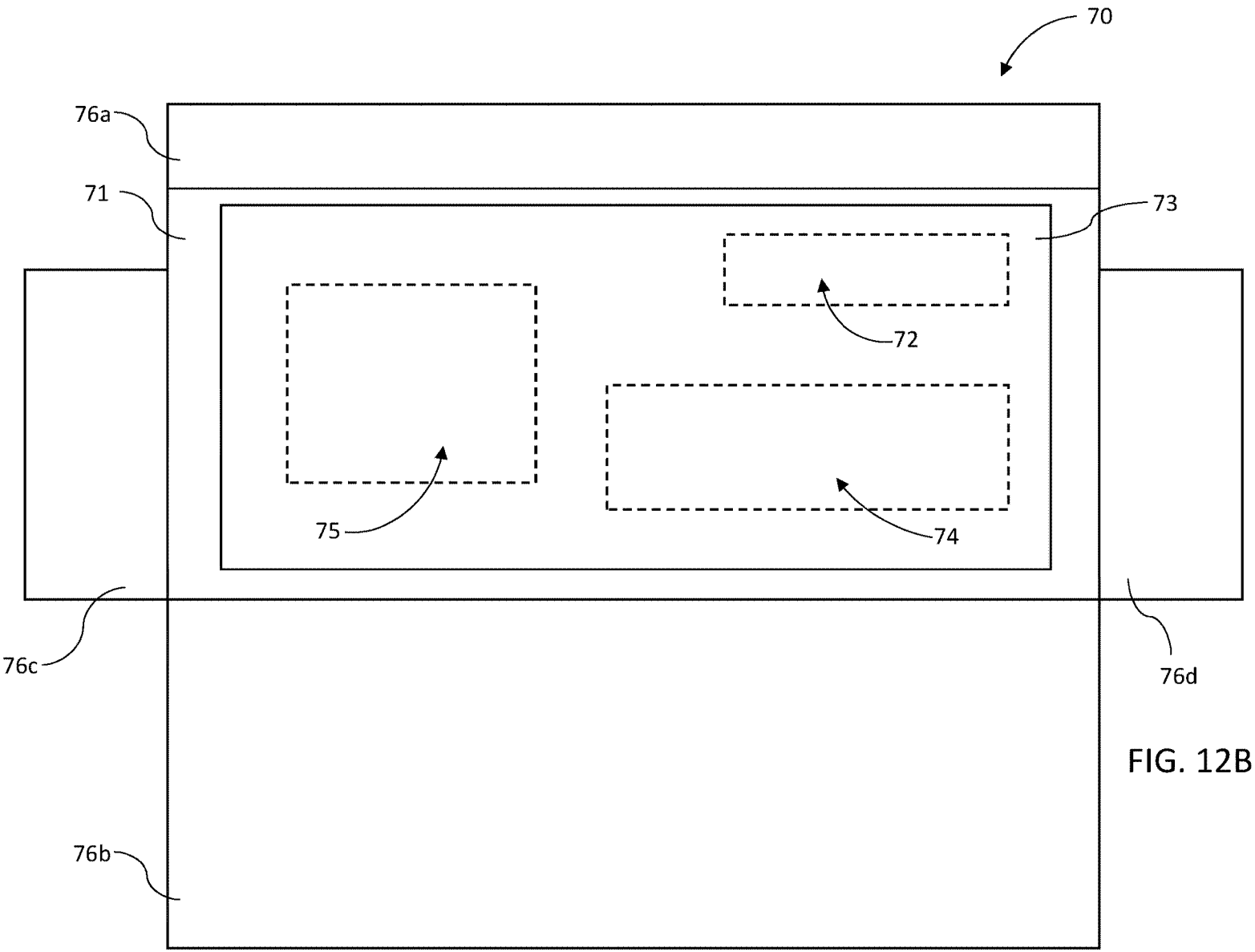
Figure 13A:
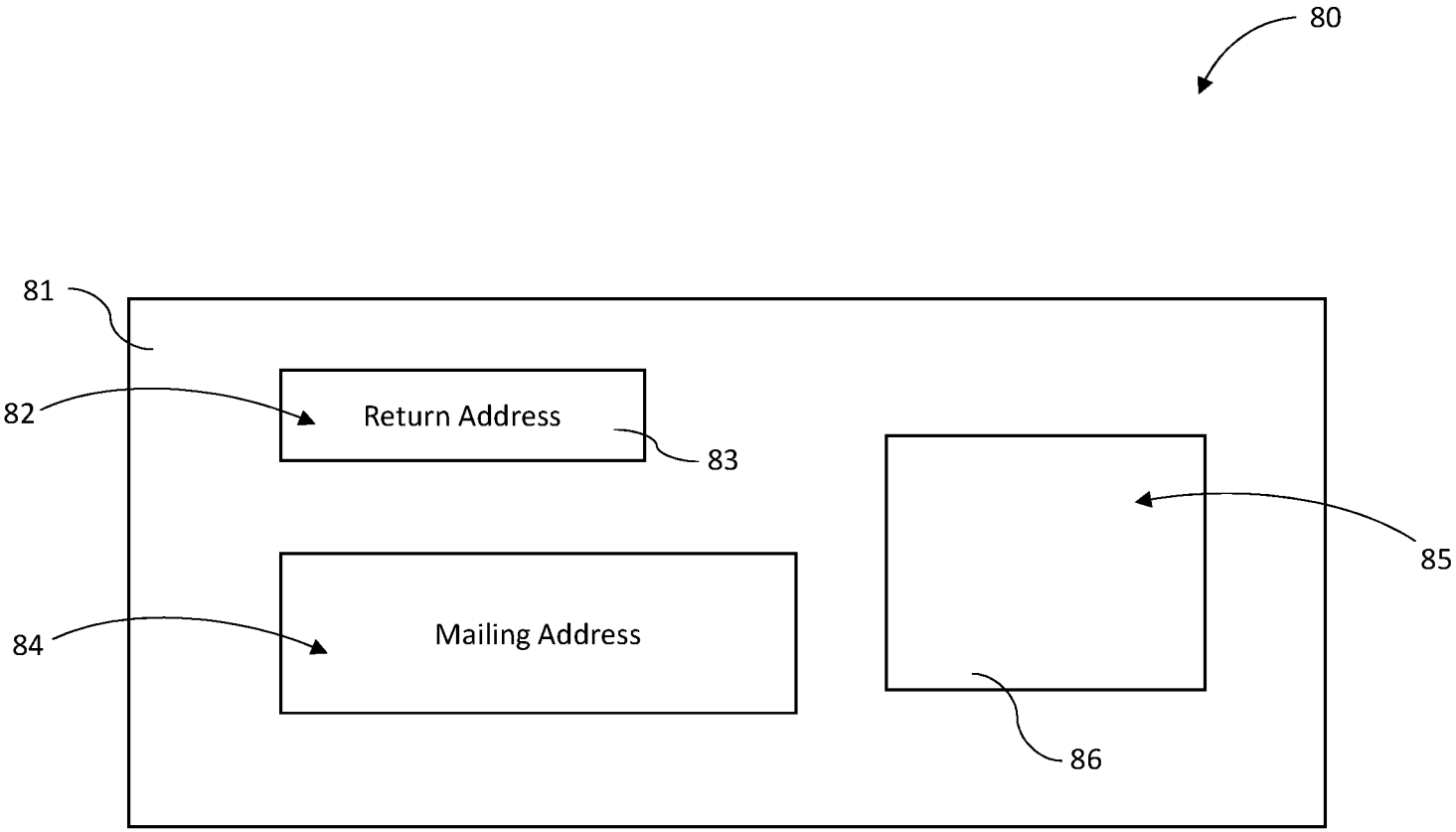
Figure 13B:
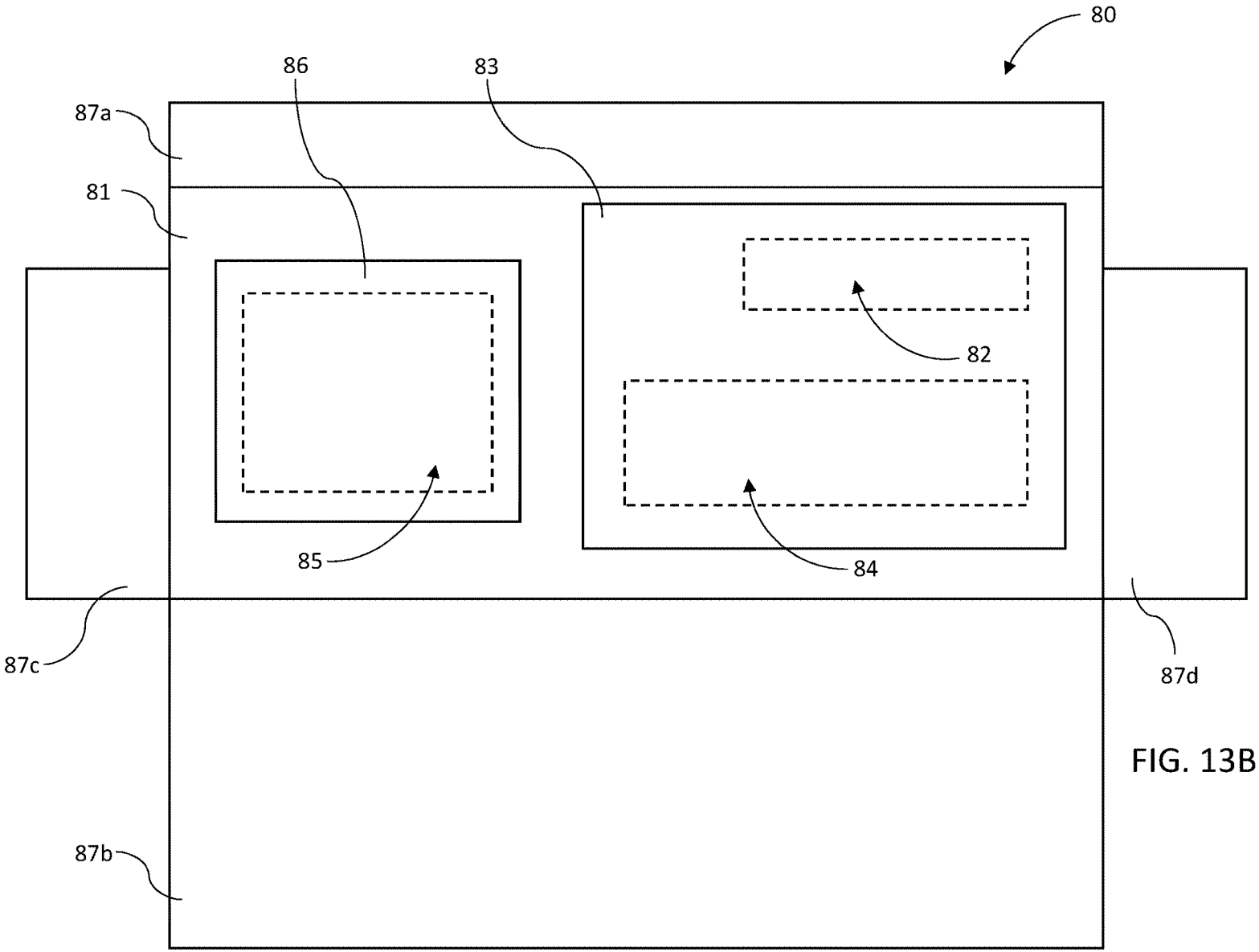
Figure 14A:
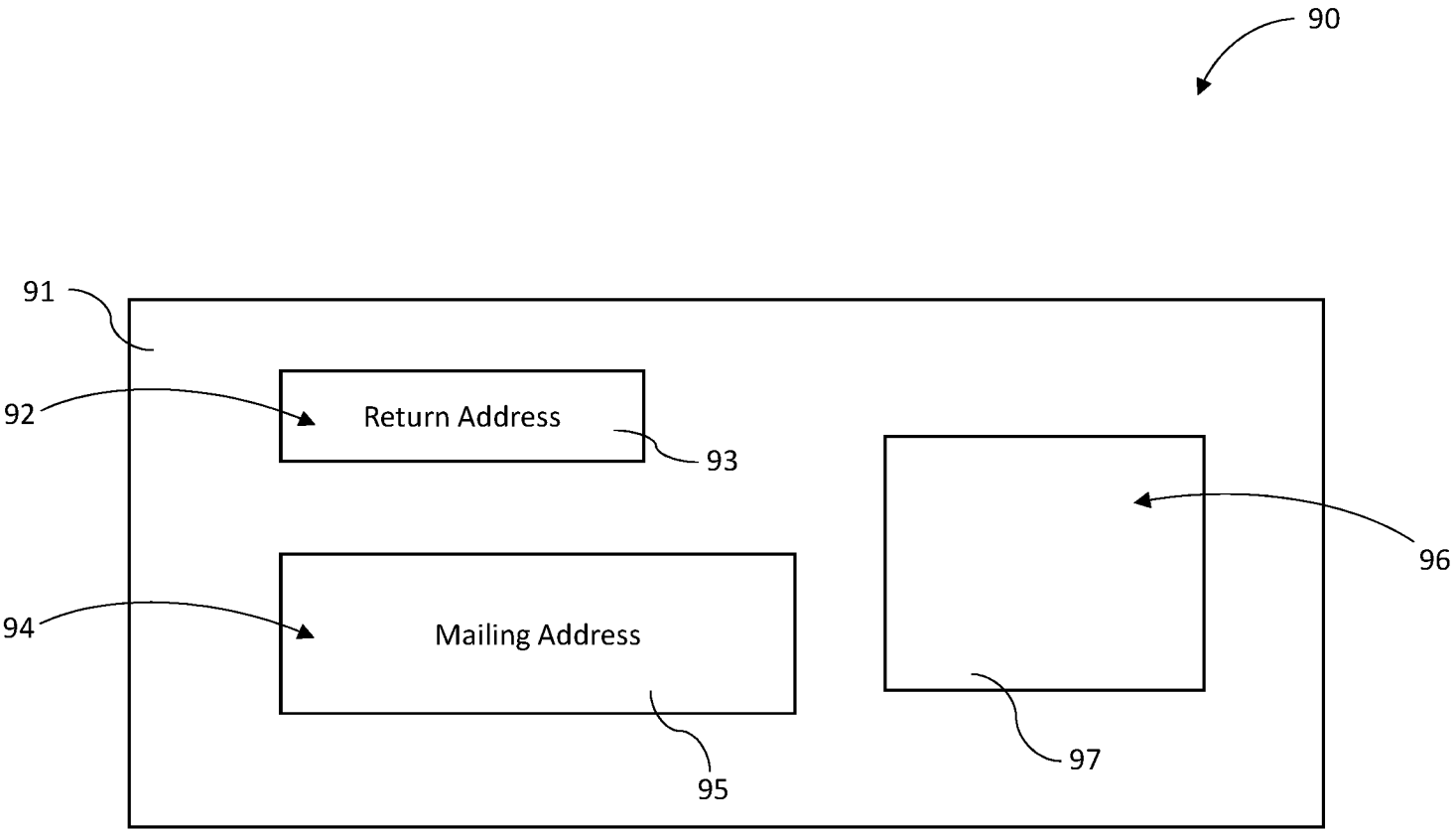
Figure 14B:
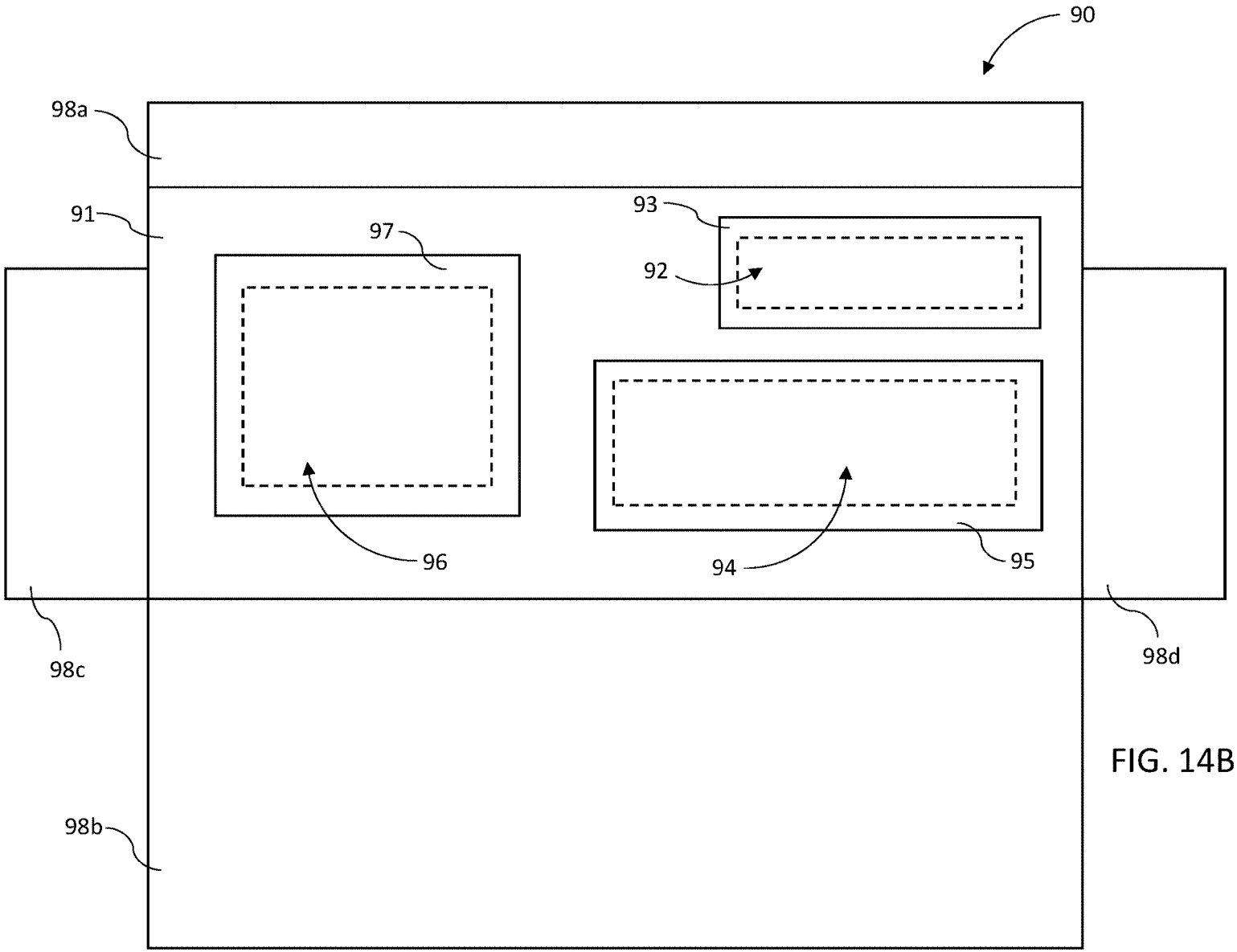
Figure 15A:
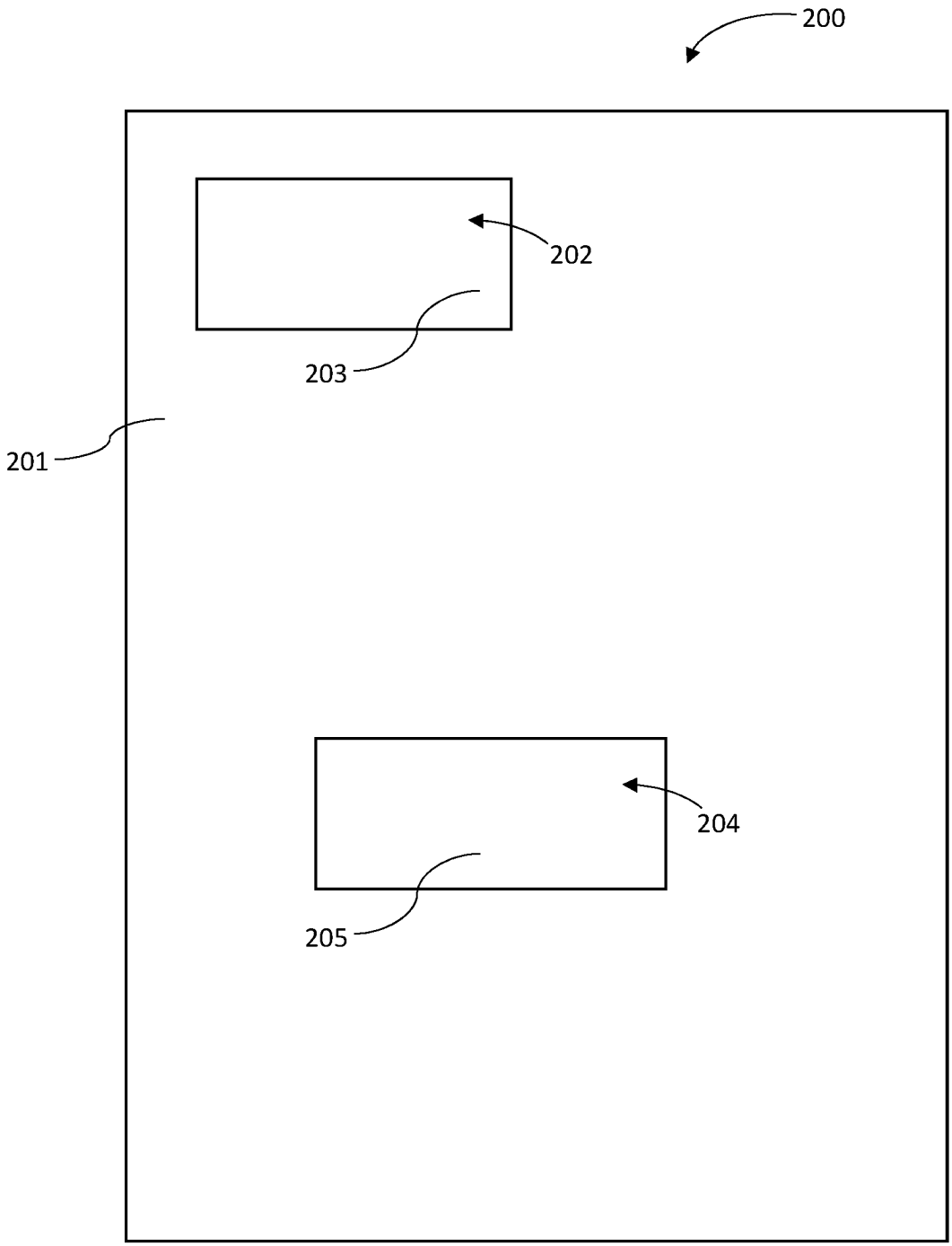
Figure 15B:
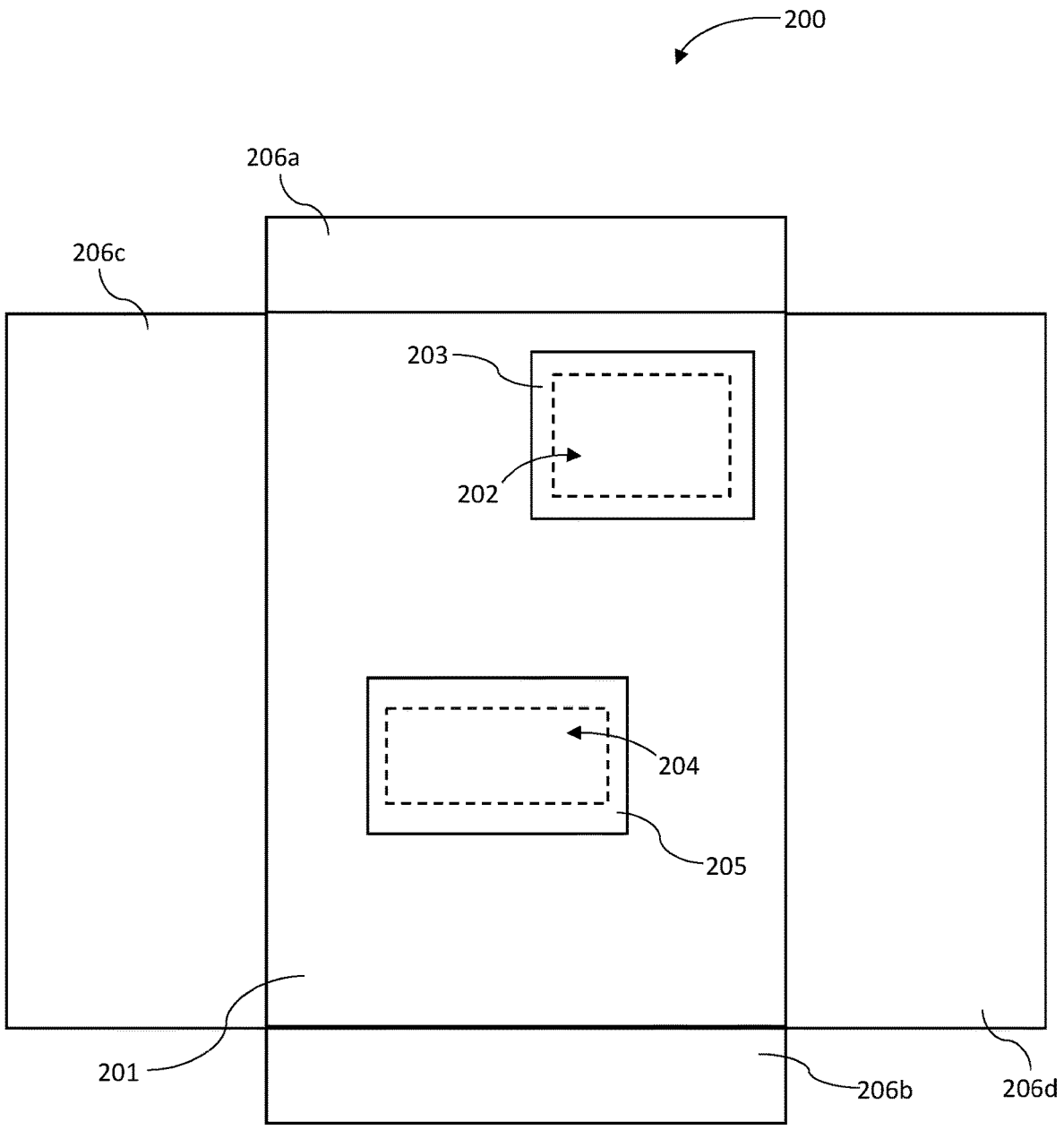
Figure 16A:
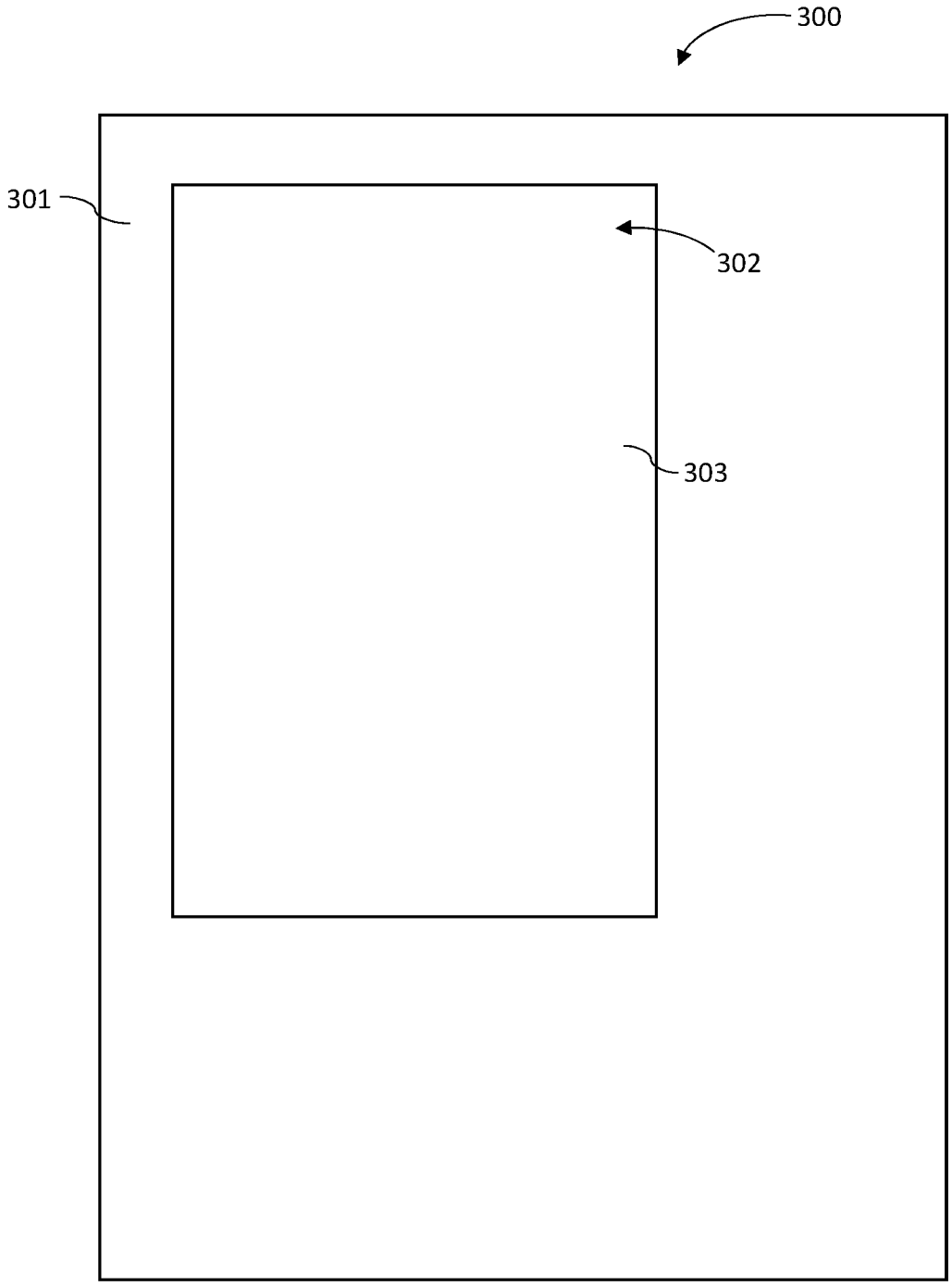
Figure 16B:
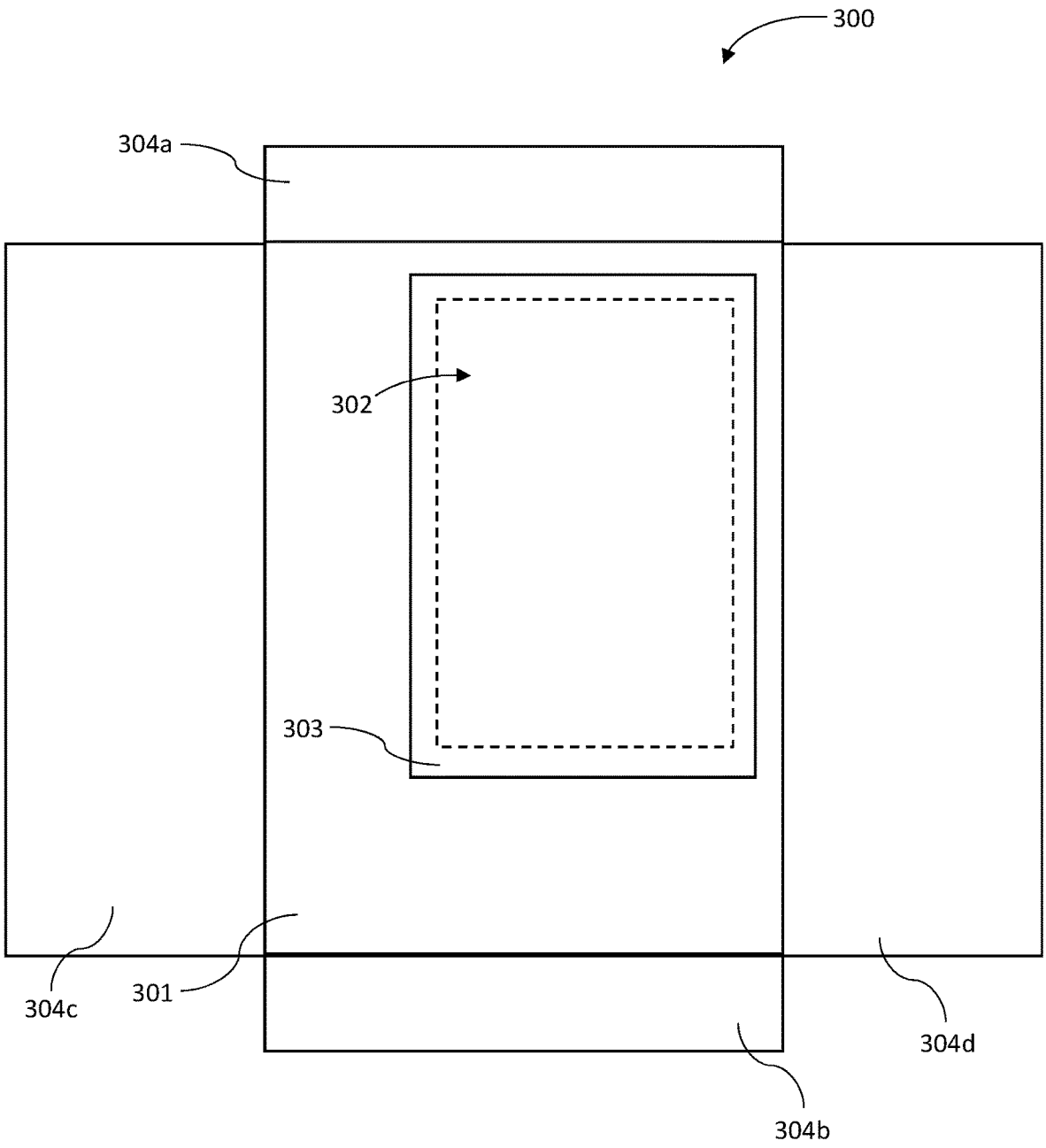
Figure 17:
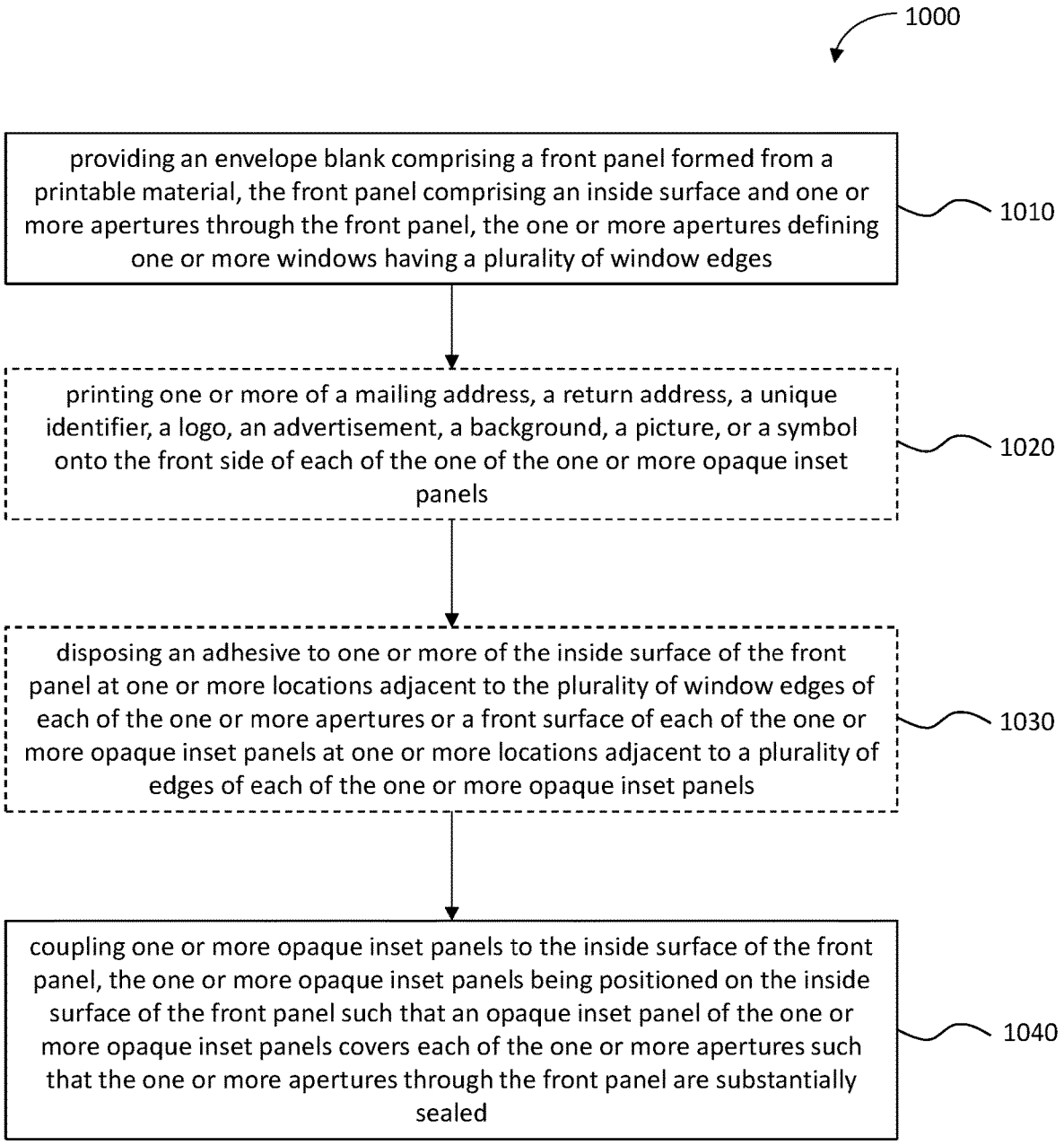
Figure 18:
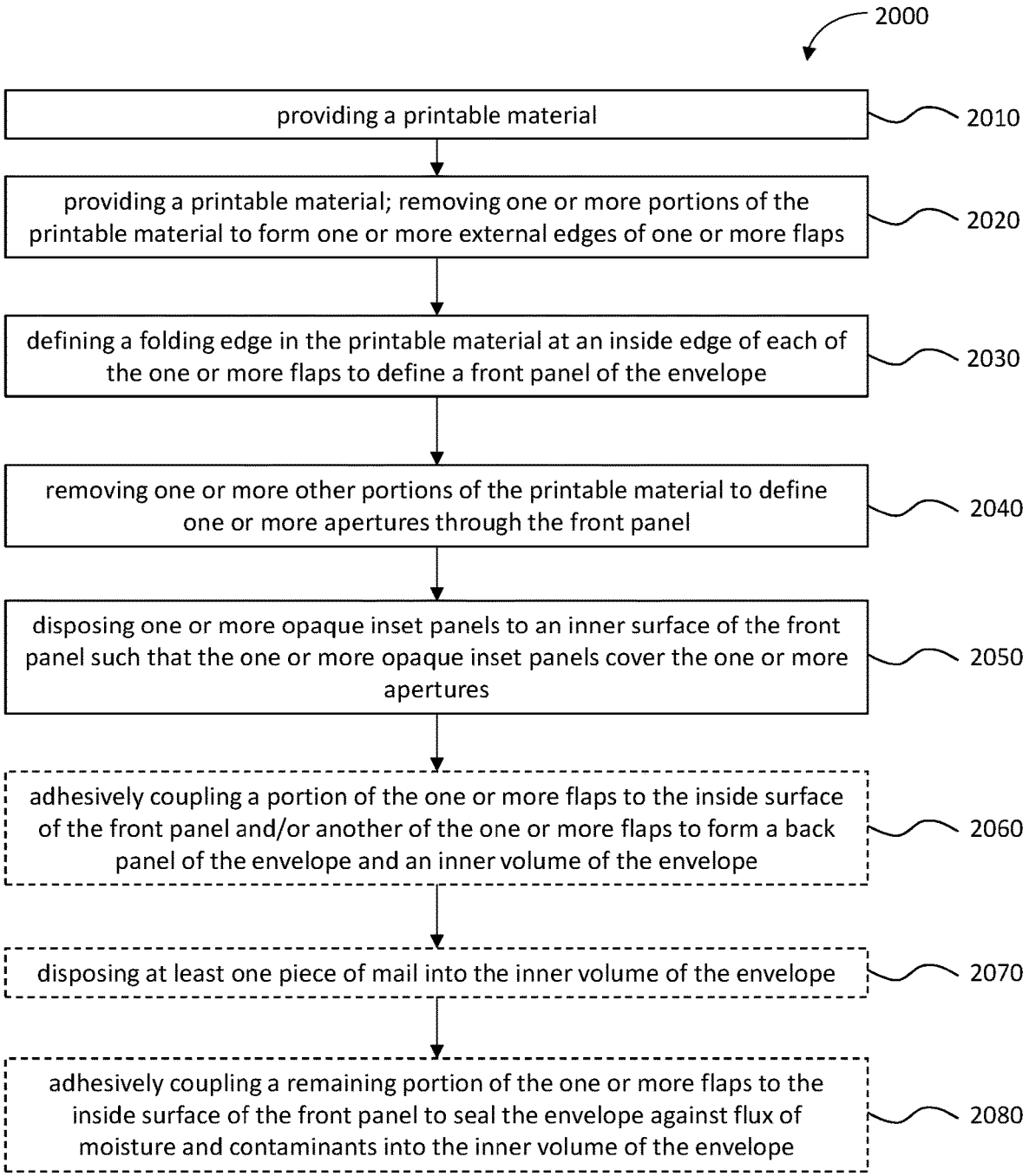
Figure 19:
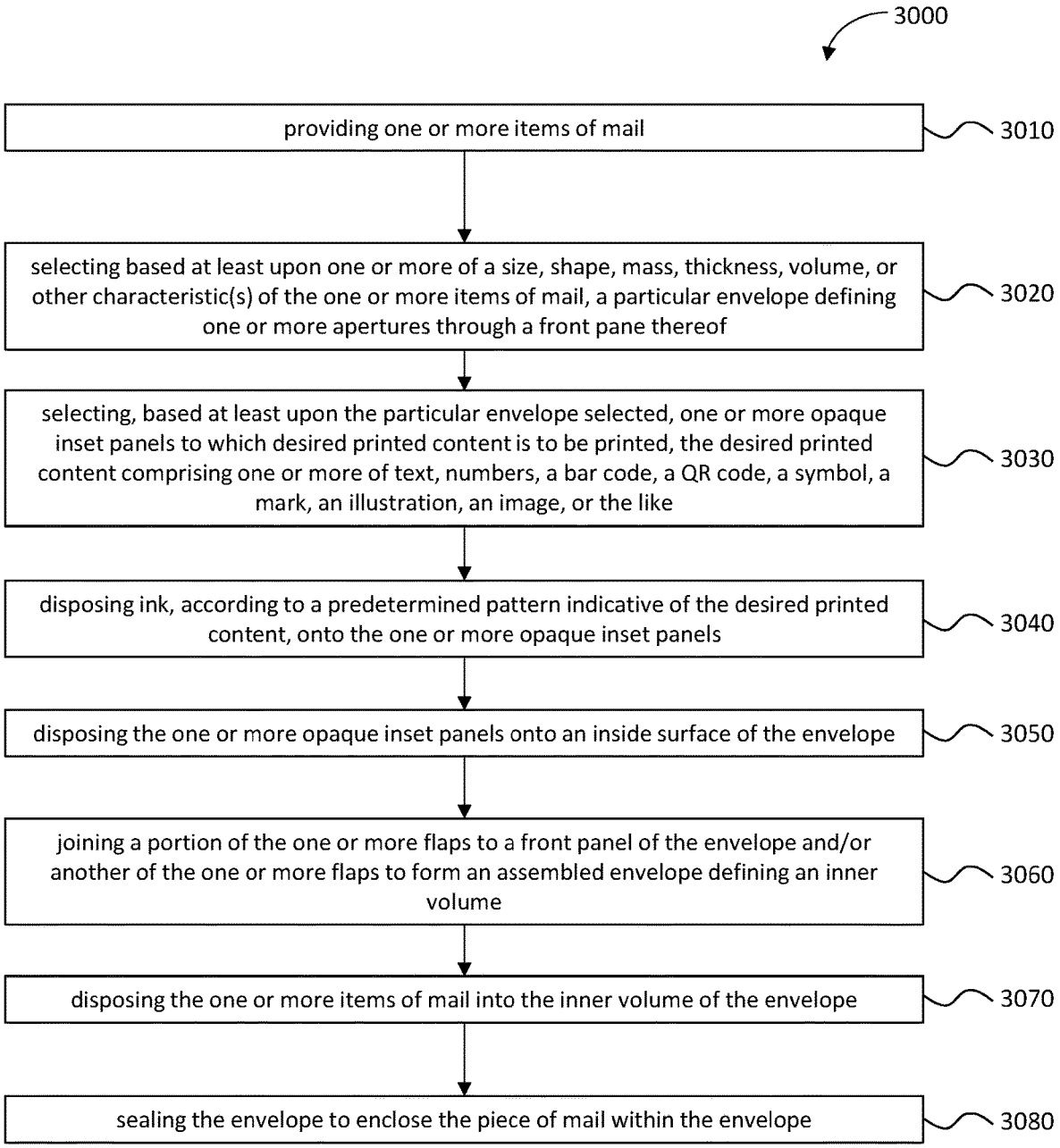

Having thus described the invention(s) in general terms, reference will now be made to the accompanying drawings, which are not necessarily drawn to scale, and wherein:

FIG. 1 is a diagram of a system that can be used in conjunction with various embodiments of the present application;

FIG. 2A is a schematic of a central computing entity in accordance with certain embodiments of the present application;

FIG. 2B is a schematic representation of a memory media storing a plurality of data assets;

FIG. 3 is a schematic of a user computing entity, in accordance with certain embodiments of the present application;

FIG. 4A is a front view of an exemplary envelope, in accordance with certain embodiments of the present application;

FIG. 4B is a back view of an unassembled exemplary envelope, in accordance with certain embodiments of the present application;

FIG. 5 is a back view of an unassembled exemplary envelope, in accordance with certain embodiments of the present application;

FIG. 6A is a front view of an exemplary envelope, in accordance with certain embodiments of the present application;

FIG. 6B is a cross-sectional view of a portion of an exemplary envelope, in accordance with certain embodiments of the present application;

FIG. 6C is a back view of an unassembled exemplary envelope, in accordance with certain embodiments of the present application;

FIG. 7 is a back view of an unassembled exemplary envelope, in accordance with certain embodiments of the present application;

FIG. 8 illustrates a cross-sectional view of a portion of an exemplary envelope, in accordance with certain embodiments of the present application;

FIG. 9A illustrates a cross-sectional view of a portion of an exemplary envelope, in accordance with certain embodiments of the present application;

FIG. 9B illustrates a cross-sectional view of a portion of an exemplary envelope, in accordance with certain embodiments of the present application;

FIG. 10A is a front view of an exemplary envelope, in accordance with certain embodiments of the present application;

FIG. 10B is a back view of an unassembled exemplary envelope, in accordance with certain embodiments of the present application;

FIG. 11A is a front view of an exemplary envelope, in accordance with certain embodiments of the present application;

FIG. 11B is a back view of an unassembled exemplary envelope, in accordance with certain embodiments of the present application;

FIG. 12A is a front view of an exemplary envelope, in accordance with certain embodiments of the present application;

FIG. 12B is a back view of an unassembled exemplary envelope, in accordance with certain embodiments of the present application;

FIG. 13A is a front view of an exemplary envelope, in accordance with certain embodiments of the present application;

FIG. 13B is a back view of an unassembled exemplary envelope, in accordance with certain embodiments of the present application;

FIG. 14A is a front view of an exemplary envelope, in accordance with certain embodiments of the present application;

FIG. 14B is a back view of an unassembled exemplary envelope, in accordance with certain embodiments of the present application;

FIG. 15A is a front view of an exemplary envelope, in accordance with certain embodiments of the present application;

FIG. 15B is a back view of an unassembled exemplary envelope, in accordance with certain embodiments of the present application;

FIG. 16A is a front view of an exemplary envelope, in accordance with certain embodiments of the present application;

FIG. 16B is a back view of an unassembled exemplary envelope, in accordance with certain embodiments of the present application;

FIG. 17 is a block flow diagram of an exemplary method for forming an envelope, in accordance with certain embodiments of the present application;

FIG. 18 is a block flow diagram of an exemplary method for forming an envelope, in accordance with certain embodiments of the present application; and FIG. 19 is a block flow diagram of an exemplary method for forming an envelope, in accordance with certain embodiments of the present application.

DETAILED DESCRIPTION

Various embodiments will now be described more fully hereinafter with reference to the accompanying drawings, in which some, but not all embodiments are shown. Indeed, the invention(s) may be embodied in many different forms and should not be construed as limited to the embodiments set forth herein; rather, these embodiments are provided so that this disclosure will satisfy applicable legal requirements. The term "or" (also designated as "/") is used herein in both the alternative and conjunctive sense, unless otherwise indicated. The terms "illustrative" and "exemplary" are used to be examples with no indication of quality level. Like numbers refer to like elements throughout.

As used herein, the term "about," "substantially," and "approximately" generally mean plus or minus 10% of the value stated, e.g., about 250 μm would include 225 μm to 275 μm, approximately 1,000 μm would include 900 μm to 1,100 μm, and substantially sealed would include 90% to 100% sealed.

As used herein, the term "opaque" generally means that a material is impenetrable by certain kinds of electromagnetic energy, such as visible light, and is therefore not transparent or translucent. As such, an average person viewing an opaque material, as defined herein, from a reasonable distance such as arm's length or closer, under normal lighting conditions, may not be able to see clearly through the opaque material. By way of example only, an average person may be able to discern a color of another object behind an opaque object but may not be able to read text or discern an image on the other object behind the opaque object. For instance, a sheet of about 90 brightness to about 98 brightness paper of normal thickness, such as greater than about $1/100^{th}$ of a millimeter, greater than about $1/10^{th}$ of a millimeter, greater than about 1 millimeter, or greater than about 10 millimeters, may be considered opaque under normal lighting and viewing conditions.

Envelopes are used to enclose and transmit pieces of mail, e.g., documents that contain personal information about the sender or receiver, invoices, bills, statements, business documents, legal documents, and/or the like. However, preparing, assembling, sorting, and mailing such pieces of mail often requires printing of the document to be mailed and printing of additional information (e.g., mailing address, return address, sorting identifier, and/or the like) on a front panel (e.g., a face) of the envelope. For instance, a bill is often printed with the bill sender's name and contact information and the bill receiver's name and contact information printed somewhere on the bill, and then the same information is redundantly printed on the face of the envelope. This leads to inefficient mail creation.

As a way to reduce or eliminate the redundancy of printing the same information on the document within the envelope as well as on the face of the envelope, window envelopes were developed. Window envelopes typically define an opening through the front face of the envelope which allows information from the document being mailed such as a mailing address, a return address, and/or other identifying information to be viewable on the front face of the envelope once the document is disposed within the envelope and the envelope is sealed shut. The use of a window in envelopes allows for the production of anonymized envelopes onto which the printing of information, such as a mailing address and/or a return address, is not required, so long as the necessary information is printed in the proper location on the document being mailed within the envelope. Returning to the example of a bill, if the bill recipient's name and address are printed on a particular portion of the bill that corresponds particularly, once the bill is disposed within the envelope, with a top surface of the bill that is visible through the window of the envelope, then each bill can be printed as a unique printing while any suitably sized envelope with a properly positioned window can be used without the need for printing the unique name and address of the recipient on a front panel (a face) of the envelope.

Over time, a variety of sizes, colors, and window styles were created, including but not limited to single window envelopes that have just one opening for the mailing address, double window envelopes that have an additional opening for the return address, full face envelopes that have an opening that covers the entire front of the envelope, and the like. As such, each piece of mail or document that is produced for mailing can be configured to fit one of the available window envelopes such that the necessary information is visible through the window. The use of window envelopes has led to reduced costs and increased production speeds, but has also led to many unintended consequences such as the need to very particularly fold and/or pack envelopes such that the correct portion of the document within the envelope is visible through the window, the unintended exposure of private or confidential information through the envelope window either when the document is inserted into the envelope incorrectly or when the document to envelope tolerances are not sufficiently minimized and the document is able to shift within the envelope, exposing such information through the window, the proliferation of international and domestic mailing standards and protocols for ensuring compliance with those standards (e.g., the USPS's "tap" test), and complications with optical and machine learning sorting of prepared mail when a portion or all of the mailing or return address(es) are not visible through the window.

Sometimes, a barcode or similar unique identifier can be printed on a front panel (a face) or the back of the envelope in order to identify the particular type, size, color, window configuration, and/or other characteristics of the envelope, or the identify a unique piece of mail once assembled and once the document is sealed within the envelope. In some cases, a catalog number can be imprinted on the front of envelope to distinguish between different envelopes used by different senders, for difference purposes, associated with different documents, or the like. Since there are hundreds of different envelope sizes, envelope material types, envelope colors, window numbers, window sizes, window positions, and the like, which can lead to millions of unique combinations, it is often difficult or impossible to prepare, assemble, sort, and distribute such mail without a difficult and time-consuming process of manually checking any mail that does not pass the various automated tests, such as optical character recognition (OCR) analysis or the like.

Since window envelopes define an opening in a front panel (a face) of the envelope, the inside of such envelopes is open to the elements and contamination during mailing, and the edge of the opening can often catch on other mail or mechanisms used during sorting or distribution and can tear open a front panel (a face) of the envelope. As such, a further advancement for the window envelope was the use of cellophane over the address window to protect the document within the envelope. Since the use of cellophane over the window increased the cost of production of the envelope, it was typically reserved for the most important documents, such as bills, legal contracts, and/or the like. As the use of such window envelopes continued to grow, it became common for less important mail (e.g., "junk mail") to either not include a window or to have a window that is not covered by cellophane, meaning that recipients began associating the use of cellophane over the window with the envelope containing a relatively more important document, which meant that such envelopes were more frequently opened by recipients instead of being unopened or simply thrown away.

However, as mentioned above, the use of a window envelope, whether cellophane covered or not, relies upon the proper positioning of sender/receiver information on the document within the envelope. When a document shifts around in the envelope, personal or sensitive information may become viewable through the window of the envelope, which may present a costly problem to the mail sender, the mail receiver, the mail distributor, and/or the mail producer. However, the only currently available option for preventing the exposure of personal or private information from a document within a window envelope is to use a conventional (non-window) envelope, which, as described above, requires the costly and inefficient duplication of information on the envelope as well as the document within the envelope. To avoid the exposure of personal or private information, such as in the case of a medical bill, a medical explanation of benefits, tax documents, any information protected under attorney-client privilege or under the Health Insurance Portability and Accountability Act of 1996 (HIPPA), some companies have begun to create an entirely additional document (e.g., a cover page) that is added to the outside of the document being mailed, the only information printed on the additional document being the mailing address and/or return address or the like. However, this additional document and the unique printing of sender and/or recipient information on the additional document represents additional cost, additional weight added to the mailing in a system in which the cost of mailing the document depends typically on the mass of the final, sealed envelope, and still represents a duplication of information with that information that is already printed on the document within the cover page. Due to the legal implications of such privacy matters for many companies, the extra cost of such measures has been outweighed by the potential cost that could result from fines, litigation, and/or the like if they allow such private information to be exposed. However, for many senders of mail, there is less or no need to protect private information, but the only available options remain either a window-less envelope, which is costly to print for unique recipients and which is more likely to be discarded by the recipient, or a window envelope which adds to the complexity of printing the document within the envelope due to the particular positioning of the information so it is viewable through the window.

Some additional issues related to the conventional window envelopes are that senders often use a similarly sized and shaped envelope with the only distinguishing characteristics between them being a sender-specific identifier, e.g., a 10 digit alpha numeric catalog number or a barcode, printed somewhere on the envelope. However, many senders rely upon a centralized manufacturer, printer, assembler, distributor, or the like to manufacture, prepare, assemble, sort, and/or ship their mail, which means that such centralized entities often have difficulty discerning between which unique envelope should be used for which particular document. Due to this similarity of or only slight differences between envelopes used by different senders, it is difficult for operators to verify different envelopes, and this similarity combined with the many customized envelopes used by many senders can increase the possibility of an error being made, which may lead to mail being undeliverable or more costly to deliver due to some or all of the mailing address not being visible, or which may lead to the exposure of private or HIPPA-protected information, for instance. Additionally, maintaining custom envelopes increases required inventory space, warehousing costs, transportation waste, equipment change-over time, and decreases the overall efficiency of the process.

Additionally, mail sent in single or double window envelopes typically requires that a tap-test be conducted to ensure the address on the letter is not obscured by the window when the document shifts inside the envelope. Mail that does not meet the relevant regulation (e.g., United States Postal Service (USPS) regulation DMM 601.6.3), for which a portion of the address or other critical information falls outside of the window, are separated and metered at full-rate, meaning the cost to mail the document increases.

As such, the inventors, through diligent effort and innovation, have invented a new envelope and associated methods, apparatuses, and computer program products for solving at least some of the problems associated with conventional envelopes. In general, described herein are embodiments that minimize the mass of the mailed envelope, that allow for the use of anonymized envelopes without needing to print any unique identifiers on the envelope shell itself, that convey the importance of the document within the envelope, that eliminate the need for the document within the envelope to be printed in such a way that the particular location of the sender's or receiver's information is suitably viewable through a window in a front panel (a face) of the envelope, and that eliminates the possibility that private/confidential information from the document will be visible through the window of the envelope.

In some embodiments, a high-integrity opaque-inset panel envelope construction is provided. In some embodiments, the envelope construction can comprise a panel fixed to an inside surface of the front panel of the envelope shell, the envelope shell having a window through a front panel (a face) of the envelope shell, the panel being disposed within the envelope in such a way that the panel covers the opening. In some embodiments, information such as the mailing address, return address, sender/receiver information, a logo, an identifier, and/or other content can be printed on the panel either before or after the panel is fixed within the envelope. In some embodiments, the optical properties of the opaque panel can be different from those of the envelope shell so that the opaque panel, viewable through the window defined through the front panel (the face) of the envelope shell, appears to the recipient to be the document within the envelope. In some embodiments, while this opaque panel may give the illusion that the address in the window is printed on the document within the envelope and is showing through the window, since the panel is fixed within the envelope and cannot shift within the envelope, there is no possibility that the address or other information will be hidden due to the shifting of the document within the envelope or that private information on the document may be viewable through the window. In some embodiments, a particular optical property, such as brightness, can be used to differentiate between the envelope shell and the panel. By way of example only, a sufficient brightness difference may be a brightness of 96 for the opaque panel and a brightness of 92 for the envelope paper. Other brightness values, differences in brightness values, ratio of brightness values, and/or other characteristics are contemplated and are considered to be within the scope of the present disclosure. In some embodiments, to permit the address on the panel to be viewed by an automated sorting machine and the like, the print contrast ratio may adhere to the USPS print contrast ratio (PCR) standards in DMM 204.1.4, which may increase the likelihood of efficient processing and delivery. In some embodiments, the high-integrity opaque-inset panel envelope can be inkjet treated and moisture proof such that damage to the document within the envelope is reduced or prevented. In some embodiments, a surface treatment, coating, or the like may be disposed on one or both surfaces of the opaque panel such that, when inset within the envelope, beneath the window(s), the opaque panel may provide the appearance that the window(s) is(are) covered with a protective covering such as cellophane.

Also described herein are systems, methods, apparatuses, and computer program products suitable for managing a system of manufacturing, assembling, sorting, and distributing such high-integrity opaque-inset panel envelopes. As described herein, exemplary systems and apparatuses can be provided, along with associated computer code, computer instructions, and/or computer program products, for carrying out any of the methods described herein. For instance, an exemplary system can comprise one or more of the computing entities described herein for use in tracking and selecting the envelope shells and inset opaque panels. Alternatively or additionally, an exemplary system can comprise one or more of the computing entities described herein for use in printing desired content, such as a mailing address, a return address, a unique identifier, or the like on the inset opaque panel. Alternatively or additionally, an exemplary system can comprise one or more of the computing entities described herein for use in affixing the inset opaque panel to an inside of the front panel of the envelope shell. Alternatively or additionally, an exemplary system can comprise one or more of the computing entities described herein for use in assembling the envelope, disposing the document(s) to be mailed into the envelope, and/or sealing the envelope. Alternatively or additionally, an exemplary system can comprise one or more of the computing entities described herein for use in sorting and/or mailing the sealed envelope.

Computer Program Products, Methods, and Computing Entities

Embodiments may be implemented in various ways, including as computer program products that comprise articles of manufacture. Such computer program products may include one or more software components including, for example, software objects, methods, data structures, and/or the like. A software component may be coded in any of a variety of programming languages. An illustrative programming language may be a lower-level programming language, such as an assembly language associated with a particular hardware architecture and/or operating system platform. A software component comprising assembly language instructions may require conversion into executable machine code by an assembler prior to execution by the hardware architecture and/or platform. Another example programming language may be a higher-level programming language that may be portable across multiple architectures. A software component comprising higher-level programming language instructions may require conversion to an intermediate representation by an interpreter or a compiler prior to execution.

Other examples of programming languages include, but are not limited to, a macro language, a shell or command language, a job control language, a script language, a database query or search language, and/or a report writing language. In one or more example embodiments, a software component comprising instructions in one of the foregoing examples of programming languages may be executed directly by an operating system or other software component without having to be first transformed into another form. A software component may be stored as a file or other data storage construct. Software components of a similar type or functionally related may be stored together such as, for example, in a particular directory, folder, or library. Software components may be static (e.g., pre-established or fixed) or dynamic (e.g., created or modified at the time of execution).

A computer program product may include a non-transitory computer-readable storage medium storing applications, programs, program modules, scripts, source code, program code, object code, byte code, compiled code, interpreted code, machine code, executable instructions, and/or the like (also referred to herein as executable instructions, instructions for execution, computer program products, program code, and/or similar terms used herein interchangeably). Such non-transitory computer-readable storage media include all computer-readable media (including volatile and non-volatile media).

In one embodiment, a non-volatile computer-readable storage medium may include a floppy disk, flexible disk, hard disk, solid-state storage (SSS) (e.g., a solid state drive (SSD), solid state card (SSC), solid state module (SSM), enterprise flash drive, magnetic tape, or any other non-transitory magnetic medium, and/or the like. A non-volatile computer-readable storage medium may also include a punch card, paper tape, optical mark sheet (or any other physical medium with patterns of holes or other optically recognizable indicia), compact disc read only memory (CD-ROM), compact disc-rewritable (CD-RW), digital versatile disc (DVD), Blu-ray disc (BD), any other non-transitory optical medium, and/or the like. Such a non-volatile computer-readable storage medium may also include read-only memory (ROM), programmable read-only memory (PROM), erasable programmable read-only memory (EPROM), electrically erasable programmable read-only memory (EEPROM), flash memory (e.g., Serial, NAND, NOR, and/or the like), multimedia memory cards (MMC), secure digital (SD) memory cards, SmartMedia cards, CompactFlash (CF) cards, Memory Sticks, and/or the like. Further, a non-volatile computer-readable storage medium may also include conductive-bridging random access memory (CBRAM), phase-change random access memory (PRAM), ferroelectric random-access memory (FeRAM), non-volatile random-access memory (NVRAM), magnetoresistive random-access memory (MRAM), resistive random-access memory (RRAM), Silicon-Oxide-Nitride-Oxide-Silicon memory (SONOS), floating junction gate random access memory (FJG RAM), Millipede memory, racetrack memory, and/or the like.

In one embodiment, a volatile computer-readable storage medium may include random access memory (RAM), dynamic random access memory (DRAM), static random access memory (SRAM), fast page mode dynamic random access memory (FPM DRAM), extended data-out dynamic random access memory (EDO DRAM), synchronous dynamic random access memory (SDRAM), double data rate synchronous dynamic random access memory (DDR SDRAM), double data rate type two synchronous dynamic random access memory (DDR2 SDRAM), double data rate type three synchronous dynamic random access memory (DDR3 SDRAM), Rambus dynamic random access memory (RDRAM), Twin Transistor RAM (TTRAM), Thyristor RAM (T-RAM), Zero-capacitor (Z-RAM), Rambus in-line memory module (RIMM), dual in-line memory module (DIMM), single in-line memory module (SIMM), video random access memory (VRAM), cache memory (including various levels), flash memory, register memory, and/or the like. It will be appreciated that where embodiments are described to use a computer-readable storage medium, other types of computer-readable storage media may be substituted for or used in addition to the computer-readable storage media described above.

As should be appreciated, various embodiments may also be implemented as methods, apparatus, systems, computing devices, computing entities, and/or the like. As such, embodiments may take the form of a data structure, apparatus, system, computing device, computing entity, and/or the like executing instructions stored on a computer-readable storage medium to perform certain steps or operations. Thus, various embodiments may also take the form of an entirely hardware embodiment, an entirely computer program product embodiment, and/or an embodiment that comprises a combination of computer program products and hardware performing certain steps or operations.

Several exemplary embodiments are described below with reference to block diagrams and flowchart illustrations. Thus, it should be understood that each block of the block diagrams and flowchart illustrations may be implemented in the form of a computer program product, an entirely hardware embodiment, a combination of hardware and computer program products, and/or apparatus, systems, computing devices, computing entities, and/or the like carrying out instructions, operations, steps, and similar words used interchangeably (e.g., the executable instructions, instructions for execution, program code, and/or the like) on a computer-readable storage medium for execution. For example, retrieval, loading, and execution of code may be performed sequentially such that one instruction is retrieved, loaded, and executed at a time. In some exemplary embodiments, retrieval, loading, and/or execution may be performed in parallel such that multiple instructions are retrieved, loaded, and/or executed together. Thus, such embodiments can produce specifically-configured machines performing the steps or operations specified in the block diagrams and flowchart illustrations. Accordingly, the block diagrams and flowchart illustrations support various combinations of embodiments for performing the specified instructions, operations, or steps.

Exemplary System Architecture

FIG. 1 provides an illustration of a system 1 that can be used in conjunction with various embodiments. As shown in FIG. 1, the system 1 may comprise one or more central computing entities 10, one or more networks 20, one or more user computing entities 30, and/or the like. Each of the components of the system may be in electronic communication with, for example, one another over the same or different wireless or wired networks 20 including, for example, a wired or wireless Personal Area Network (PAN), Local Area Network (LAN), Metropolitan Area Network (MAN), Wide Area Network (WAN), and/or the like. Additionally, while FIG. 1 illustrate certain system entities as separate, standalone entities, the various embodiments are not limited to this particular architecture.

Exemplary Central Computing Entity

FIG. 2A provides a schematic of a central computing entity 10 according to one embodiment. In general, the terms computing entity, entity, device, system, and/or similar words used herein interchangeably may refer to, for example, one or more computers, computing entities, desktop computers, mobile phones, tablets, phablets, notebooks, laptops, distributed systems, items/devices, terminals, servers or server networks, blades, gateways, switches, processing devices, processing entities, set-top boxes, relays, routers, network access points, base stations, the like, and/or any combination of devices or entities adapted to perform the functions, operations, and/or processes described herein. Such functions, operations, and/or processes may include, for example, transmitting, receiving, operating on, processing, displaying, storing, determining, creating/generating, monitoring, evaluating, comparing, and/or similar terms used herein interchangeably. In one embodiment, these functions, operations, and/or processes can be performed on data, content, information, and/or similar terms used herein interchangeably.

As indicated, in one embodiment, the central computing entity 10 may also include one or more network and/or communications interfaces 108 for communicating with various computing entities, such as by communicating data, content, information, and/or similar terms used herein interchangeably that can be transmitted, received, operated on, processed, displayed, stored, and/or the like. For instance, the central computing entity 10 may communicate with other computing entities, one or more user computing entities 30, and/or the like.

As shown in FIG. 2A, in one embodiment, the central computing entity 10 may include or be in communication with one or more processing elements 105 (also referred to as processors, processing circuitry, and/or similar terms used herein interchangeably) that communicate with other elements within the central computing entity 10 via a bus, for example, or network connection. As will be understood, the processing element 105 may be embodied in a number of different ways. For example, the processing element 105 may be embodied as one or more complex programmable logic devices (CPLDs), microprocessors, multi-core processors, coprocessing entities, application-specific instruction-set processors (ASIPs), and/or controllers. Further, the processing element 105 may be embodied as one or more other processing devices or circuitry. The term circuitry may refer to an entirely hardware embodiment or a combination of hardware and computer program products. Thus, the processing element 105 may be embodied as integrated circuits, application specific integrated circuits (ASICs), field programmable gate arrays (FPGAs), programmable logic arrays (PLAs), hardware accelerators, other circuitry, and/or the like. As will therefore be understood, the processing element 105 may be configured for a particular use or configured to execute instructions stored in volatile or non-volatile media or otherwise accessible to the processing element 105. As such, whether configured by hardware or computer program products, or by a combination thereof, the processing element 105 may be capable of performing steps or operations according to various embodiments when configured accordingly.

In one embodiment, the central computing entity 10 may further include or be in communication with non-volatile media (also referred to as non-volatile storage, memory, memory storage, memory circuitry and/or similar terms used herein interchangeably). In one embodiment, the non-volatile storage or memory may include one or more non-volatile storage or memory media 106 as described above, such as hard disks, ROM, PROM, EPROM, EEPROM, flash memory, MMCs, SD memory cards, Memory Sticks, CBRAM, PRAM, FeRAM, RRAM, SONOS, racetrack memory, and/or the like. As will be recognized, the non-volatile storage or memory media may store databases, metadata repositories database instances, database management system entities, data, applications, programs, program modules, scripts, source code, object code, byte code, compiled code, interpreted code, machine code, executable instructions, and/or the like. The term database, database instance, database management system entity, and/or similar terms may be used herein interchangeably and in a general sense to refer to a structured or unstructured collection of information/data that is stored in a computer-readable storage medium.

Memory media 106 (e.g., metadata repository) may also be embodied as a data storage device or devices, as a separate database server or servers, or as a combination of data storage devices and separate database servers. Further, in some embodiments, memory media 106 may be embodied as a distributed repository such that some of the stored information/data is stored centrally in a location within the system and other information/data is stored in one or more remote locations. Alternatively, in some embodiments, the distributed repository may be distributed over a plurality of remote storage locations only. An example of the embodiments contemplated herein would include a cloud data storage system maintained by a third party provider and where some or all of the information/data required for the operation of the system may be stored. As a person of ordinary skill in the art would recognize, the information/data required for the operation of the system may also be partially stored in the cloud data storage system and partially stored in a locally maintained data storage system.

Memory media 106 (e.g., metadata repository) may include information/data accessed and stored by the system to facilitate the operations of the system. More specifically, memory media 106 may encompass one or more data stores configured to store information/data usable in certain embodiments. For example, as shown in FIG. 2B, metadata for data assets may be stored in metadata repositories encompassed within the memory media 106. The metadata for the data assets in the metadata data stores, metadata repositories, and similar words used herein interchangeably may comprise file information/data 111, relational information/data 112, Hive information/data 113, data lake information information/data, and/or various other types of information/data.

In one embodiment, the central computing entity 10 may further include or be in communication with volatile media (also referred to as volatile storage, memory, memory storage, memory circuitry and/or similar terms used herein interchangeably). In one embodiment, the volatile storage or memory may also include one or more volatile storage or memory media 107 as described above, such as RAM, DRAM, SRAM, FPM DRAM, EDO DRAM, SDRAM, DDR SDRAM, DDR2 SDRAM, DDR3 SDRAM, RDRAM, RIMM, DIMM, SIMM, VRAM, cache memory, register memory, and/or the like. As will be recognized, the volatile storage or memory media may be used to store at least portions of the databases, database instances, database management system entities, data, applications, programs, program modules, scripts, source code, object code, byte code, compiled code, interpreted code, machine code, executable instructions, and/or the like being executed by, for example, the processing element 105. Thus, the databases, database instances, database management system entities, data, applications, programs, program modules, scripts, source code, object code, byte code, compiled code, interpreted code, machine code, executable instructions, and/or the like may be used to control certain aspects of the operation of the central computing entity 10 with the assistance of the processing element 105 and operating system.

As indicated, in one embodiment, the central computing entity 10 may also include one or more network and/or communications interfaces 108 for communicating with various computing entities, such as by communicating data, content, information, and/or similar terms used herein interchangeably that can be transmitted, received, operated on, processed, displayed, stored, and/or the like. For instance, the central computing entity 10 may communicate with computing entities or communication interfaces of other computing entities (e.g., similar to or the same as the central computing entity 10), user computing entities 30, and/or the like.

As indicated, in one embodiment, the central computing entity 10 may also include one or more network and/or communications interfaces 108 for communicating with various computing entities, such as by communicating data, content, information, and/or similar terms used herein interchangeably that can be transmitted, received, operated on, processed, displayed, stored, and/or the like. Such communication may be executed using a wired data transmission protocol, such as fiber distributed data interface (FDDI), digital subscriber line (DSL), Ethernet, asynchronous transfer mode (ATM), frame relay, data over cable service interface specification (DOCSIS), or any other wired transmission protocol. Similarly, the central computing entity 65 may be configured to communicate via wireless external communication networks using any of a variety of protocols, such as general packet radio service (GPRS), Universal Mobile Telecommunications System (UMTS), Code Division Multiple Access 2000 (CDMA2000), CDMA2000 1×

(1×RTT), Wideband Code Division Multiple Access (WCDMA), Global System for Mobile Communications (GSM), Enhanced Data rates for GSM Evolution (EDGE), Time Division-Synchronous Code Division Multiple Access (TD-SCDMA), Long Term Evolution (LTE), Evolved Universal Terrestrial Radio Access Network (E-UTRAN), Evolution-Data Optimized (EVDO), High Speed Packet Access (HSPA), High-Speed Downlink Packet Access (HSDPA), IEEE 802.11 (Wi-Fi), Wi-Fi Direct, 802.16 (WiMAX), ultra-wideband (UWB), infrared (IR) protocols, near field communication (NFC) protocols, Wibree, Bluetooth protocols, wireless universal serial bus (USB) protocols, and/or any other wireless protocol. The central computing entity 65 may use such protocols and standards to communicate using Border Gateway Protocol (BGP), Dynamic Host Configuration Protocol (DHCP), Domain Name System (DNS), File Transfer Protocol (FTP), Hypertext Transfer Protocol (HTTP), HTTP over TLS/SSL/Secure, Internet Message Access Protocol (IMAP), Network Time Protocol (NTP), Simple Mail Transfer Protocol (SMTP), Telnet, Transport Layer Security (TLS), Secure Sockets Layer (SSL), Internet Protocol (IP), Transmission Control Protocol (TCP), User Datagram Protocol (UDP), Datagram Congestion Control Protocol (DCCP), Stream Control Transmission Protocol (SCTP), HyperText Markup Language (HTML), and/or the like.

As will be appreciated, one or more of the central computing entity's components may be located remotely from other components of the central computing entity 10, such as in a distributed system. Furthermore, one or more of the components may be aggregated and additional components performing functions described herein may be included in the central computing entity 10. Thus, the central computing entity 65 can be adapted to accommodate a variety of needs and circumstances.

Exemplary User Computing Entity

FIG. 3 provides an illustrative schematic representative of user computing entity 30 that can be used in conjunction with various embodiments. As will be recognized, the user computing entity may be operated by an agent and include components and features similar to those described in conjunction with the central computing entity 10. Further, as shown in FIG. 3, the user computing entity may include additional components and features. For example, the user computing entity 30 can include an antenna 312, a transmitter 304 (e.g., radio), a receiver 306 (e.g., radio), and a processing element 308 that provides signals to and receives signals from the transmitter 304 and receiver 306, respectively. The signals provided to and received from the transmitter 304 and the receiver 306, respectively, may include signaling information/data in accordance with an air interface standard of applicable wireless systems to communicate with various entities, such as the central computing entity 10, another user computing entity 30, and/or the like. In this regard, the user computing entity 30 may be capable of operating with one or more air interface standards, communication protocols, modulation types, and access types. More particularly, the user computing entity 30 may operate in accordance with any of a number of wireless communication standards and protocols. In a particular embodiment, the user computing entity 30 may operate in accordance with multiple wireless communication standards and protocols, such as GPRS, UMTS, CDMA2000, 1×RTT, WCDMA, TD-SCDMA, LTE, E-UTRAN, EVDO, HSPA, HSDPA, Wi-Fi, WiMAX, UWB, IR protocols, Bluetooth protocols, USB protocols, and/or any other wireless protocol.

Via these communication standards and protocols, the user computing entity 30 can communicate with various other entities using concepts such as Unstructured Supplementary Service data (USSD), Short Message Service (SMS), Multimedia Messaging Service (MMS), Dual-Tone Multi-Frequency Signaling (DTMF), and/or Subscriber Identity Module Dialer (SIM dialer). The user computing entity 30 can also download changes, add-ons, and updates, for instance, to its firmware, software (e.g., including executable instructions, applications, program modules), and operating system.

According to one embodiment, the user computing entity 30 may include location determining aspects, devices, modules, functionalities, and/or similar words used herein interchangeably. For example, the user computing entity 30 may include outdoor positioning aspects, such as a location module adapted to acquire, for example, latitude, longitude, altitude, geocode, course, direction, heading, speed, UTC, date, and/or various other information/data. In one embodiment, the location module can acquire data, sometimes known as ephemeris data, by identifying the number of satellites in view and the relative positions of those satellites. The satellites may be a variety of different satellites, including LEO satellite systems, DOD satellite systems, the European Union Galileo positioning systems, the Chinese Compass navigation systems, Indian Regional Navigational satellite systems, and/or the like. Alternatively, the location information/data/data may be determined by triangulating the position in connection with a variety of other systems, including cellular towers, Wi-Fi access points, and/or the like. Similarly, the user computing entity 30 may include indoor positioning aspects, such as a location module adapted to acquire, for example, latitude, longitude, altitude, geocode, course, direction, heading, speed, time, date, and/or various other information/data. Some of the indoor aspects may use various position or location technologies including RFID tags, indoor beacons or transmitters, Wi-Fi access points, cellular towers, nearby computing devices (e.g., smartphones, laptops) and/or the like. For instance, such technologies may include iBeacons, Gimbal proximity beacons, BLE transmitters, Near Field Communication (NFC) transmitters, and/or the like. These indoor positioning aspects can be used in a variety of settings to determine the location of someone or something to within inches or centimeters.

The user computing entity 30 may also comprise a user interface comprising one or more user input/output interfaces (e.g., a display 316, a keypad 318 and/or speaker/speaker driver coupled to a processing element 308 and a touch screen, keyboard, mouse, and/or microphone coupled to a processing element 308). For example, the user output interface may be configured to provide an application, browser, user interface, dashboard, webpage, and/or similar words used herein interchangeably executing on and/or accessible via the user computing entity 30 to cause display or audible presentation of information/data and for user interaction therewith via one or more user input interfaces. The user output interface may be updated dynamically from communication with the central computing entity 10. The user input interface can comprise any of a number of devices allowing the user computing entity 30 to receive data, such as the keypad 318 (hard or soft), a touch display, voice/speech or motion interfaces, scanners, readers, or other input device. In embodiments including a keypad 318, the keypad 318 can include (or cause display of) the conventional numeric (0-9) and related keys (#, *), and other keys used for operating the user computing entity 30 and may include a full set of alphabetic keys or set of keys that may be activated to provide a full set of alphanumeric keys. In addition to providing input, the user input interface can be used, for example, to activate or deactivate certain functions, such as screen savers and/or sleep modes. Through such inputs the user computing entity 30 can collect information/data, user interaction/input, and/or the like.

The user computing entity 30 can also include volatile storage or memory 322 and/or non-volatile storage or memory 324, which can be embedded and/or may be removable. For example, the non-volatile memory may be ROM, PROM, EPROM, EEPROM, flash memory, MMCs, SD memory cards, Memory Sticks, CBRAM, PRAM, FeRAM, RRAM, SONOS, racetrack memory, and/or the like. The volatile memory may be RAM, DRAM, SRAM, FPM DRAM, EDO DRAM, SDRAM, DDR SDRAM, DDR2 SDRAM, DDR3 SDRAM, RDRAM, RIMM, DIMM, SIMM, VRAM, cache memory, register memory, and/or the like. The volatile and non-volatile storage or memory can store databases, database instances, database management system entities, data, applications, programs, program modules, scripts, source code, object code, byte code, compiled code, interpreted code, machine code, executable instructions, and/or the like to implement the functions of the user computing entity 30.

Exemplary Networks

In one embodiment, the networks 20 may include, but are not limited to, any one or a combination of different types of suitable communications networks such as, for example, cable networks, public networks (e.g., the Internet), private networks (e.g., frame-relay networks), wireless networks, cellular networks, telephone networks (e.g., a public switched telephone network), or any other suitable private and/or public networks. Further, the networks 20 may have any suitable communication range associated therewith and may include, for example, global networks (e.g., the Internet), MANs, WANs, LANs, or PANs. In addition, the networks 20 may include any type of medium over which network traffic may be carried including, but not limited to, coaxial cable, twisted-pair wire, optical fiber, a hybrid fiber coaxial (HFC) medium, microwave terrestrial transceivers, radio frequency communication mediums, satellite communication mediums, or any combination thereof, as well as a variety of network devices and computing platforms provided by network providers or other entities.

Exemplary Envelopes

Referring now to FIG. 4A-FIG. 7, an envelope construction 40 is illustrated that comprises a front panel 41 that defines an aperture 42 through the front panel 41. In some embodiments, an envelope shell can be formed from a single area of paper or other suitable material. In some embodiments, the envelope construction 40 can further comprise an opaque inset panel 43 fixed to an inside surface of the front panel 41 of the envelope shell such that at least a portion of a front side of the inset panel 43 is visible through the aperture 42. In the assembled form, such as illustrated in FIG. 4A and FIG. 6A, the opaque inset panel 43 can present information, such as a mailing address, a return address, and/or any other suitable content or markings.

In some embodiments, the front panel 41 of the envelope construction 40 (also referred to herein as the "high-integrity opaque-inset panel envelope" and the "envelope") and/or the opaque inset panel 43 (also referred to herein as the "panel," the "opaque panel," the "inset panel," and the "opaque labeling panel") can be formed from a printable material. In some embodiments, the envelope shell of the envelope construction 40 can further comprise of one or more flaps 44*a*, 44*b*, 44*c*, 44*d* (collectively "the flaps 44") that are formed integrally from the same printable material as the front panel 41 of the envelope construction 40 and extend from the edges of the front panel 41. In some embodiments, the opaque inset panel 43 can be disposed on an inner surface of the front panel 41 to cover the aperture 42. The opaque inset panel 43 can have an optical brightness about 1-6% greater than the optical brightness of the printable material, such as that used for the front panel 41 of the envelope construction 40. The envelope construction 40 can be formed by removing portions of a printable material to form the flaps 44 about the front panel 41 and the aperture 42 through the front panel 41, and by then fixing the opaque inset panel 43 to an inner surface of the front panel 41, such that the opaque inset panel 43 covers the aperture 42.

In some embodiments, the opaque inset panel 43 can be adhesively coupled to the inner surface of the front panel 41. In some embodiments, once the flaps 44 are folded about one or more edges of the front panel 41 and coupled to the front panel 41, the envelope construction 40 is formed. In some embodiments, the printable material can comprise or be coated with a hydrophobic material to reduce or prevent liquid (e.g., water) intrusion into an inner volume of the envelope construction 40. In some embodiments, the flaps 44 can be coupled to the front panel 41 by an adhesive material disposed therebetween. In some embodiments, once the envelope construction 40 is assembled, a flux of moisture and dust from outside the envelope construction 40 into the inner volume of the envelope construction 40 may be less than a flux threshold. In some embodiments, the printable material can have a first optical brightness (e.g., about 92) and opaque inset panel 43 may have a second optical brightness (e.g., 97) greater than the first optical brightness. In some embodiments, a difference between the second optical brightness and the first optical brightness can be greater than about 1% of the first optical brightness. In some embodiments, a difference between the second optical brightness and the first optical brightness can be greater than about 5% of the first optical brightness. In some embodiments, a difference between one or more optical properties of the printable material and the one or more optical properties of the opaque inset panel 43 can be greater than about 0.01%, about 0.1%, about 0.25%, about 0.5%, about 1%, about 2%, about 3%, about 4%, about 5%, about 6%, about 7%, about 8%, about 9%, about 10%, or greater than about 15%, inclusive of all values and regions therebetween. In some embodiments, the difference between one or more optical properties of the printable material and the one or more optical properties of the opaque inset panel 43 can be between about 0.01% and about 15%, between about 1% and about 10%, between about 2% and about 8%, between about 3% and about 6%, between about 4% and about 5%, between about 3% and about 5%, between about 4% and about 6%, between about 5% and about 7%, between about 5% and about 6%, between about 6% and about 7%, between about 4% and about 8%, between about 5% and about 9%, between about 6% and about 10%, or between about 4.5% and about 6.5%, inclusive of all values and regions therebetween. In some embodiments, the optical brightness of the printable material can be between about 0 and about 99, about 10 and about 98, about 20 and about 97, about 30 and about 96, about 40 and about 95, about 50 and about 94, about 60 and about 93, about 70 and about 92, about 80 and about 91, about 50 and about 95, about 60 and about 95, about 70 and about 95, about 80 and about 95, about 90 and about 95, or about 85 and about 94, inclusive of all values and ranges therebetween. In some embodiments, the optical brightness of the printable material can be less than about 99, about 98, about 97, about 96, about 95, about 94, about 93, about 92, about 91, about 90, about 89, about 88, about 87, about 86, about 85, about 84, about 83, about 82, about 81, about 80, about 70, about 60, about 50, about 40, about 30, about 20, or about 10, inclusive of all values and ranges therebetween. In some embodiments, the opaque inset panel 43 can have an optical brightness of between about 80 and about 100, about 85 and about 99, about 90 and about 98, about 91 and about 97, about 92 and about 96, about 93 and about 95, about 92 and about 99, about 93 and about 99, about 94 and about 99, about 95 and about 99, about 96 and about 99, about 97 and about 99, about 98 and about 99, about 91 and about 100, about 92 and about 100, about 93 and about 100, about 94 and about 100, about 95 and about 100, about 96 and about 100, about 98 and about 100, or about 99 and about 100, inclusive of all values and ranges therebetween. In some embodiments, the optical brightness of the opaque inset panel 43 can be greater than about 80, about 81, about 82, about 83, about 84, about 85, about 86, about 87, about 88, about 89, about 90, about 91, about 92, about 93, about 94, about 95, about 96, about 97, about 98, or about 99, inclusive of all values and ranges therebetween.

In some embodiments, the differences between the printable material and the opaque inset panel 43 may be differences in optical properties other than brightness, such as whiteness, color, opacity, gloss, and/or the like. In some embodiments, the differences between the printable material and the opaque inset panel 43 may be differences in dimensional characteristics, such as caliper (thickness), the density, the specific gravity, the basis weight, the rupture strength (burst strength), tensile strength, and/or the like. In some embodiments, the optical properties of the opaque inset panel 43 can be modified by chemically treating, bleaching, coating, dying, irradiating, heating, or otherwise modifying a printable material, such as paper, to achieve the desired optical properties relative to the printable material used for the front panel 41 of the envelope construction 40. In some embodiments, instead of modifying the optical properties of the opaque inset panel 43, the envelope shell or front panel 41 thereof may be modified, such as described above with regard to the opaque inset panel 43, to achieve the desired optical properties relative to the opaque inset panel 43. In some embodiments, the desired optical properties of the printable material used for the front panel 41 of the envelope shell and the desired optical properties of the opaque inset panel 43 can be achieved, at least in part, through material selection by selecting materials or a combination of materials that will have the desired optical properties without requiring further treatment or modification of the material, or which will reduce the extent of treatment or modification of the material required to achieve the desired optical properties. In this regard, the opaque inset panel 43 and the printable material for the envelope shell need not comprise different materials in order for the relative optical properties to be achieved. For instance, the relative optical properties can be achieved by treating only one of the opaque inset panel 43 or the printable material used for the envelope shell. In some embodiments, the opaque inset panel 43 can be made from the printable material and simply further treated, dyed, coated, or otherwise modified to achieve the relative optical properties. Alternatively, in some embodiments, the opaque inset panel 43 can be a fibrous material, such as paper, that is made from pulp that has been bleached to a greater extent prior to papermaking.

In some embodiments, textural differences between the opaque inset panel 43 and the printable material used for the envelope shell may be helpful for causing the recipient of the mail to believe or perceive that the opaque inset panel 43 is actually the document within the envelope that the recipient is seeing through a window in the face of the envelope. As such, a material, such as paper, may be chosen for the opaque inset panel 43 that has one or more textural properties that are different from those of the printable material used for the envelope shell. In some embodiments, e.g., in the context of a paper material being used for the opaque inset panel 43, the surface roughness, fiber length, recycled content rate, filler concentration, additive type and concentration, pulp source, finishing/sizing additives rate, paper grain, weave, grammage, density, coating(s) used, z-directional thickness, lignin content, pulping method, bleaching method, and other processes, characteristics, or attributes of the paper material can be modified or fine-tuned to achieve the desired textural properties. In some embodiments, some or all of these processes, characteristics, or attributes can be modified or fine-tuned to achieve the desired optical properties also or instead.

In some embodiments, a system (e.g., system 1) or apparatus (e.g., 10, 20, 30) can be provided that comprises at least one processor and at least one memory storing instructions, the at least one memory storing instructions, with the at least one processor, configured to cause the apparatus to at least: cause the formation and assembly of an envelope. In some embodiments, the at least one memory storing instructions, with the at least one processor, can cause the apparatus to at least: provide a printable material; remove one or more portions of the printable material to form one or more external edges of one or more flaps; define a folding edge in the printable material at an inside edge of each of the one or more flaps to define a front panel of the envelope and one or more flaps; remove one or more other portions of the printable material to define one or more apertures 42 through the front panel; and disposing one or more opaque labeling panels or one or more opaque inset panels 43 to an inner surface of the front panel, such that the one or more opaque labeling panels or one or more opaque inset panels 43 cover or substantially cover the one or more apertures 42. In some embodiments, the one or more flaps are configured to form a back panel of the envelope when each of the one or more flaps are suitably folded respectively about the folding edge and coupled to the front panel or another of the one or more flaps. In some embodiments, disposing the one or more opaque labeling panels or the one or more opaque inset panels 43 to the inner surface of the front panel comprises adhesively coupling the one or more opaque labeling panels or the one or more opaque inset panels 43 to the inner surface of the front panel. In some embodiments, the printable material comprises or is coated with a hydrophobic material. In some embodiments, the at least one memory storing instructions, with the at least one processor, can cause the apparatus to at least: adhesively couple a portion of the one or more flaps to the inside surface of the front panel to form the back panel of the envelope and an inner volume of the envelope; dispose at least one piece of mail into the inner volume of the envelope; and adhesively couple a remaining portion of the one or more flaps to the inside surface of the front panel to seal the envelope against flux of moisture and contaminants into the inner volume of the envelope.

In some embodiments, such as illustrated in FIG. 5 and FIG. 7, the envelope construction 40 can comprise an inner surface on which is disposed, printed, sprayed, dyed, imprinted, or otherwise marked a particular hash pattern configured to obfuscate the content within the envelope construction 40. In some embodiments, even with the hashing inside conventional window envelopes, the same personal, private, confidential, or privileged information from inside the envelope that the hashing is designed to obfuscate may be visible through the window. However, according to some embodiments described herein, such a hash pattern, in conjunction with the use of the opaque inset panel 43 spanning the aperture 42, such personal, private, confidential, or privileged information can be better protected.

In some embodiments, such as illustrated in FIG. 6C, the use of flaps such as 44*c* and 44*d* that include an initial fold at the edge of the front panel 41 and a subsequent fold part way to the extents may allow for a portion of another flap (e.g., 44*b*) to be adhesively fixed between two portions of the flaps 44*c*, 44*d* to add to the durability of construction of the envelope construction 40.

In some embodiments, a computer program product can be provided that comprises a non-transitory computer-readable medium storing computer code, the computer code operable to cause an apparatus, such as that described above, to carry out one or more of the methods, approaches, processes, sub-processes, or actions described herein.

Referring now to FIG. 6B, FIG. 8, FIG. 9A, and FIG. 9B, there are various possible approaches for fixing the opaque inset panel 43 to the inside of the front panel 41 of the envelope shell. As illustrated in FIG. 6B, which illustrates a cross-sectional view, along dashed line A-A in FIG. 6A, an adhesive 45 can be applied to one or both of the inside of the front panel 41 of the envelope or a top side of the opaque inset panel 43 before disposing the opaque inset panel 43 onto the inside of the front panel 41. In some embodiments, the opaque inset panel 43 can be sized such that the opaque inset panel 43 can be disposed about the aperture 42 that is defined by an opening through the front panel 41 of the envelope construction 40. In some embodiments, the opaque inset panel 43 can have a length and width that is sufficient to span the entire length and width of the aperture 42 while also leaving some room above, below, and on each side of the aperture 42 for the adhesive 45 to be applied between the opaque inset panel 43 and the inside of the front panel 41 of the envelope construction 40. In some embodiments, the adhesive 45 can be disposed continuously or discretely about one or more edges of the aperture 42 and the opaque inset panel 43 can then be disposed onto the inside of the front panel 41, such that the extents of the opaque inset panel 43 cover all disposed adhesive 45. In other embodiments, the adhesive can be applied to a contact surface of the opaque inset panel 43, sufficiently near the edges of the opaque inset panel 43 that when the opaque inset panel 43 is disposed onto the inside of the front panel 41 the adhesive 45 does not migrate either across the inside of the front panel 41 in a direction extending beyond the extents of the opaque inset panel 43 or across the front of the opaque inset panel 43 in a direction extending beyond the edge of the aperture 42.

As illustrated in FIG. 8, a first portion of adhesive 45*a* can be disposed between the inside of the front panel 41 and the contact surface of the opaque inset panel 43 along a first side of the opaque inset panel 43, and a second portion of the adhesive 45*b* can be disposed between the inside of the front panel 41 and the contact surface of the opaque inset panel 43 along a second side of the opaque inset panel 43. In some embodiments, a third and fourth portion of adhesive (not shown) can be disposed at a third and fourth respective side of the opaque inset panel 43. In some embodiments, the first and second portions of adhesive 45*a*, 45*b* can be disposed onto the opaque inset panel 43 at respective first and second edges of the opaque inset panel 43, while the third and fourth portions of adhesive can be disposed on the inside of the front panel 41 of the envelope construction 40 along respective edges of the aperture 42 that will be associated with, respectively, the third and fourth edges of the opaque inset panel 43 once fixed to the inside of the front panel 41 of the envelope construction 40. In some embodiments, a continuous line of adhesive 45 can be disposed along all edges of the opaque inset panel 43 or along the edge of the aperture 42 inside the front panel 41 of the envelope construction 40 before joining the opaque inset panel 43 to the inside of the front panel 41 of the envelope construction 40.

In some embodiments, such as illustrated in FIG. 9A, an interstitial layer 46 may be disposed between the adhesive 45*a*, 45*b* and the opaque inset panel 43. In some embodiments, the interstitial layer 46 may comprise a coating, a covering, a transparent film, a translucent film, a partially opaque film, a tinted film, or the like. In some embodiments, the interstitial layer 46 may increase the water resistance of the opaque inset panel 43. In some embodiments, the interstitial layer 46 can change the optical properties of the opaque inset panel 43. In some embodiments, the interstitial layer 46 can increase the glossiness or shininess of the opaque inset panel 43, such that the recipient of the envelope construction 40 may perceive the opaque inset panel 43 to be a portion of the document within the envelope construction 40 that is being seen through a window in the face of the envelope construction 40, the window being covered on the inside by a protective film or layer. In some embodiments, while not illustrated in FIG. 9A, more or a different adhesive may be disposed between the interstitial layer 46 and the opaque inset panel 43. In some embodiments, a method of manufacturing the envelope construction 40 can comprise disposing or affixing the interstitial layer 46 to a front side (contacting side) of the opaque inset panel 43, disposing a portion of adhesive to a front side (contacting side) of the interstitial layer 46 (or to the inside of the front panel 41 at one or more locations surrounding the aperture 42), and joining the interstitial layer 46 to the inside of the front panel 41 of the envelope construction 40, such that the laminate structure of the interstitial layer 46 and the opaque inset panel 43 spans the entirety of the aperture 42 and the adhesive on the front side of the interstitial layer 46 contacts the inside of the front panel 41 of the envelope construction 40 at suitable location(s) about the aperture 42.

In other embodiments, such as illustrated in FIG. 9B, the interstitial layer 46 may be disposed between the adhesive 45*a*, 45*b* and the inside of the front panel 41 of the envelope construction 40, with the adhesive 45*a*, 45*b* between the opaque inset panel 43 and the interstitial layer 46 defining an interstitial volume 47 between the opaque inset panel 43, the interstitial layer 46, and the adhesive 45*a*, 45*b*. In some embodiments, by defining or forming such an interstitial volume 47, a "depth" may be created between the front panel 41 and the opaque inset panel 43, which can further cause the recipient of the envelope construction 40 to perceive that the opaque inset panel 43 is actually the document(s) retained within the envelope construction 40, as viewed through the aperture 42 of the front panel 41 of the envelope construction 40. In some embodiments, by defining or forming such an interstitial volume 47, a further "depth" may also be created between the interstitial layer 46 and the opaque inset panel 43, which may cause the recipient to further perceive that the interstitial layer 46 (e.g., a transparent or translucent film) is a protective cellophane portion covering a window to the envelope construction 40 and that the opaque inset panel 43 is actually the document(s) retained within the envelope construction 40. In some embodiments, a method of manufacturing the envelope construction 40 can comprise disposing a portion of adhesive to a front side (contacting side) of the opaque inset panel 43, disposing the interstitial layer 46 onto the opaque inset panel 43, disposing an additional portion of adhesive to a front side (contacting side) of the interstitial layer 46 (or to the inside of the front panel 41 at one or more locations surrounding the aperture 42), and adhesively joining the interstitial layer 46 to the inside of the front panel 41 of the envelope construction 40, such that the laminate structure of the interstitial layer 46 and the opaque inset panel 43 spans the entirety of the aperture 42 and the adhesive on the front side of the interstitial layer 46 contacts the inside of the front panel 41 of the envelope construction 40 at suitable location(s) about the aperture 42.

As discussed above, recipients of such mail often, whether consciously, subconsciously, or unconsciously, may evaluate the relative importance of a piece of mail by one or more features of the outside of the envelope. As such, by adding an interstitial layer 46 such as a thin film or the like between the inside of the front panel 41 of the envelope construction 40 and the opaque inset panel 43, the recipient may be more likely to perceive that the opaque inset panel 43 is actually a portion of the document within the envelope construction 40, as viewed through the aperture 42, and to perceive the document(s) within the envelope construction 40 to be of relatively greater importance due to the use of the interstitial layer 46, which may likely to be perceived as a cellophane portion covering the aperture 42 in the front panel 41 of the envelope construction 40. Without wishing to be bound by any particular theory, by causing the recipient of the envelope construction 40 to perceive that the envelope construction 40 is a window envelope with a protective cellophane portion over the window in the front face of the envelope, there may be an increased likelihood of the recipient opening the envelope, which may reduce the need for follow-up, repetitious mailing of the same document to recipients who do not open the mail, can reduce the overall cost of mailing documents to recipients, can, importantly, result in the recipient being made aware of an important document, and/or can reduce the environmental impacts associated with such repetitious mailing.

Referring now to FIG. 10A and FIG. 10B, an exemplary envelope 50, according to a certain embodiment, is illustrated which comprises a front panel 51, a first aperture 52 through the front panel 51, a second aperture 54 through the front panel 51, and an opaque inset panel 53 disposed to a back side of the front panel 51 such that the opaque inset panel 53 covers one or both of the first aperture 52 and the second aperture 54. In some embodiments, the envelope 50 can further comprise flaps 55*a*, 55*b*, 55*c*, 55*d* configured to be foldable about one or more edges of the front panel 51 in order to form a back of the envelope 50. The first aperture 52 and the second aperture 54 can be positioned anywhere on the front panel 51 of the envelope 50. In some embodiments, the first aperture 52 may be positioned, when looking at the envelope 50 from a front side (as in FIG. 10A), at or near the top left of the front panel 51. In some embodiments, the associated region of the opaque inset panel 53 that is viewable through the first aperture 52 may be printed with information such as a return address of the sender, a logo or brand identifiers, numbers, or the like. In some embodiments, the second aperture 54 may be positioned, when looking at the envelope from the front side (as in FIG. 10A), below the first aperture 52 and to the right, but without being centered or to the right of center of a vertical median of the envelope construction 40. In some embodiments, the associated region of the opaque inset panel 53 that is viewable through the second aperture 54 may be printed with information such as a mailing address of the recipient or the like. As illustrated in FIG. 10B, a single opaque inset panel 53 can be used to cover both apertures 52, 54 and/or to provide information or the like that is viewable through the respective apertures 52, 54. To do so, during production and/or printing of the opaque inset panel 53, a first region of the opaque inset panel 53 that is spatially aligned or substantially spatially aligned with the first aperture 52 can be denoted, marked, designated, delineated, identified, or otherwise determined; a second region of the opaque inset panel 53 that is spatially aligned or substantially spatially aligned with the second aperture 54 can be determined; the correct content associated with the first aperture 52 can be printed onto the first region of the opaque inset panel 53; the correct content associated with the second aperture 54 can be printed onto the second region of the opaque inset panel 53; and the envelope 50 can then be assembled according to any of the various approaches described herein.

Referring now to FIG. 11A and FIG. 11B, an exemplary envelope 60, according to a certain embodiment, is illustrated which comprises a front panel 61, an aperture 62 through the front panel 61, and an opaque inset panel 63 disposed to a back side of the front panel 61, such that the opaque inset panel 63 covers or substantially covers the aperture 62. In some embodiments, the envelope 60 can further comprise flaps 64*a*, 64*b*, 64*c*, 64*d* configured to be foldable about one or more edges of the front panel 61 in order to form a back of the envelope 60. The aperture 62 can be positioned anywhere on the front panel 61 of the envelope 60. In some embodiments, the aperture 62 may be formed, when looking at the envelope 60 from a front side (as in FIG. 11A) in a left-justified position by removing a portion of the front panel 61, such that the space between the aperture 62 and a left edge, top edge, and bottom edge of the front panel 61 are equal or substantially equal. In some embodiments, the associated region of the opaque inset panel 63 that is viewable through the aperture 62 may be printed with information such as a mailing address, a return address of the sender, a logo, brand information, unique mailing identifiers, and/or the like. In some embodiments, unlike in the embodiment of FIG. 10A and FIG. 10B, a single, relatively larger aperture 62 may be formed that allows for the use of an opaque inset panel 63 having a larger surface area onto which such information may be printed and leading to more spatial flexibility with regard to where the information is printed on the opaque inset panel 63. In some instances in which a single opaque inset panel 63 is used but multiple discrete pieces of information (e.g., a mailing address and a return address) are desired to be printed on the opaque inset panel 63, it can still be helpful to, during production and/or printing of the opaque inset panel 63, identify a first region of the opaque inset panel 63 that is spatially aligned or substantially spatially aligned with the desired location of the first discrete piece of information (e.g., a top-left position on the opaque inset panel 63 for a return address); identify a second region of the opaque inset panel 63 that is spatially aligned or substantially spatially aligned with the desired location of the second discrete piece of information (e.g., a center-bottom position on the opaque inset panel 63 for a mailing address); identify an $n^{th}$ region of the opaque inset panel 63 that is spatially aligned or substantially spatially aligned with the desired location of an $n^{th}$ discrete piece of information (e.g., a top-right position on the opaque inset panel 63 for a company mark, logo, or advertisement); print each of the discrete pieces of information on the opaque inset panel 63 in their respective position; and then assemble the envelope 60 according to any of the various approaches described herein.

Referring now to FIG. 12A and FIG. 12B, an exemplary envelope 70, according to a certain embodiment, is illustrated which comprises a front panel 71, a first aperture 72 defined through the front panel 71 at a first location, a second aperture 74 defined through the front panel 71 at a second location, a third aperture 75 defined through the front panel 71 at a third location, and an opaque inset panel 73 disposed to a back side of the front panel 71, such that the opaque inset panel 73 covers or substantially covers the apertures 72, 74, 75. In some embodiments, the envelope 70 can further comprise of flaps 76*a*, 76*b*, 76*c*, 76*d* configured to be foldable about one or more edges of the front panel 71 in order to form a back of the envelope 70. The apertures 72, 74, 75 can be positioned anywhere on the front panel 71 of the envelope 70. In some embodiments, the first aperture 72 may be formed, when looking at the envelope 70 from a front side (as in FIG. 12A) in a top-left-justified position. In some embodiments, the second aperture 74 may be formed in a bottom-left-justified position at a location beneath the first aperture 72. In some embodiments, the third aperture 75 may be positioned anywhere in the envelope to the right of the first and second apertures 72, 74. In some embodiments, a first region, second region, and third region of the opaque inset panel 73 that are viewable through each respective aperture 72, 74, 75 may be printed with information such as a mailing address, a return address of the sender, a logo, brand information, unique mailing identifiers, and/or the like. In some embodiments, unlike in the embodiment of FIG. 11A and FIG. 11B in which a single, relatively larger aperture 62 may be formed, the use of multiple discrete apertures 72, 74, 75 can help both the recipient, as well as sorting technologies, more quickly identify which region of printed content on the face of the envelope 70 refers to what particular information being sought (e.g., mailing address, return address, a unique mailing or company identifier, a company logo, or the like). In some instances in which a single opaque inset panel 73 is used, but multiple discrete pieces of information (e.g., a mailing address and a return address) are desired to be printed on the opaque inset panel 73 in particular locations that spatially correspond to the apertures 72, 74, 75, it can be helpful to, during production and/or printing of the opaque inset panel 73, identify the first region of the opaque inset panel 73 that is spatially aligned or substantially spatially aligned with the first aperture 72 (e.g., a top-left position on the opaque inset panel 73 for a return address); identify the second region of the opaque inset panel 73 that is spatially aligned or substantially spatially aligned with the second aperture 74 (e.g., a center-bottom position on the opaque inset panel 73 for a mailing address); identify a third region of the opaque inset panel 73 that is spatially aligned or substantially spatially aligned with the third aperture 75 (e.g., a top-right position on the opaque inset panel 73 for a company mark, logo, or advertisement); print each of the discrete pieces of information on the opaque inset panel 73 in their respective position; and then assemble the envelope 70 according to any of the various approaches described herein.

Referring now to FIG. 13A and FIG. 13B, an exemplary envelope 80, according to a certain embodiment, is illustrated which comprises a front panel 81, a first aperture 82 defined through the front panel 81 at a first location, a second aperture 84 defined through the front panel 81 at a second location, a third aperture 85 defined through the front panel 81 at a third location, a first opaque inset panel 83 disposed to a back side of the front panel 81, such that the first opaque inset panel 83 covers or substantially covers the first and second apertures 82, 84, and a second opaque inset panel 86 disposed to the back side of the front panel 81, such that the second opaque inset panel 86 covers or substantially covers the third aperture 85. Conversely, in some embodiments, the first opaque inset panel 83 may cover only the first aperture 82 or the first and third apertures 84, 85, while the second opaque inset panel 86 may conversely cover the first and third apertures 82, 85 or the second and third apertures 84, 85. In some embodiments, the envelope 80 can further comprise flaps 87*a*, 87*b*, 87*c*, 87*d* configured to be foldable about one or more edges of the front panel 81 in order to form a back of the envelope 80. The apertures 82, 84, 85 can be positioned anywhere on the front panel 81 of the envelope 80. In some embodiments, the first aperture 82 may be formed, when looking at the envelope 80 from a front side (as in FIG. 13A) in a top-left-justified position. In some embodiments, the second aperture 84 may be formed in a bottom-left-justified position at a location beneath the first aperture 82. In some embodiments, the third aperture 85 may be formed anywhere in the envelope to the right of the first and second apertures 82, 84. In some embodiments, a first region and a second region of the first opaque inset panel 83 that are viewable through, respectively, the first and second apertures 82, 84 may be printed with information, such as a mailing address, a return address of the sender, a logo, brand information, unique mailing identifiers, and/or the like. Likewise, in some embodiments, the portion of the second opaque inset panel 86 that is viewable through the third aperture 85 may be printed with information such as a mailing address, a return address of the sender, a logo, brand information, unique mailing identifiers, and/or the like. In some embodiments, unlike in the embodiment of FIG. 11A and FIG. 11B in which a single, relatively larger aperture 62 may be formed, the use of multiple discrete apertures 82, 84, 85 can help both the recipient, as well as sorting technologies, more quickly identify which region of printed content on the face of the envelope 80 refers to what particular information being sought (e.g., mailing address, return address, a unique mailing or company identifier, a company logo, or the like). However, unlike in the embodiment of FIG. 11A and FIG. 11B, the information to be printed on the two opaque inset panels 83, 86 must be particularly positioned in order for the information to align with and be viewable through the respective apertures 82, 84, 85 in the front panel 81 of the envelope 80, which means that the envelope architecture may dictate or substantially dictate the position, size, affixed location, printing position, and/or the like for the opaque inset panels 83, 86. In some embodiments, a first and second region of the first opaque inset panel 83 may need to be determined and/or delineated (e.g., by computer aided alignment or by small positioning markers being printed on the first opaque inset panel 83) such that the first and second discrete portions of printed content are properly printed, respectively, in the first region of the first opaque inset panel 83 associated spatially with the first aperture 82 and the second region of the first opaque inset panel 83 associated spatially with the second aperture 84 (e.g., for, respectively, a mailing address and a return address). Then once the regions are identified or delineated for the printed material positioning on the first opaque inset panel 83, a production and/or printing process can be carried out by identifying the first and second regions of the first opaque inset panel 83 that are spatially aligned or substantially spatially aligned with, respectively, the first and second apertures 82, 84; print the discrete pieces of information on the first opaque inset panel 83 in their respective positions; print the other information on the second opaque inset panel 86; and then assemble the envelope 80 according to any of the various approaches described herein.

Referring now to FIG. 14A and FIG. 14B, an exemplary envelope 90, according to a certain embodiment, is illustrated which comprises a front panel 91, a first aperture 92 defined through the front panel 91 at a first location, a second aperture 94 defined through the front panel 91 at a second location, a third aperture 96 defined through the front panel 91 at a third location, a first opaque inset panel 93 disposed to a back side of the front panel 91, such that the first opaque inset panel 93 covers or substantially covers the first aperture 92, a second opaque inset panel 95 disposed to the back side of the front panel 91, such that the second opaque inset panel 95 covers or substantially covers the second aperture 94, and a third opaque inset panel 97 disposed to the back side of the front panel 91, such that the third opaque inset panel 97 covers or substantially covers the third aperture 96. In some embodiments, the envelope 90 can further comprises flaps 98*a*, 98*b*, 98*c*, 98*d* configured to be foldable about one or more edges of the front panel 91 in order to form a back of the envelope 90. The apertures 92, 94, 96 can be positioned anywhere on the front panel 91 of the envelope 90. In some embodiments, the first aperture 92 may be formed, when looking at the envelope 90 from a front side (as in FIG. 14A) in a top-left-justified position. In some embodiments, the second aperture 94 may be formed in a bottom-left-justified position at a location beneath the first aperture 92. In some embodiments, the third aperture 96 may be positioned anywhere in the envelope 90 to the right of the first and second apertures 92, 94.

In some embodiments, for purposes of ensuring that content printed on the opaque inset panels 93, 95, 97 will be sufficiently viewable once affixed to the back side of the front panel 91 of the envelope 90, a buffer or margin may be marked, defined, delineated or otherwise determined on the contact surface of each of the opaque inset panels 93, 95, 97. In some embodiments, such a buffer or margin may be based, for instance, on at least an overlap caused by the difference in dimensions (W×H) between each of the opaque inset panels 93, 95, 97 and their respective apertures 92, 94, 96. For instance, if the dimensional difference is 2 mm by 2 mm between the third opaque inset panel 97 and the third aperture 96, then an initial margin for purposes of ensuring that printed content can be seen through the third aperture 96 would be 1 mm in from each edge of the third opaque inset panel 97. In some embodiments, there may be a margin of error with regard to affixing opaque inset panels (e.g., 97) to a precise location on the back side of the front panel 91 of the envelope 90, which may lead to an additional buffer or margin of, for instance, ±0.5 mm, which could increase the per-side buffer or margin to 1.5 mm. In some embodiments, there may be additional aspects of the printing process, the assembling process, or other aspects that may lead to the incorporation of an additional buffer or margin with regard to delineating the effective printable region within the opaque inset panels 93, 95, 97. By doing so, the likelihood may be reduced that any content printed on the opaque inset panels 93, 95, 97 is not visible or becomes hidden with respect to optical sorting machines, manual sorting, the recipient, or the like.

In some embodiments, once the effective printable region within each opaque inset panel 93, 95, 97 is identified or delineated for the printed material positioning, the respective content can be printed on each of the opaque inset panels 93, 95, 97 (either before or after the opaque inset panels 93, 95, 97 are cut from a larger sheet of, e.g., printable material), the opaque inset panels 93, 95, 97 can be affixed (e.g., adhesively) to the suitable portion of the back of the front panel 91, such that the printed content on the front side of each opaque inset panel 93, 95, 97 is visible through the respective aperture 92, 94, 96, and the envelope 90 can then be assembled according to any of the various approaches described herein, (e.g., by folding the flaps and fixing those together to form a back of the envelope 90.)

Referring now to FIG. 15A and FIG. 15B, an exemplary embodiment of an envelope 200, such as a manila envelope, a booklet envelope, or a catalog envelope, is illustrated, the envelope 200 comprising a front panel 201, a first aperture 202 defined or formed through the front panel 201 at a first location, a second aperture 204 defined or formed through the front panel 201 at a second location, a first opaque inset panel 203 disposed on a back side of the front panel 201 and aligned or substantially aligned with the first aperture 202, and a second opaque inset panel 205 disposed on the back side of the front panel 201 and aligned or substantially aligned with the second aperture 204. In some embodiments, the envelope 200 can further comprise flaps 206*a*, 206*b*, 206*c*, 206*d* configured to be foldable about one or more edges of the front panel 201 in order to form a back of the envelope 200.

In some embodiments, the size and shape of the envelope 200 may be different from and/or larger than the size and shape of other previously illustrated envelopes, which may mean that, because the apertures 202, 204 may be located further apart than in commercial mail or letter mail, such as described above, that using a single opaque inset panel may unnecessarily add cost and weight to the envelope. As such, the use of two or more opaque inset panels (e.g., 203, 205) can reduce the cost and weight of the envelope 200. In some embodiments, depending upon the orientation, size, shape, and durability of the envelope 200, it may be desired to define apertures 202, 204 elsewhere in the front panel 201 of the envelope 200, e.g., in an orientation that is one quarter of a clockwise rotation and similarly respectively oriented, such that aperture 202 may present therethrough a return address or the like while aperture 204 may present therethrough a mailing address or the like. Given the increased relative surface area of the envelope 200, it may be possible or advantageous to print anonymized imagery, a company logo, or the like on the front panel 201 of the envelope 200, e.g., in the upper-right-hand corner. In some embodiments, envelope 200 may be constructed durably or be constructed from durable materials and may comprise one or more card slots aligned with or affixed within the apertures 202, 204 and having a translucent or transparent front surface, such that opaque inset panels 203, 205 can be removably, slidably disposed within the one or more card slots, thereby being removably affixed within the respective aperture 202, 204.

Referring now to FIG. 16A and FIG. 16B, an exemplary embodiment of an envelope 300, such as a manila envelope, a booklet envelope, or a catalog envelope, is illustrated, the envelope 300 comprising a front panel 301, an aperture 302 defined or formed through the front panel 301, and an opaque inset panel 303 disposed on the back side of the front panel 301 and aligned or substantially aligned with the aperture 302. In some embodiments, the envelope 300 can further comprise flaps 304*a*, 304*b*, 304*c*, 304*d* configured to be foldable about one or more edges of the front panel 301 in order to form a back of the envelope 300.

In some embodiments, envelopes that are as large on their face as envelope 200, described above, often are relatively more durable, however such envelopes typically become less durable when a relatively large window (e.g., the size of aperture 302) is formed within the front face of the envelope. Even when a cellophane cover is disposed across the window of such large envelopes, the flexible cellophane film provides little or no structural or mechanical strength to the envelope. However, with envelope 300, when the opaque inset panel 303 is formed from a durable material, and when the extents of the opaque inset panel 303 are adhesively coupled to the back of the front panel 301 either continuously or discretely about the aperture 302, the resulting envelope 300 has similar or equal mechanical strength and structural durability to similarly sized and similarly constructed envelopes that do not have a window or aperture formed through the face of the envelope. As such, not only in the larger envelopes (e.g., 200, 300) but also in the smaller envelopes, such as commercial mail envelopes, baronial envelopes, A-style envelopes, and the like, the use of an opaque inset panel can lead to improved durability and mechanical strength of the overall envelope, can lead to a reduced likelihood of damage occurring to the envelope, and can lead to a further reduction in the likelihood that private documents and information from inside the envelope will be exposed during sorting or distribution.

In addition, while envelope 200 provides surface area on the front panel 201 of the envelope 200 that is advantageous for printing anonymized imagery, a company logo, or the like thereon, this requires that printing occurs on the envelope itself and not just the opaque inset panels 203, 205. However, since the opaque inset panel 303 of the envelope 300 is relatively larger than the opaque inset panels 203, 205 relative to the size of the envelopes 300, 200, it may be advantageous in the case of envelope 300 to print additional imagery, a company logo, or the like on the opaque inset panel 303, in addition to the mailing address and/or return address or the like. As such, printing need only occur on the opaque inset panel 303 and not on the front panel 301 of the envelope 300 itself.

In some embodiments, envelopes described herein may comprise, but are not limited to, baronial envelopes, A-style envelopes, A1 envelopes, A2 envelopes, A6 envelopes, A7 envelopes, A8 envelopes, A9 envelopes, A10 envelopes, number 6¼ business envelopes, number 6½ business envelopes, number 6¾ business envelopes, square envelopes, rectangular envelopes, commercial envelopes, booklet envelopes, catalog envelopes, number 7 envelopes (#7), number 7¾ envelopes (#7¾), number 9 envelopes (#9), number 10 envelopes (#10), number 11 envelopes (#11), number 12 envelopes (#12), number 14 envelopes (#14), remittance envelopes, business/commercial envelopes, number C7 envelopes, number C7/6 envelopes, number DL envelopes, number C6 envelopes, number B6 envelopes, Number 1/2BC4 envelopes, number E6 envelopes, number C5 envelopes, number B5 envelopes, number E5 envelopes, number C4 envelopes, number B4 envelopes, number E4 envelopes, any other suitable or available variety, size, type, designation, or category of envelopes, and the like.

In some embodiments, the printable material and/or the opaque inset panels can be or include a polymeric material, a cross-linking material, a synthetic material, an organic material, an inorganic material, a composite material, a natural material, paper, any other suitable material, or the like. In some embodiments, the printable material may comprise a paper sheet of any suitable size and/or characteristics, such as a 16 lb. (16 #) paper material, a 20 lb. (20 #) paper material, a 22 lb. (22 #) paper material, a 24 lb. (24 #) paper material, a 28 lb. (28 #) paper material, a 32 lb. (32 #) paper material, a 50 lb. (50 #) paper material, a 60 lb. (60 #) paper material, a 65 lb. (65 #) paper material, a 80 lb. (80 #) paper material, or the like.

In some embodiments, all edges of the opaque inset panel material can be glued securely inside the envelope. In some embodiments, every character in the delivery address, including any Intelligent Mail Barcode (IMB), marking, or endorsement, may be and remain completely visible through the window or aperture, and the resulting envelope may therefore comply with domestic and international mailing standards without requiring the use of labor-intensive tests, such as the tap-test. For instance, given the margin or buffer determined and delineated, as discussed above, the resulting envelope complies with DMM 601.6.3, which states that the delivery address must show completely, with an ⅛" clearance, in the window of a window envelope, at all times during processing and delivery.

In some embodiments, in addition to the mailing and/or return addresses that are printed or sprayed onto the opaque inset panel, an intelligent barcode may also be printed or sprayed onto the exposed surface of the opaque inset panel to eliminate the need for, e.g., a Multiline optical-character reader (MLOCR), remote video encoding (RVE), and/or the USPS's FASTforward database. Furthermore, in some embodiments, the IMB read rate during presort and in a mail processing system (e.g., the USPS mail processing system) may be increased due to the increased visibility and readability of mailing address/return address details and the intelligent barcode.

Exemplary Methods

Referring now to FIG. 17, a method 1000 is provided for assembling an envelope, the method 1000 comprising providing an envelope blank comprising a front panel formed from a printable material, the front panel comprising an inside surface and one or more apertures through the front panel, the one or more apertures defining one or more windows having a plurality of window edges, at 1010. In some embodiments, the method 1000 can, optionally, further comprise printing one or more of a mailing address, a return address, a unique identifier, a logo, an advertisement, a background, a picture, or a symbol onto the front side of each of the one of the one or more opaque inset panels, at 1020. In some embodiments, the method 1000 can, optionally, further comprise disposing an adhesive to one or more of the inside surface of the front panel at one or more locations adjacent to the plurality of window edges of each of the one or more apertures or a front surface of each of the one or more opaque inset panels at one or more locations adjacent to a plurality of edges of each of the one or more opaque inset panels, at 1030. In some embodiments, the method 1000 can further comprise coupling one or more opaque inset panels to the inside surface of the front panel, the one or more opaque inset panels being positioned on the inside surface of the front panel such that an opaque inset panel of the one or more opaque inset panels covers each of the one or more apertures such that the one or more apertures through the front panel are substantially sealed, at 1040. In some embodiments, the printing 1020 may be carried out after the coupling 1040. In other embodiments, the printing 1020 may be carried out before one or both of the disposing 1030 and the coupling 1040.

In some embodiments, the adhesive comprises one of a back gum, a seam gum, a glue, an epoxy, a fugitive glue, a resin, a dextrin-containing adhesive, a fastening agent, a sealing agent, a water-soluble adhesive, a polymer, a cross-linking agent, an ethylene vinyl acetate copolymer, a polyvinyl alcohol, starches, animal glues, and mixtures thereof. In some embodiments, the printable material and the one or more opaque inset panels are coated with and/or comprise one or more hydrophobic materials, such as waxes, paraffin wax, epicuticular waxes, PDMS, silica-containing coatings, nano-silica coatings, siloxanes, silicone additives, manganese oxide polystyrene ($MnO_2$/PS), zinc oxide polystyrene (ZnO/PS), precipitated calcium carbonate, carbon nano-tube structures, silica nano-coatings, fluoropolymers, fluorinated silanes, fluoroalkylsilane-containing materials such as hydrophobic hybrid sol-gels, esterified lignin particle suspensions, nanostructured fluorinated cellulose esters, micro-sized $CaCO_3$ and fatty acids, supercritical $CO_2$ containing alkyl ketene dimer (AKD), silica particles and polymers dip-coating with AKD, grafting polymers, microcrystalline cellulose, nanocrystalline cellulose, nanostructured cellulose stearoyl esters, cellulose nanofibers functionalized with fluoroalkyl trialkoxysilane, ionic liquids, other suitable compositions or solutions, variations thereof, combinations thereof, and/or the like. In some embodiments, a flux of moisture and dust from an outside surface of the front panel to the inside surface of the front panel is less than a flux threshold.

In some embodiments, the one or more opaque inset panels can overlap one or more inside edges of the one or more apertures defined through the front panel by between about 1 mm and about 1 inch, about 1 mm and about 10 inches, about 1 mm and about 9 inches, about 1 mm and about 8 inches, about 1 mm and about 7 inches, about 1 mm and about 6 inches, about 1 mm and about 5 inches, about 1 mm and about 4 inches, about 1 mm and about 3 inches, about 1 mm and about 2 inches, about 2 mm and about 100 mm, about 3 mm and about 95 mm, about 4 mm and about 90 mm, about 5 mm and about 85 mm, about 6 mm and about 80 mm, about 7 mm and about 75 mm, about 8 mm and about 70 mm, about 9 mm and about 65 mm, about 10 mm and about 60 mm, about 15 mm and about 55 mm, about 20 mm and about 50 mm, about 19 mm and about 45 mm, about 18 mm and about 40 mm, about 17 mm and about 35 mm, about 16 mm and about 30 mm, about 15 mm and about 25 mm, about 14 mm and about 25 mm, about 13 mm and about 25 mm, about 12 mm and about 25 mm, about 11 mm and about 25 mm, about 10 mm and about 25 mm, about 9 mm and about 25 mm, about 8 mm and about 25 mm, about 7 mm and about 25 mm, about 6 mm and about 25 mm, about 5 mm and about 25 mm, about 4 mm and about 25 mm, about 3 mm and about 25 mm, about 2 mm and about 25 mm, or about 1 mm and about 25 mm, inclusive of all values and ranges therebetween. In some embodiments, the one or more opaque inset panels can overlap one or more inside edges of the one or more apertures defined through the front panel by greater than about 1 mm, greater than about 2 mm, greater than about 3 mm, greater than about 4 mm, greater than about 5 mm, greater than about 6 mm, greater than about 7 mm, greater than about 8 mm, greater than about 9 mm, greater than about 10 mm, greater than about 11 mm, greater than about 12 mm, greater than about 13 mm, greater than about 14 mm, greater than about 15 mm, greater than about 16 mm, greater than about 17 mm, greater than about 18 mm, greater than about 19 mm, greater than about 20 mm, greater than about 21 mm, greater than about 22 mm, greater than about 23 mm, greater than about 24 mm, greater than about 25 mm, greater than about 26 mm, greater than about 27 mm, greater than about 28 mm, greater than about 29 mm, greater than about 30 mm, greater than about 35 mm, greater than about 40 mm, greater than about 45 mm, greater than about 50 mm, greater than about 55 mm, greater than about 60 mm, greater than about 65 mm, greater than about 70 mm, greater than about 75 mm, greater than about 80 mm, greater than about 85 mm, greater than about 90 mm, greater than about 95 mm, or greater than about 100 mm, inclusive of all values and ranges therebetween. In some embodiments, the one or more opaque inset panels can overlap one or more inside edges of the one or more apertures defined through the front panel by less than about 1 mm, less than about 2 mm, less than about 3 mm, less than about 4 mm, less than about 5 mm, less than about 6 mm, less than about 7 mm, less than about 8 mm, less than about 9 mm, less than about 10 mm, less than about 11 mm, less than about 12 mm, less than about 13 mm, less than about 14 mm, less than about 15 mm, less than about 16 mm, less than about 17 mm, less than about 18 mm, less than about 19 mm, less than about 20 mm, less than about 21 mm, less than about 22 mm, less than about 23 mm, less than about 24 mm, less than about 25 mm, less than about 26 mm, less than about 27 mm, less than about 28 mm, less than about 29 mm, less than about 30 mm, less than about 35 mm, less than about 40 mm, less than about 45 mm, less than about 50 mm, less than about 55 mm, less than about 60 mm, less than about 65 mm, less than about 70 mm, less than about 75 mm, less than about 80 mm, less than about 85 mm, less than about 90 mm, less than about 95 mm, or less than about 100 mm, inclusive of all values and ranges therebetween.

In some embodiments, the front panel further comprises an outside surface, and wherein the one or more opaque inset panels comprise a front surface and a back surface, the one or more opaque inset panels coupled to the inside surface of the front panel such that a portion of the front surface of each of the one or more opaque panels is viewable through a respective aperture of the one or more apertures through the front panel of the envelope construction. In some embodiments, the inside surface of the front panel has a first optical brightness and the front surface of each of the one or more opaque inset panels has a second optical brightness that is between about 1% and about 10% greater than the first optical brightness. In some embodiments, the inside surface of the front panel has an optical brightness that is 95 or less and the front surface of each of the one or more opaque inset panels has an optical brightness that is greater than 95. In some embodiments, the method can further comprise: printing one or more of a mailing address, a return address, a unique identifier, a logo, an advertisement, a background, a picture, or a symbol onto the front side of each of the one of the one or more opaque inset panels. In some embodiments, the one or more apertures comprise a quantity of apertures between two and about ten, wherein the one or more opaque inset panels comprise a quantity of opaque inset panels between two and about ten, and wherein the quantity of apertures and the quantity of opaque inset panels is the same.

Referring now to FIG. 18, a method 2000 is provided for assembling an envelope, the method 2000 comprising providing a printable material, at 2010, and removing one or more portions of the printable material to form one or more external edges of one or more flaps, at 2020. In some embodiments, the method 2000 can further comprise defining a folding edge in the printable material at an inside edge of each of the one or more flaps to define a front panel of the envelope and one or more flaps, at 2030. In some embodiments, the method 2000 can further comprise removing one or more other portions of the printable material to define one or more apertures through the front panel, at 2040. In some embodiments, the method 2000 can further comprise disposing one or more opaque labeling panels or one or more opaque inset panels to an inner surface of the front panel, such that the one or more opaque labeling panels or the one or more opaque inset panels cover or substantially cover the one or more apertures, at 2050. In some embodiments, the method 2000 can, optionally, further comprise adhesively coupling a portion of the one or more flaps to the inside surface of the front panel to form the back panel of the envelope and an inner volume of the envelope, at 2060. In some embodiments, the method 2000 can, optionally, further comprise disposing at least one piece of mail into the inner volume of the envelope, at 2070. In some embodiments, the method 2000 can, optionally, further comprise adhesively coupling a remaining portion of the one or more flaps to the inside surface of the front panel to seal the envelope against flux of moisture and contaminants into the inner volume of the envelope, at 2080.

Referring now to FIG. 19, a method 3000 is provided for selecting appropriate envelope components for an item of mail and assembling the envelope from the components. In some embodiments, the method 3000 can comprise providing one or more items of mail, at 3010, and selecting, based at least in part upon, one or more of a size, shape, mass, thickness, volume, or other characteristic(s) of the one or more items of mail, a particular envelope defining one or more apertures through a front pane thereof, at 3020. In some embodiments, the method 3000 can further comprise selecting, based at least in part upon the particular envelope selected, one or more opaque labeling panels or one or more opaque inset panels to which desired printed content is to be printed, the desired printed content comprising one or more of text, numbers, a bar code, a QR code, a symbol, a mark, an illustration, an image, or the like, at 3030. In some embodiments, the method 3000 can further comprise disposing ink, according to a predetermined pattern indicative of desired printed content, onto an opaque labeling panel or an opaque inset panel, at 3040. In some embodiments, the method 3000 can further comprise disposing the opaque labeling panel onto an inside surface of the envelope, at 3050. In some embodiments, the method 3000 can further comprise joining one or more flaps to a front panel of the envelope to form an assembled envelope defining an inner volume, at 3060. In some embodiments, the method 3000 can further comprise disposing the one or more items of mail into the inner volume of the envelope, at 3070. In some embodiments, the method 3000 can further comprise sealing the envelope to enclose the piece of mail within the envelope, at 3080.

As described generally herein are envelopes and methods for manufacturing the same, among other associated constructions, methods, apparatuses, and systems. In some embodiments, a high-integrity opaque-inset panel envelope includes a front panel formed from a printable material, one or more apertures being defined therethrough, and one or more opaque inset panels disposed on an inner surface of the front panel to cover the one or more apertures. Opaque labeling panels and/or opaque inset panels can have an optical brightness about 1-6% greater than the optical brightness of the printable material. The envelope can be formed by removing portions of a printable material to form one or more flaps about a front panel and one or more apertures through the front panel and disposing one or more opaque inset panels to an inner surface of the front panel such that the one or more opaque inset panels covers the one or more apertures.

In some embodiments, an envelope construction is provided that comprises: a front panel formed from a printable material, the front panel comprising an inside surface and one or more apertures through the front panel, the one or more apertures defining one or more windows having a plurality of window edges; and one or more opaque inset panels coupled to the inside surface of the front panel, the one or more opaque inset panels being positioned on the inside surface of the front panel such that an opaque inset panel of the one or more opaque inset panels covers each of the one or more apertures such that the one or more apertures through the front panel are substantially sealed. In some embodiments, the one or more opaque inset panels are coupled to the inside surface of the front panel using an adhesive. In some embodiments, the adhesive comprises one of a back gum, a seam gum, a glue, an epoxy, a fugitive glue, a resin, a dextrin-containing adhesive, a fastening agent, a sealing agent, a water-soluble adhesive, a polymer, a cross-linking agent, an ethylene vinyl acetate copolymer, a polyvinyl alcohol, starches, animal glues, and mixtures thereof. In some embodiments, the printable material and the one or more opaque inset panels are coated with and/or comprise one or more hydrophobic materials. In some embodiments, a flux of moisture and dust from an outside surface of the front panel to the inside surface of the front panel is less than a flux threshold. In some embodiments, the one or more opaque inset panels overlap one or more inside edges of the one or more apertures defined through the front panel by between about 1 mm and about 1 inch. In some embodiments, the front panel further comprises an outside surface, and wherein the one or more opaque inset panels comprise a front surface and a back surface, the one or more opaque inset panels coupled to the inside surface of the front panel such that a portion of the front surface of each of the one or more opaque panels is viewable through a respective aperture of the one or more apertures through the front panel of the envelope construction. In some embodiments, the inside surface of the front panel has a first optical brightness and the front surface of each of the one or more opaque inset panels has a second optical brightness that is between about 1% and about 10% greater than the first optical brightness. In some embodiments, the inside surface of the front panel has an optical brightness that is 95 or less and the front surface of each of the one or more opaque inset panels has an optical brightness that is greater than 95. In some embodiments, the one or more apertures comprise a quantity of apertures between two and about ten, wherein the one or more opaque inset panels comprise a quantity of opaque inset panels between two and about ten, and wherein the quantity of apertures and the quantity of opaque inset panels is the same.

In some embodiments, a method for forming an envelope can be provided. In some embodiments, the method can comprise: providing an envelope blank comprising a front panel formed from a printable material, the front panel comprising an inside surface and one or more apertures through the front panel, the one or more apertures defining one or more windows having a plurality of window edges; and coupling one or more opaque inset panels to the inside surface of the front panel, the one or more opaque inset panels being positioned on the inside surface of the front panel such that an opaque inset panel of the one or more opaque inset panels covers each of the one or more apertures such that the one or more apertures through the front panel are substantially sealed. In some embodiments, the method can further comprise: disposing an adhesive to one or more of the inside surface of the front panel at one or more locations adjacent to the plurality of window edges of each of the one or more apertures or a front surface of each of the one or more opaque inset panels at one or more locations adjacent to a plurality of edges of each of the one or more opaque inset panels. In some embodiments, the adhesive comprises one of a back gum, a seam gum, a glue, an epoxy, a fugitive glue, a resin, a dextrin-containing adhesive, a fastening agent, a sealing agent, a water-soluble adhesive, a polymer, a cross-linking agent, an ethylene vinyl acetate copolymer, a polyvinyl alcohol, starches, animal glues, and mixtures thereof. In some embodiments, the printable material and the one or more opaque inset panels are coated with and/or comprise one or more hydrophobic materials. In some embodiments, a flux of moisture and dust from an outside surface of the front panel to the inside surface of the front panel is less than a flux threshold. In some embodiments, the one or more opaque inset panels overlap one or more inside edges of the one or more apertures defined through the front panel by between about 1 mm and about 1 inch. In some embodiments, the front panel further comprises an outside surface, and wherein the one or more opaque inset panels comprise a front surface and a back surface, the one or more opaque inset panels coupled to the inside surface of the front panel such that a portion of the front surface of each of the one or more opaque panels is viewable through a respective aperture of the one or more apertures through the front panel of the envelope construction. In some embodiments, the inside surface of the front panel has a first optical brightness and the front surface of each of the one or more opaque inset panels has a second optical brightness that is between about 1% and about 10% greater than the first optical brightness. In some embodiments, the inside surface of the front panel has an optical brightness that is 95 or less and the front surface of each of the one or more opaque inset panels has an optical brightness that is greater than 95. In some embodiments, the method can further comprise: printing one or more of a mailing address, a return address, a unique identifier, a logo, an advertisement, a background, a picture, or a symbol onto the front side of each of the one of the one or more opaque inset panels. In some embodiments, the one or more apertures comprise a quantity of apertures between two and about ten, wherein the one or more opaque inset panels comprise a quantity of opaque inset panels between two and about ten, and wherein the quantity of apertures and the quantity of opaque inset panels is the same.

In some embodiments, an envelope construction can be provided that comprises: an envelope blank formed from a continuous sheet of a printable material, the envelope blank comprising a front panel having an inside surface and an outside surface, one or more apertures being defined through the front panel; and one or more opaque inset panels having a front surface and a back surface, the one or more opaque inset panels being coupled to the inside surface of the front panel, the one or more opaque inset panels being positioned on the inside surface of the front panel such that a portion of the front surface of each of the one or more opaque panels is viewable through a respective aperture of the one or more apertures when viewing the outside surface of the front panel and such that the one or more opaque inset panels cover said one or more apertures, thereby sealing the front panel, wherein the inside surface of the front panel has a first optical brightness and the front surface of each of the one or more opaque inset panels has a second optical brightness that is between about 1% and about 10% greater than the first optical brightness.

In some embodiments, an envelope construction (also referred to herein as "an envelope") can comprise: a front panel formed from a printable material, one or more apertures being defined therethrough; one or more flaps formed integrally from the printable material and extending from one or more edges of the front panel, the one or more flaps being configured to form a back panel of the envelope construction when suitably folded about the one or more edges of the front panel and coupled to the front panel; and one or more opaque inset panels disposed on an inner surface of the front panel and covering the one or more apertures. In some embodiments, the one or more opaque inset panels are adhesively coupled to the inner surface of the front panel. In some embodiments, once the one or more flaps are folded about the one or more edges of the front panel and coupled to the front panel, an assembled envelope is formed. In some embodiments, the printable material comprises or is coated with a hydrophobic material. In some embodiments, the one or more flaps are coupled to the front panel by an adhesive material disposed therebetween. In some embodiments, once the assembled envelope is formed, a flux of moisture and dust from outside the assembled envelope into an inner volume of the assembled envelope is less than a flux threshold. In some embodiments, the printable material has a first optical brightness and the one or more opaque inset panels have a second optical brightness greater than the first optical brightness. In some embodiments, a difference between the second optical brightness and the first optical brightness is greater than about 1% of the first optical brightness. In some embodiments, a difference between the second optical brightness and the first optical brightness is greater than about 5% of the first optical brightness.

In some embodiments, a method for forming an envelope can comprise: providing a printable material; removing one or more portions of the printable material to form one or more external edges of one or more flaps; defining a folding edge in the printable material at an inside edge of each of the one or more flaps to define a front panel of the envelope and one or more flaps; removing one or more other portions of the printable material to define one or more apertures through the front panel; and disposing one or more opaque inset panels to an inner surface of the front panel, such that the one or more opaque inset panels covers the one or more apertures. In some embodiments, the one or more flaps are configured to form a back panel of the envelope when each of the one or more flaps are suitably folded respectively about the folding edge and coupled to the front panel or another of the one or more flaps. In some embodiments, disposing the one or more opaque inset panels to the inner surface of the front panel comprises adhesively coupling the one or more opaque inset panels to the inner surface of the front panel. In some embodiments, the printable material comprises or is coated with a hydrophobic material. In some embodiments, the method can further comprise: adhesively coupling a portion of the one or more flaps to the inside surface of the front panel to form the back panel of the envelope and an inner volume of the envelope; disposing at least one piece of mail into the inner volume of the envelope; and adhesively coupling a remaining portion of the one or more flaps to the inside surface of the front panel to seal the envelope against flux of moisture and contaminants into the inner volume of the envelope.

In some embodiments, an apparatus is provided that comprises at least one processor and at least one memory storing instructions, the at least one memory storing instructions, with the at least one processor, configured to cause the apparatus to at least: cause the formation and assembly of an envelope. In some embodiments, the at least one memory storing instructions, with the at least one processor, can cause the apparatus to at least: provide a printable material; remove one or more portions of the printable material to form one or more external edges of one or more flaps; define a folding edge in the printable material at an inside edge of each of the one or more flaps to define a front panel of the envelope and one or more flaps; remove one or more other portions of the printable material to define one or more apertures through the front panel; and disposing one or more opaque inset panels to an inner surface of the front panel, such that the one or more opaque inset panels covers the one or more apertures. In some embodiments, the one or more flaps are configured to form a back panel of the envelope when each of the one or more flaps are suitably folded respectively about the folding edge and coupled to the front panel or another of the one or more flaps. In some embodiments, disposing the one or more opaque inset panels to the inner surface of the front panel comprises adhesively coupling the one or more opaque inset panels to the inner surface of the front panel. In some embodiments, the printable material comprises or is coated with a hydrophobic material. In some embodiments, the at least one memory storing instructions, with the at least one processor, can cause the apparatus to at least: adhesively couple a portion of the one or more flaps to the inside surface of the front panel to form the back panel of the envelope and an inner volume of the envelope; dispose at least one piece of mail into the inner volume of the envelope; and adhesively couple a remaining portion of the one or more flaps to the inside surface of the front panel to seal the envelope against flux of moisture and contaminants into the inner volume of the envelope.

In some embodiments, a computer program product is provided that comprises a non-transitory computer-readable medium storing computer code, the computer code operable to cause an apparatus to at least: cause the formation and assembly of an envelope. In some embodiments, the computer code can be operable to cause the apparatus to at least: provide a printable material; remove one or more portions of the printable material to form one or more external edges of one or more flaps; define a folding edge in the printable material at an inside edge of each of the one or more flaps to define a front panel of the envelope and one or more flaps; remove one or more other portions of the printable material to define one or more apertures through the front panel; and dispose one or more opaque inset panels to an inner surface of the front panel such that the one or more opaque inset panels covers the one or more apertures. In some embodiments, the one or more flaps are configured to form a back panel of the envelope when each of the one or more flaps are suitably folded respectively about the folding edge and coupled to the front panel or another of the one or more flaps. In some embodiments, disposing the one or more opaque inset panels to the inner surface of the front panel comprises adhesively coupling the one or more opaque inset panels to the inner surface of the front panel. In some embodiments, the printable material comprises or is coated with a hydrophobic material. In some embodiments, the computer code can be operable to cause the apparatus to at least: adhesively couple a portion of the one or more flaps to the inside surface of the front panel to form the back panel of the envelope and an inner volume of the envelope; dispose at least one pieces of mail into the inner volume of the envelope; and adhesively couple a remaining portion of the one or more flaps to the inside surface of the front panel to seal the envelope against flux of moisture and contaminants into the inner volume of the envelope.

In some embodiments, an envelope construction is provided that comprises: an envelope shell formed from a continuous sheet of a printable material, the envelope shell having a front panel and defining an inner volume configured to receive one or more pieces of mail, one or more apertures being defined through the front panel; and one or more opaque inset panels disposed on an inner surface of the front panel and covering the one or more apertures. In some embodiments, the one or more opaque inset panels are coupled to the inner surface of the front panel. In some embodiments, the envelope shell further comprises: one or more flaps integrally formed from the continuous sheet of printable material and foldable about one or more edges of the front panel to form a back panel of the envelope construction when coupled to the front panel. In some embodiments, the printable material comprises or is coated with a hydrophobic material. In some embodiments, the one or more flaps, when folded about the one or more edges of the front panel, are coupled to the front panel by an adhesive material disposed therebetween. In some embodiments, the printable material has a first optical brightness and the one or more opaque inset panels have a second optical brightness that is between about 1% and about 6% greater than the first optical brightness.

In some embodiments, a method is provided for sorting, selecting, and addressing envelopes, the method comprising: disposing ink, according to a predetermined pattern indicative of desired printed content, onto an opaque inset panel, the desired printed content comprising one or more of text, numbers, a bar code, a QR code, a symbol, a mark, an illustration, an image, or the like. The method can further comprise disposing the opaque inset panel onto an inside surface of an unassembled envelope. In some embodiments, the opaque inset panel can be disposed on to the inside surface of an unassembled envelope in order to cover or partially cover an aperture or opening defined through the front of the envelope. In some embodiments, one or more of the printed content on the opaque inset panel can be used to identify a type, a size, a configuration, a client name, a client identifier, a mailing type, an envelope code, or the like. In some embodiments, the method can further comprise providing one or more items of mail; and selecting, based at least in part upon, one or more of a size, shape, mass, thickness, volume, or other characteristic(s) of the one or more items of mail, a particular envelope and one or more particular opaque inset panels to which desired printed content is to be printed. In some embodiments, the method can further comprise: once the desired printed content is printed on the one or more opaque inset panels, the one or more opaque inset panels being disposed onto an inside of the front of the envelope, and a respective piece of mail is disposed within an inner volume of the envelope, sealing the envelope to enclose the piece of mail within the envelope. In some embodiments, the method can further comprise: sorting a plurality of sealed envelopes enclosing a respective piece of mail based at least upon one or more of the printed content on a front side of each respective opaque inset panel. In some embodiments, a common identifier can be printed onto a portion of each envelope shell and a portion of each opaque inset panel such that, once the correct envelope shell is selected for the respective piece of mail to be mailed, an opaque inset panel can be selected, based at least upon the common identifier, that has a correct size, a correct shape, and/or a correct other characteristic for the associated envelope shell, the associated piece of mail, the particular application, and/or other requirements.

In some embodiments, an apparatus is provided that comprises at least one processor and at least one memory storing instructions, the at least one memory storing instructions, with the at least one processor, configured to cause the apparatus to at least: sort, select, and/or address envelopes. In some embodiments, the at least one memory storing instructions, with the at least one processor, can cause the apparatus to at least: dispose ink, according to a predetermined pattern indicative of desired printed content, onto an opaque inset panel, the desired printed content comprising one or more of text, numbers, a bar code, a QR code, a symbol, a mark, an illustration, an image, or the like. In some embodiments, the at least one memory storing instructions, with the at least one processor, can cause the apparatus to at least: dispose the opaque inset panel onto an inside surface of an unassembled envelope. In some embodiments, the opaque inset panel can be disposed on to the inside surface of an unassembled envelope in order to cover or partially cover an aperture or opening defined through the front of the envelope. In some embodiments, one or more of the printed content on the opaque inset panel can be used to identify a type, a size, a configuration, a client name, a client identifier, a mailing type, an envelope code, or the like. In some embodiments, the at least one memory storing instructions, with the at least one processor, can cause the apparatus to at least: provide one or more items of mail; and select based at least in part upon one or more of a size, shape, mass, thickness, volume, or other characteristic(s) of the one or more items of mail, a particular envelope and one or more particular opaque inset panels to which desired printed content is to be printed. In some embodiments, the at least one memory storing instructions, with the at least one processor, can cause the apparatus to at least: once the desired printed content is printed on the one or more opaque inset panels, the one or more opaque inset panels being disposed onto an inside of the front of the envelope, and a respective piece of mail is disposed within an inner volume of the envelope, seal the envelope to enclose the piece of mail within the envelope. In some embodiments, the at least one memory storing instructions, with the at least one processor, can cause the apparatus to at least: sort a plurality of sealed envelopes enclosing a respective piece of mail based at least upon one or more of the printed content on a front side of each respective opaque inset panel. In some embodiments, a common identifier can be printed onto a portion of each envelope shell and a portion of each opaque inset panel such that, once the correct envelope shell is selected for the respective piece of mail to be mailed, an opaque inset panel can be selected, based at least upon the common identifier, that has a correct size, a correct shape, and/or a correct other characteristic for the associated envelope shell, the associated piece of mail, the particular application, and/or other requirements.

In some embodiments, a computer program product is provided that comprises a non-transitory computer-readable medium storing computer code, the computer code operable to cause an apparatus to at least: sort, select, and/or address envelopes. In some embodiments, the computer code can be operable to cause the apparatus to at least: dispose ink, according to a predetermined pattern indicative of desired printed content, onto an opaque inset panel, the desired printed content comprising one or more of text, numbers, a bar code, a QR code, a symbol, a mark, an illustration, an image, or the like. In some embodiments, the computer code can be operable to cause the apparatus to at least: dispose the opaque inset panel onto an inside surface of an unassembled envelope. In some embodiments, the opaque inset panel can be disposed on to the inside surface of an unassembled envelope in order to cover or partially cover an aperture or opening defined through the front of the envelope. In some embodiments, one or more of the printed content on the opaque inset panel can be used to identify a type, a size, a configuration, a client name, a client identifier, a mailing type, an envelope code, or the like. In some embodiments, the computer code can be operable to cause the apparatus to at least: provide one or more items of mail; and select based at least in part upon one or more of a size, shape, mass, thickness, volume, or other characteristic(s) of the one or more items of mail, a particular envelope and one or more particular opaque inset panels to which desired printed content is to be printed. In some embodiments, the computer code can be operable to cause the apparatus to at least: once the desired printed content is printed on the one or more opaque inset panels, the one or more opaque inset panels being disposed onto an inside of the front of the envelope, and a respective piece of mail is disposed within an inner volume of the envelope, sealing the envelope to enclose the piece of mail within the envelope. In some embodiments, the computer code can be operable to cause the apparatus to at least: sorting a plurality of sealed envelopes enclosing a respective piece of mail based at least upon one or more of the printed content on a front side of each respective opaque inset panel. In some embodiments, a common identifier can be printed onto a portion of each envelope shell and a portion of each opaque inset panel such that once the correct envelope shell is selected for the respective piece of mail to be mailed, an opaque inset panel can be selected, based at least upon the common identifier, that has a correct size, a correct shape, and/or a correct other characteristic for the associated envelope shell, the associated piece of mail, the particular application, and/or other requirements.

CONCLUSION

To provide an overall understanding, certain illustrative embodiments have been described; however, it will be understood by one of ordinary skill in the art that systems, apparatuses, and methods described herein can be adapted and modified to provide systems, apparatuses, and methods for other suitable applications and that other additions and modifications can be made without departing from the scope of systems, apparatuses, and methods described herein.

The embodiments described herein have been particularly shown and described, but it will be understood that various changes in form and details may be made. Unless otherwise specified, the illustrated embodiments can be understood as providing exemplary features of varying detail of certain embodiments, and therefore, unless otherwise specified, features, components, modules, and/or aspects of the illustrations can be otherwise combined, separated, interchanged, and/or rearranged without departing from the disclosed systems or methods. Additionally, the shapes and sizes of components are also exemplary and unless otherwise specified, can be altered without affecting the scope of the disclosed and exemplary systems, apparatuses, or methods of the present disclosure.

Conventional terms in the fields of pulp and paper engineering, computer science, envelope manufacturing, and algorithms have been used herein. The terms are known in the art and are provided only as a non-limiting example for convenience purposes. Accordingly, the interpretation of the corresponding terms in the claims, unless stated otherwise, is not limited to any particular definition. Thus, the terms used in the claims should be given their broadest reasonable interpretation.

Although specific embodiments have been illustrated and described herein, it will be appreciated by those of ordinary skill in the art that any arrangement that is adapted to achieve the same purpose may be substituted for the specific embodiments shown. Many adaptations will be apparent to those of ordinary skill in the art. Accordingly, this application is intended to cover any adaptations or variations.

The above detailed description includes references to the accompanying drawings, which form a part of the detailed description. The drawings show, by way of illustration, specific embodiments that may be practiced. These embodiments are also referred to herein as "examples." Such examples may include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," and/or the like are used merely as labels and are not intended to impose numerical requirements or any relative order of operations or organization on their objects.

The above description is intended to be illustrative, and not restrictive. For example, the above-described examples (or one or more aspects thereof) may be used in combination with each other. Other embodiments may be used, such as by one of ordinary skill in the art upon reviewing the above description. The Abstract is provided to comply with 37 C.F.R. § 1.72(b), to allow the reader to quickly ascertain the nature of the technical disclosure and is submitted with the understanding that it will not be used to interpret or limit the scope or meaning of the claims.

In this Detailed Description, various features may have been grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments may be combined with each other in various combinations or permutations. The scope of the embodiments should be determined with reference to the appended claims, along with the full scope of equivalents to which such claims are entitled.

In the claims, as well as in the specification above, all transitional phrases such as "comprising," "including," "carrying," "having," "containing," "involving," "holding," "composed of," and the like are to be understood to be open-ended, e.g., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

The invention claimed is:

1. A method for forming an envelope, the method comprising:

providing an envelope blank comprising a front panel formed from a printable material, the front panel comprising an outside surface, an inside surface, and one or more apertures through the front panel, the one or more apertures defining one or more windows having a plurality of window edges; and coupling one or more opaque inset panels to the inside surface of the front panel, the one or more opaque inset panels being positioned on the inside surface of the front panel such that an opaque inset panel of the one or more opaque inset panels covers each of the one or more apertures such that the one or more apertures through the front panel are covered by at least one of the one or more opaque inset panels, the outside surface of the front panel having a first optical brightness and the front surface of each of the one or more opaque inset panels having a second optical brightness that is between about 1% and about 10% greater than the first optical brightness.

2. The method of claim 1, further comprising:

disposing an adhesive to one or more of the inside surface of the front panel at one or more locations adjacent to the plurality of window edges of each of the one or more apertures or a front surface of each of the one or more opaque inset panels at one or more locations adjacent to a plurality of edges of each of the one or more opaque inset panels.

3. The method of claim 2, wherein the adhesive comprises one of a back gum, a seam gum, a glue, an epoxy, a fugitive glue, a resin, a dextrin-containing adhesive, a fastening agent, a sealing agent, a water-soluble adhesive, a polymer, a cross-linking agent, an ethylene vinyl acetate copolymer, a polyvinyl alcohol, starches, animal glues, and mixtures thereof.

4. The method of claim 1, wherein the printable material and the one or more opaque inset panels are coated with and/or comprise one or more hydrophobic materials.

5. The method of claim 1, wherein a flux of moisture and dust from the outside surface of the front panel to the inside surface of the front panel is less than a flux threshold.

6. The method of claim 1, wherein the one or more opaque inset panels overlap one or more inside edges of the one or more apertures defined through the front panel by between 0.90 mm and 1.10 inch.

7. The method of claim 1, wherein the one or more opaque inset panels comprise a front surface and a back surface, the one or more opaque inset panels coupled to the inside surface of the front panel such that a portion of the front surface of each of the one or more opaque panels is viewable through a respective aperture of the one or more apertures through the front panel of the envelope construction.

8. The method of claim 1, wherein the inside surface of the front panel has an optical brightness that is 95 or less and the front surface of each of the one or more opaque inset panels has an optical brightness that is greater than 95.

9. The method of claim 1, further comprising:

printing one or more of a mailing address, a return address, a unique identifier, a logo, an advertisement, a background, a picture, or a symbol onto the front side of each of the one of the one or more opaque inset panels.

10. The method of claim 1, wherein the one or more apertures comprise a quantity of apertures between one and eleven, wherein the one or more opaque inset panels comprise a quantity of opaque inset panels between one and eleven, and wherein the quantity of apertures and the quantity of opaque inset panels is the same.

11. A method for forming an envelope, the method comprising:

providing an envelope blank comprising a front panel formed from a printable material, the front panel comprising an outside surface, an inside surface, and an aperture through the front panel, the outside surface having a first optical brightness;

providing an opaque inset panel comprising a front surface having a second optical brightness that is between about 1% and about 10% greater than the first optical brightness;

adhesively coupling an interstitial layer to the front surface of the opaque inset pane, the interstitial layer being transparent or translucent such that the front surface of the opaque inset panel is viewable through the interstitial layer; and adhesively coupling the interstitial layer or the opaque inset panel to the inside surface of the front panel of the envelope blank such that the interstitial layer and the opaque inset panel cover the aperture, the interstitial layer and the opaque inset panel being dimensioned and configured to fully cover the aperture.

12. The method of claim 11, wherein the envelope blank further comprises back panel portions, the method further comprising:

forming the envelope by folding at least some of the back panel portions about one or more edges of the front panel in a direction opposite that of the outside surface of the front panel, and adhesively coupling the at least some of the back panel portions together to define an inner volume of the envelope.

13. The method of claim 11, further comprising:

printing one or more of a mailing address, a return address, a unique identifier, a logo, an advertisement, a background, a picture, or a symbol onto the front side of each of the one of the one or more opaque inset panels.

14. The method of claim 11, wherein at least one of the printable material or the opaque inset panel is coated with or comprises a hydrophobic material.

15. A method for forming an envelope, the method comprising:

providing an envelope blank comprising a front panel formed from a printable material and back panel portions, the front panel comprising an outside surface and an inside surface, the outside surface of the front panel of the envelope blank having a first optical brightness, wherein an aperture is defined in a portion of the front panel;

providing an opaque inset panel comprising a front surface having a second optical brightness that is between about 1% and about 10% greater than the first optical brightness of the outside surface of the front panel of the envelope blank; and adhesively coupling the opaque inset panel to the inside surface of the front panel of the envelope blank such that the opaque inset panel covers the aperture and a portion of the front surface of the opaque inset panel is visible through the aperture of the front panel when viewing the outside surface of the front panel, the opaque inset panel being dimensioned and configured to fully cover the aperture from the inside surface of the front panel and seal the front panel of the envelope blank against dust and moisture flux through the aperture.

16. The method of claim 15, further comprising:

printing one or more of a mailing address, a return address, a unique identifier, a logo, an advertisement, a background, a picture, or a symbol onto the front side of each of the one of the one or more opaque inset panels.

17. The method of claim 15, wherein at least one of the printable material or the opaque inset panel is coated with or comprises a hydrophobic material.

18. The method of claim 15, wherein a flux of moisture and dust from the outside surface of the front panel, through the aperture, to the inside surface of the front panel is less than a flux threshold.

19. The method of claim 15, further comprising:

forming the envelope by folding at least some of the back panel portions about one or more edges of the front panel in a direction opposite that of the outer surface of the front panel, and adhesively coupling the at least some of the back panel portions together to define an inner volume of the envelope.

20. The method of claim 15, wherein the envelope blank further comprises a sealing portion, the method further comprising:

disposing one or more mailing materials into the inner volume of the envelope;

folding the sealing portion of the envelope blank about one or more edges of the front panel in the direction opposite that of the outer surface of the front panel, and adhesively coupling the sealing portion to one or more of the back panel portions to seal the envelope, wherein, once the envelope is sealed, a flux of moisture and dust into the inner volume of the sealed envelope is less than a flux threshold.

21. The method of claim 15, further comprising:

adhesively coupling an interstitial layer to the front surface of the opaque inset pane, the interstitial layer being transparent or translucent such that the front surface of the opaque inset panel is viewable through the interstitial layer.

* * * * *